US006131529A

United States Patent [19]

Smith

[11] Patent Number: 6,131,529

[45] Date of Patent: Oct. 17, 2000

[54] WATER GOING VESSEL HULL AND METHOD FOR HULL DESIGN

[75] Inventor: Drexel Kermit Smith, Greenville, N.C.

[73] Assignee: The East Group, Kinston, N.C.

[21] Appl. No.: 09/087,633

[22] Filed: May 29, 1998

Related U.S. Application Data

[60] Provisional application No. 60/048,192, May 31, 1997, and provisional application No. 60/082,606, Apr. 22, 1998.

[51] Int. Cl.[7] ..... B63B 1/00

[52] U.S. Cl. ..... 114/271; 114/61.1

[58] Field of Search ..... 114/56.1, 57, 59, 114/61.1, 61.15, 61.16, 61.17, 61.18, 61.2, 61.28, 61.29, 61.3, 61.31, 61.32, 61.33

[56] References Cited

U.S. PATENT DOCUMENTS

| | | | |
|---|---|---|---|
| 2,141,181 | 12/1938 | Geddes . | |
| 3,094,959 | 6/1963 | Fox . | |
| 3,191,572 | 6/1965 | Wilson . | |
| 3,345,967 | 10/1967 | Sweet | 114/61 |
| 3,611,967 | 10/1971 | Bossler | 114/61 |
| 3,625,173 | 12/1971 | Mitton | 114/61 |
| 3,807,337 | 4/1974 | English et al. | 114/56 |
| 3,885,514 | 5/1975 | Lauenborg | 114/66.5 |
| 3,996,869 | 12/1976 | Hadley | 114/56 |
| 3,996,874 | 12/1976 | Winch | 114/123 |
| 4,004,534 | 1/1977 | Allison | 114/274 |
| 4,091,761 | 5/1978 | Fehn | 114/290 |
| 4,348,972 | 9/1982 | Parsons | 114/61 |
| 4,452,166 | 6/1984 | Daniel | 114/282 |
| 4,494,477 | 1/1985 | Matthews | 114/287 |
| 4,644,890 | 2/1987 | Lott | 114/61 |
| 4,730,570 | 3/1988 | Harris | 114/61 |
| 4,802,427 | 2/1989 | Biegel | 114/61 |
| 4,821,663 | 4/1989 | Schad | 114/43 |
| 4,986,204 | 1/1991 | Yoshida | 114/61 |
| 5,107,783 | 4/1992 | Magazzù | 114/123 |
| 5,178,085 | 1/1993 | Hsu | 114/61 |
| 5,191,849 | 3/1993 | Labrucherie et al. | 114/61 |
| 5,211,126 | 5/1993 | Johnson | 114/61 |
| 5,231,949 | 8/1993 | Hadley | 114/271 |
| 5,237,947 | 8/1993 | Manning | 114/61 |
| 5,243,924 | 9/1993 | Mann | 114/61 |
| 5,265,554 | 11/1993 | Meredith | 114/290 |
| 5,269,245 | 12/1993 | Bystedt et al. | 114/61 |
| 5,325,804 | 7/1994 | Schneider | 114/61 |
| 5,435,260 | 7/1995 | Granie et al. | 114/61 |
| 5,529,009 | 6/1996 | Faury et al. | 114/61 |
| 5,611,294 | 3/1997 | Burg | 114/61 |
| 5,619,944 | 4/1997 | Baker | 114/61 |

OTHER PUBLICATIONS

PCT International Search Report dated Oct. 23, 1998.

Lewis, E.V. (Ed.), *Principles of Naval Architecture, Second Revision, vol. 1, Stability and Strength,* 1988, Society of Naval Architects and Marine Engineers (Pub.).

*Primary Examiner*—Jesus D. Sotelo

*Attorney, Agent, or Firm*—Wilburn L. Chesser; Jones Jain, L.L.P.

[57] ABSTRACT

The present invention provides a design for a water going vessel hull and a method for determining useful hull design, and particularly multihull design, with emphasis on applicability to smaller trimaran vessels operating as displacement hulls but at speeds comparable to planing hulls. The present invention further relates to a trimaran design that includes a slender displacement type main hull with two outrigger hulls. More particularly, the invention relates to a boat hull that utilizes planing hulls or slender ellipsoidal displacement hulls as outrigger hulls, and an ellipsoidal hull (preferably, one which is longitudinally non-symmetric with and without a transom stern) as a main hull.

32 Claims, 76 Drawing Sheets

TABLE I

REFERENCE HULL SHAPE DATA vs. PROLATE SPHEROID

| SOURCE | $F_N$ | $C_B$ | $C_M$ | $C_P$ | $C_{WP}$ | L/B | $L/\nabla^{1/3}$ |
|---|---|---|---|---|---|---|---|
| REF. I, VOL. II, CH5 | | | | | | | |
| TABLE 17. PG. 70 | >0.45 | 0.46–0.54 | 0.76–0.85 | 0.56–0.64 | 0.68–0.76 | — | — |
| FIG. 62, PG. 69 | 0.60 | — | — | 0.62–0.64 | — | — | 8.2–9.4 |
| SEC. 8.6, PG. 73-74 | 0.60 | — | — | 0.65–0.67 | — | — | 8.7 |
| REF 3, PG 80 | 1.00 | — | — | 0.70 | — | — | — |
| SYMETRICAL PROLOTE SPHEROID | — | 0.52 (π/6) | 0.76 (π/4) | 0.67 (2/3) | 0.76 (π/4) | | |
| | | " | " | " | " | 14 | 9.08 |
| | | " | " | " | " | 12 | 8.19 |
| | | " | " | " | " | 10 | 7.26 |
| | | " | " | " | " | 8 | 6.25 |

FIG. 2

TABLE 2

DISPLACEMENT HULL SERIES DATA FROM REFERENCE 1

| | $F_N$ | L/B | B/T | $C_B$ | $C_P$ | $S/\sqrt{\nabla L}$ | $L/\nabla^{1/3}$ |
|---|---|---|---|---|---|---|---|
| DEGROUT | 0.30 — 1.04 | 3.5 — 10.09 | 2.72 — 6.58 | 0.293 — 0.560 | 0.463 — 0.791 | 2.75 | 5.5 — 9.0 |
| SSPA | 0.40 — 1.20 | 4.62 — 8.21 | 3.0 — 4.0 | 0.40 | 0.68 | 2.90 — 3.00 | 5.5 — 8.1 |
| NPL (A) | 0.30 — 1.19 | 3.3 | 3.19 — 10.21 | 0.397 | 0.693 | 2.8 — 3.9 | 4.4 — 6.6 |
| NPL (B) | 0.30 — 1.19 | 5.41 | 1.90 — 4.86 | 0.397 | 0.693 | 2.6 — 3.0 | 5.1 — 7.3 |
| NPL (C) | 0.3 — 1.19 | 7.5 | 2.01 — 4.20 | 0.397 | 0.693 | 2.7 — 3.2 | 6.4 — 8.4 |
| SERIES 64 | 0.06 — 1.50 | 8.45 — 18.26 | 3.0 | 0.35 — 0.56 | 0.63 | 2.6 — 3.0 | 8.04 — 12.40 |

FIG. 3

TABLE 3

REF. HULL DATA vs PROLOTE SPHEROID DATA vs SERIES 64 HULL DATA

| SOURCE | $F_N$ | $C_B$ | $C_M$ | $C_P$ | $C_{WP}$ | L/B | $L/\nabla 1/3$ |
|---|---|---|---|---|---|---|---|
| REF. 1, VOL II, CH 5 | | | | | | | |
| TABLE 17, PG. 70 | 70 .45 | 0.46-0.54 | 0.76-0.85 | 0.56-0.64 | 0.68-0.76 | | |
| FIG. 62, PG. 69 | 0.60 | | | 0.62-0.67 | | | 8.2-9.4 |
| SEC. 8.6. PG.73-74 | 0.60 | | | 0.65-0.67 | | | 8.7 |
| REF. 3 PG. 80 | 1.00 | | | 0.70 | | | |
| SYMETRICAL PROLOTE | | 0.52 (11/6) | 0.76 (11/4) | 0.67 (2/3) | 0.76 (11/4) | | |
| | | " | " | " | " | 14 | 9.08 |
| | | " | " | " | " | 12 | 8.19 |
| | | " | " | " | " | 12 | 7.26 |
| | | " | " | " | " | 8 | 6.25 |
| SERIES 64 HULL A | (0.060-1.50) | 0.55 | 0.873 | 0.63 | 0.761 | 9.762 | 8.04 |
| B | | " | " | " | " | 11.447 | 8.94 |
| C | | " | " | " | " | 14.479 | 10.45 |
| D | | 0.45 | 0.714 | " | " | 9.762 | 8.59 |
| E | | " | " | " | " | 11.487 | 9.58 |
| F | | " | " | " | " | 14.643 | 11.26 |
| G | | 0.35 | 0.556 | " | " | 9.762 | 9.35 |
| H | | " | " | " | " | 11.551 | 10.45 |
| I | | " | " | " | " | 14.913 | 12.40 |

FIG. 4

TABLE 4

| | 20 KNOTS | | | | 30 KNOTS | | | |
|---|---|---|---|---|---|---|---|---|
| | $R_T/W_T$ | $R_F/W_T$ | $R_R/W_T$ | $F_N$ | $R_T/W_T$ | $R_F/W_T$ | $R_R/W_T$ | $F_N$ |
| SMALLER HULLS | | | | | | | | |
| HULL A ($L_W$ = 48 FT.) | 0.082 (100%) | 0.044 (53.4%) | 0.038 (46.6%) | 0.859 | 0.159 (100%) | 0.093 (58.4%) | 0.066 (41.6%) | 1.290 |
| HULL C ($L_W$ = 62.39 FT.) | 0.073 (100%) | 0.048 (65.9%) | 0.025 (34.1%) | 0.754 | 0.149 (100% | 0.102 (68.4%) | 0.047 (31.6%) | 1.130 |
| %Δ C vs A | −10.8% | +10.1% | −34.6% | | −6.3% | +9.8% | −28.8% | |
| | | | | | | | | |
| LARGER HULLS | | | | | | | | |
| HULL A ($L_W$ = 200 FT.) | 0.026 (100%) | 0.009 (33.7%) | 0.017 (66.3%) | 0.407 | 0.050 (100%) | 0.019 (37.0%) | 0.032 (63.0%) | 0.630 |
| HULL C ($L_W$ = 159.96 FT.) | 0.020 (100%) | 0.009 (48.5%) | 0.010 (51.5%) | 0.362 | 0.039 (100%) | 0.020 (52.3%) | 0.019 (47.7%) | 0.550 |
| %Δ C vs A | −23.4% | +10.5% | −40.6% | | −22.5% | +9.5% | −41.3% | |

FIG. 12

TABLE 5

SMALLER HULL
MULTIHULL RESISTANCE vs HULL #25, APPENDIX 4 (SABRELINE 47)
HULL BASIS; $R_T/W_T$ = 0.148 @ 24 KNOTS, $L_W$ = 44 FT, $F_N$ = 1.08

| DISPLACEMENT DISTRIBUTION (CENTER HULL / OUTRIGGERS) | $F_N$ (CENT.) / $F_N$ (OUT.) | $R_F$ (CENTR.) / $R_R$ | $R_F$ (OUTRIG.) / $R_R$ | $L_W$ (CENT.) / $L_W$ (OUTRIG.) | $R_T$ (OUTRIG.) / $R_T$ | $R_T/W_T$ |
|---|---|---|---|---|---|---|
| HULL A | | | | | | |
| 100%/0% | 0.87/ — | 52%/48% | — | 67.9'/ — | 0 | 0.080 |
| 90%/10% | 0.88/1.43 | 53%/47% | 59%/41% | 65.5'/25.0' | 23% | 0.096 |
| 80%/20% | 0.90/1.27 | 54%/46% | 61%/39% | 63.0'/31.5' | 32% | 0.101 |
| 70%/30% | 0.92/1.19 | 54%/46% | 61%/39% | 60.3'/36.1' | 40% | 0.104 |
| 1/3 / 2/3 | 1.04/1.04 | 58%/42% | | 47.1'/47.1' | 67% | 0.109 |
| 0%/100% | — /0.97 | — | 56%/44% | /53.9' | 100% | 0.097 |
| HULL C | | | | | | |
| 100%/0% | 0.76/ — | 64%/36% | — | 88.2'/— | 0 | 0.072 |
| 90%/10% | 0.78/1.25 | 65%/35% | 70%/30% | 85.2'/32.5' | 24% | 0.086 |
| 80%/20% | 0.79/1.12 | 66%/34% | 71%/29% | 81.9'/41.0' | 33% | 0.092 |
| 70%/30% | 0.81/1.04 | 66%/34% | 71%/29% | 78.3'/46.9' | 43% | 0.097 |
| 1/3 / 2/3 | 0.91/0.91 | 69%/31% | | 61.2'/61.2' | 67% | 0.101 |
| 0%/100% | — /0.85 | — | 68%/32% | — /70.0' | 100% | 0.088 |

FIG. 20

TABLE 6

LARGER HULL
MULTIHULL RESISTANCE vs HULL #5, APPENDIX 4 (CORVETTE)
HULL BASIS; $R_T/W_T$ = 0.064 @ 33 KNOTS, $L_W$ = 251 FT. $F_N$ = 0.62

| DISPLACEMENT DISTRIBUTION (CENTER HULL / OUTRIGGERS) | $F_N$ (CENT.) / $F_N$ (OUT.) | $R_F$ (CENTR.) / $R_R$ | $R_F$ (OUTRIG.) / $R_R$ | $L_W$ (CENTR.) / $L_W$ (OUTRIG.) | $R_T$ (OUTRIG) / $R_T$ | $R_T/W_T$ |
|---|---|---|---|---|---|---|
| HULL A | | | | | | |
| 100%/0% | 0.61/— | 35%/65% | — | 261'/0 | 0 | 0.047 |
| 90%/10% | 0.62/1.00 | 35%/65% | 54%/46% | 252.4'/96.3' | 17.8% | 0.054 |
| 80%/20% | 0.63/0.89 | 36%/64% | 50%/50% | 242.7'/121.3' | 28.0% | 0.055 |
| 70%/30% | 0.65/0.83 | 37%/63% | 48%/52% | 232.1'/138.9' | 37.1% | 0.057 |
| 1/3/2/3 | 0.73/0.73 | 42%/58% | 42%/58% | 181.3'/181.3' | 66.7% | 0.059 |
| 0%/100% | — /0.68 | — | 40%/60% | — /207.5' | 100% | 0.054 |
| HULL C | | | | | | |
| 100%/0% | 0.53/— | 50%/50% | — | 339.8'/— | 0 | 0.036 |
| 90%/10% | 0.54/0.88 | 52%/48% | 66%/34% | 328.0'/125.2' | 20.3% | 0.042 |
| 80%/20% | 0.55/0.78 | 52%/48% | 63%/37% | 315.4'/157.7' | 30.9% | 0.045 |
| 70%/30% | 0.57/0.73 | 52%/48% | 61%/39% | 301.7'/180.5' | 39.7% | 0.047 |
| 1/3/2/3 | 0.64/0.64 | 56%/44% | 56%/44% | 235.6'/225.6' | 66.7% | 0.050 |
| 0%/100% | — /0.60 | — | 54%/46% | — /269.7' | 100% | 0.044 |

FIG. 22

LONGITUDINALLY NONSYMETRICAL vs SYMETRICAL PROLATE SPHEROID

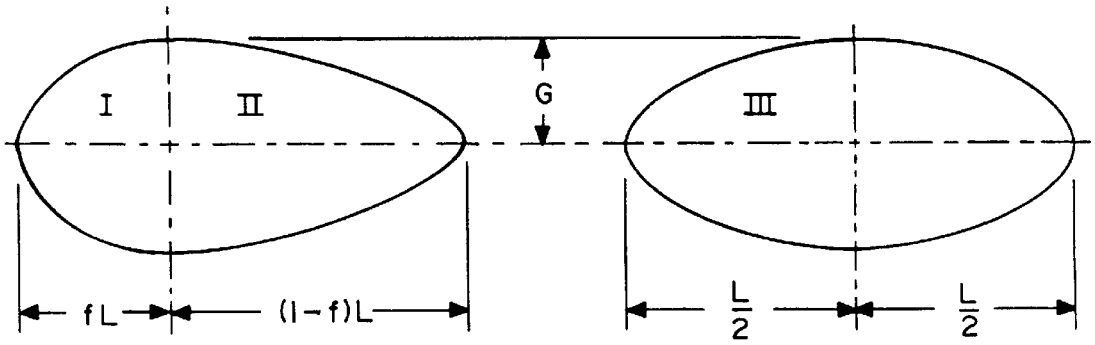

$$\nabla_I = \tfrac{1}{2}\left[\tfrac{4}{3}\pi G^2(fL)\right],\ \nabla_{II} = \tfrac{1}{2}\left[\tfrac{4}{3}\pi G^2(1-f)L\right]$$

$$\nabla_I + \nabla_{II} = \tfrac{1}{2}\left[\tfrac{4}{3}\pi G^2(fL) + \tfrac{4}{3}\pi G^2(1-f)L\right] = \tfrac{4}{3}\pi G^2\left(\tfrac{L}{2}\right) = \nabla_{III}$$

$$A_{WP_I} = \tfrac{1}{2}\left[\pi G(fL)\right],\quad A_{WP_{II}} = \tfrac{1}{2}\left[\pi G(1-f)L\right]$$

$$A_{WP_I} + A_{WP_{II}} = \tfrac{1}{2}\left[\pi G(fL) + \pi G(1-f)L\right] = \pi G\frac{L}{2} = A_{WP_{III}}$$

$$C_B = \frac{\nabla_I \nabla_{II}}{L(2G)^2} = \frac{\nabla_{III}}{L(2G)^2} = \frac{\tfrac{4}{3}\pi G^2(L/2)}{L\,4G^2} = \frac{\pi}{6} = 0.5236$$

$$C_M = \frac{\pi G^2}{(2G)^2} = \frac{\pi}{4} = 0.7854$$

$$C_P = \frac{C_B}{C_M} = \pi/6 \Big/ \pi/4 = 2/3 = 0.6667$$

$$C_{WP} = \frac{A_{WP_{III}}}{L(2G)} = \frac{\pi G\, L/2}{2GL} = \frac{\pi}{4} = 0.7854$$

FIG. 23

LCB FOR THE LNSPS HULL SHAPE $$x_0^2/a^2 + y_0/G^2 = 1$$

$$x_0 = x - a_1 = x_1 - fL$$

$$(x - fL)^2/(fL)^2 + y_1^2/G^2 = 1$$

$$a_2 = (1-f)L$$

$$\frac{(x-fL)^2}{[(1-f)L]^2} + \frac{y_2^2}{G^2} = 1$$

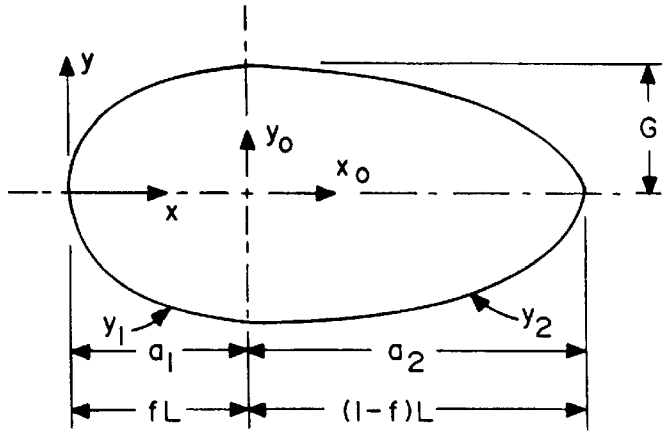

$$LCB = \frac{1}{\nabla}\int_0^L x\,d\nabla = \frac{1}{\nabla}\int_0^L x A_x\,dx = \frac{\pi}{2\nabla}\left[\int_0^L x y_1^2\,dx + \int_0^L x\,y_2^2\,dx\right]$$

$$y_1^2 = G^2\left[1 - \frac{(x-fL)^2}{(fL)^2}\right], \quad y_2^2 = G^2\left[1 - \frac{(x-fL)^2}{[(1-f)L]^2}\right]$$

$$\nabla = \tfrac{4}{3}\pi G^2 (L/2)$$

THE SOLUTION IS:

$$LCB = \tfrac{3}{2}L\left(\tfrac{1}{4} + \tfrac{f}{6}\right), \quad \tfrac{G}{L} \leq f \leq \left(1 - \tfrac{G}{L}\right) \quad \cdots\cdots\cdots\cdots (16)$$

(NOTE: LCB HERE IS REFERENCED TO THE AXIS AT AFT END)

FIG. 23A

LNSPS WITH A TRANSOM STERN

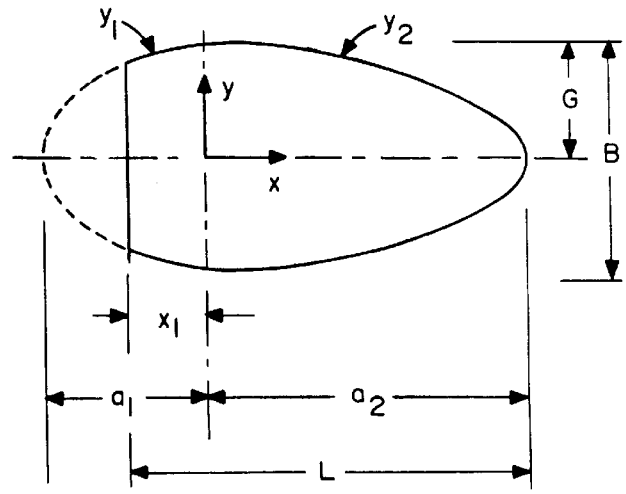

$$\frac{x^2}{a_1^2} + \frac{y_1^2}{G^2} = 1$$

$$\frac{x^2}{a_2^2} + \frac{y_2^2}{G^2} = 1$$

$$\nabla = \int_{-x_1}^{0} \frac{\pi y_1^2}{2}\,dx + \int_{0}^{a_2} \frac{\pi y_2^2}{2}\,dx$$

$$\nabla = \frac{\pi G^2}{2}\left(x_1 - \frac{x_1^3}{3a_1^2} + \frac{2}{3}\,a_2\right) \text{----(17)}$$

$$(LCB)\nabla = \int_{-x_1}^{a_2} x\,d\nabla = \frac{\pi}{2}\left[\int_{-x_1}^{0} x y_1^2\,dx + \int_{0}^{a_2} x y_2^2\,dx\right] = \frac{\pi G^2}{2}\left(\frac{a_2^2}{4} - \frac{x_1^2}{2} + \frac{x_1^4}{4a_1^2}\right)$$

$$LCB = \frac{(LCB)\nabla}{\nabla} = \frac{\left(\frac{a_2^2}{4} - \frac{x_1^2}{2} + \frac{x_1^4}{4a_1^2}\right)}{\left(x_1 - \frac{x_1^3}{3a_1^2} + \frac{2a_2}{3}\right)} \quad (18)$$

NOTE: LCB HERE IS REFERENCED TO THE MAXIMUM BEAM OR SECTIONAL AREA LOCATION, X = 0

$$A_{WP} = \int_{-x_1}^{0} 2y\,dx + \frac{\pi a_2 G}{2}, \quad y_1 = G\sqrt{1 - \frac{x^2}{a_1^2}}$$

$$A_{WP} = \frac{G}{a_1}\left(x_1\sqrt{a_1^2 - x_1^2} + a_1^2 \sin^{-1}\frac{x_1}{a_1}\right) + \frac{\pi a_2 G}{2} \text{----------(19)}$$

FIG. 24

HULL SHAPE PR

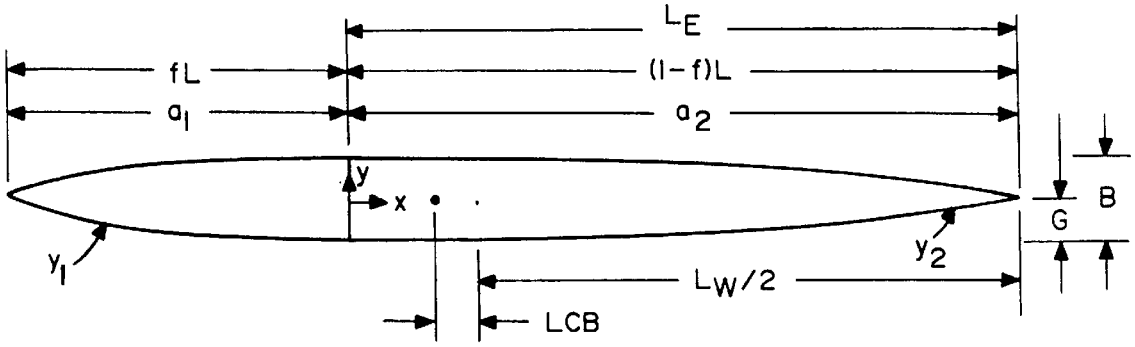

$$\frac{x^2}{a_1^2} + \frac{y_1^2}{G^2} = 1, \quad \frac{x^2}{a_2^2} + \frac{y_2^2}{G^2} = 1, \quad \text{FOR } \frac{G}{L} \leq f \leq \frac{1}{2} \text{ AND } \frac{L}{B} \geq 1$$

$C_M = \pi/4$, (0.7854)

$C_P = 2/3$, (0.6667)

$C_B = \pi/6$, (0.5236)

$C_{WP} = \pi/4$, (0.7854)

$LCB = L/4\,(1/2 - f)$ $L_E/L = (1-f) = a_2/(a_1 + a_2)$ $$\frac{S_W L_W}{\nabla} = 3 + \frac{3L}{B}\left[\frac{f\,\mathrm{SIN}^{-1} G_1}{E_1} + (1-f)\frac{\mathrm{SIN}^{-1} G_2}{E_2}\right] \text{----------(14)}$$

$$E_1 = \sqrt{1-\left(\frac{G}{fL}\right)^2}, \quad E_2 = \sqrt{1-\left[\frac{G}{(1-f)L}\right]^2}$$

MIN. $\frac{S_W L}{\nabla}$ AT $f = 0.5$ (THE SYMETRICAL PROLATE SPHEROID; $a_1 = a_2$)

BUT VARIANCE OF $\frac{S_W L_W}{\nabla}$ vs f IS<1% FOR WIDE RANGE OF f AND $L/B \geq 10$

FIG. 29

HULL SHAPE PR-T

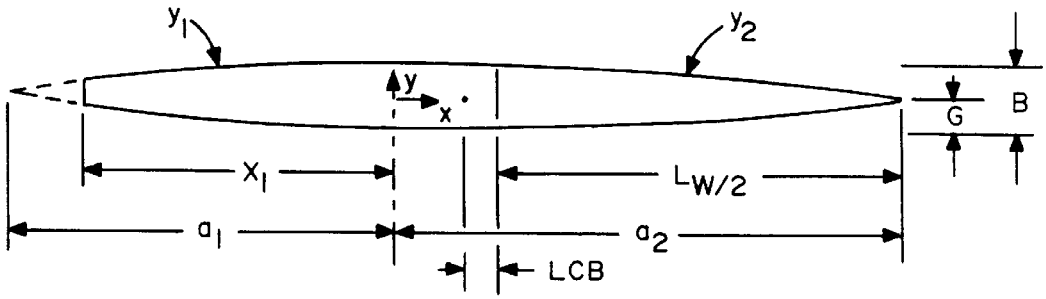

$$C_M = \pi/4$$

$$LCB = \frac{\left(a_2^2/4 - X_1^2/2 + X_1^4/4a_1^2\right)}{\left(X_1 - X_1^3/3a^2 + 2/3a_2\right)} \text{ ---------- (19)}$$

$$C_B \; \pi/4 \left[a_1\left(X_1/a_1 - X_1^3/3a_1^2\right) + 2/3\, a_2\right]\left(X + a^2\right)^{-1} \text{ ------- (20)}$$

$$\text{FOR MAX } C_B,\ \frac{dC_B}{dX_1} = 0,\ 2X_1^3 + 3a_2X_1^2 - a_1^2 a_2 = 0 \text{ ------- (21)}$$

$$C_P = C_B / C_M$$

$$C_{WP} = \frac{a_2}{2(X + a_2)}\left[\frac{X_1}{a_1}\sqrt{1-\left(\frac{X_1}{a_1}\right)^2} + \sin^{-1}\frac{X_1}{a} + \frac{\pi a_2}{2a_1}\right] \text{ -------- (22)}$$

$$\text{FOR MAX } C_{WP}\ \frac{dC_{WP}}{dX_1} = 0,\ \left(\frac{2X_1}{a_1} + \frac{4a_2}{a_1}\right)\sqrt{a_1^2 - X_1^2} - 2a \sin^{-1}\left(\frac{X_1}{a_1}\right) - 11a_2 = 0 \text{ (23)}$$

$$\frac{S_W L_W}{\nabla} = \frac{(X_1 + a_2)}{G}\left[2\int_0^{X_1}\left[1 - \left(1 - \frac{G^2}{a_1^2}\right)\left(\frac{X_1}{a_1}\right)^2\right]dX + \frac{a_2 \sin^{-1} E}{E} + G\right]\left(X\frac{X_1^3}{3a_1^2} + \frac{2}{3}a_2\right)^{-1} \text{ -(24)}$$

$$\text{WHERE } E = \sqrt{1 - \left(\frac{G}{a_2}\right)^2}$$

FOR MIN $\frac{S_W L}{\nabla}$, HUMERICAL SOLUTION FOR EQN. 24 IS REQUIRED

FIG. 30

HULL SHAPE PR-TM

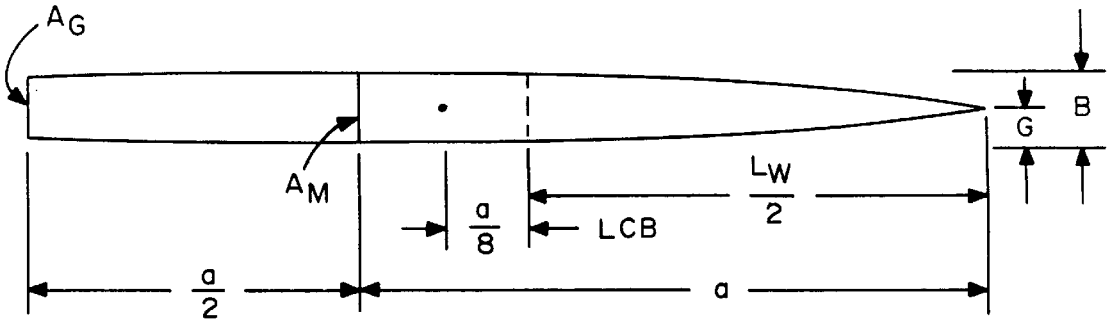

$a_1 = a_2 = a$ $\frac{L}{B} = \frac{3}{4}\frac{a}{G}$ $\frac{A_O}{A_M} = \frac{3}{4}$, (0.7500) STERN WETTED SECTION AREA/MAX. WETTED SECTION AREA $C_M = \pi/4$, (0.7854)

$C_P = 3/4$, (0.7500) MAX. FOR PROLATE SPHEROID WITH TRANSOM STERN $C_B = 3\pi/16$, (0.5890) MAX. FOR PROLATE SPHEROID WITH TRANSOM STERN $C_{WP} = 0.8425$ NEAR MAX. FOR PROLATE SPHEROID WITH TRANSOM STERN (ACTUAL MAX. $C_{WP} = 0.8428$ a X /a = 0.5382

$\frac{SL}{\nabla}$ = MINIMUM (FOR GIVEN L/B) FOR PROLATE SPHEROID WITH TRANSOM STERN (SEE FIGURE 20)

LCB/L = 7/12, (0.5833) (REF. HULL FP)

LE/L = 2/3, (0.6667)

FIG. 31

SECTIONAL AREA CURVES

| HULL | TYPE | NOTE | $C_P$ | $C_M$ | $L_E/L$ |
|---|---|---|---|---|---|
| 1 | PR | $a_1 = a_2$ | 2/3 | $\pi/6$ | 1/2 |
| 2 | PR | $a_1 = a_2/2$ | 2/3 | $\pi/6$ | 2/3 |
| 3 | PR-TM | $a_1 = a_2$ | 3/4 | $3\pi/16$ | 2/3 |

B—B 0 1 2 3 4 5 6 7 8 9 10 11 12 13 14 15 16 17 18 19 20 21 22 23 24 25 26 27 28 29 30 31 32 33 34 35 36 37 38 39 40 41 42 43 44 45 46 47 48 49

A—A

C-C
D-D
E-E
F-F
G-G
H-H
I-I
J-J
K-K
L-L
M-M
N-N

WATER PLANE FOR CENTRAL HULL WITH DIFFERENT TRANSOM STERNS

THE TANK SHAPE FACTOR

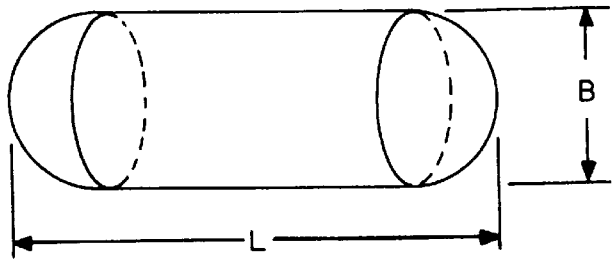

TANK VOLUME ; $\nabla_T = (2)\left(\frac{1}{2}\right)\frac{4}{3}\pi\left(\frac{B}{2}\right)^3 + \pi\left(\frac{B}{2}\right)^2 (L-B)$ $$\nabla_T = \frac{11}{4} B^3 \left(K - \frac{1}{3}\right) \quad \text{WITH } K = L/B$$

TANK SURFACE AREA; $S_T = (2)\left(\frac{1}{2}\right) 4\pi\left(\frac{B}{2}\right)^2 + \pi B(L-B) = \pi BL$ $$S_T = \pi BL$$

$$\frac{S_T}{\nabla_T} = \pi BL/\pi\left(\frac{B}{2}\right) = (L-B) = 4\,\frac{L}{B}\left(L - \frac{B}{3}\right)^{-1} = \left(\frac{4K}{K-\frac{1}{3}}\right)\frac{1}{B}$$

LET $\nabla_T = \nabla_S = \frac{4}{3}\pi R^3$ ; $B = \left(\frac{16}{3}\right)^{\frac{1}{3}}\left(K - \frac{1}{3}\right)^{-\frac{1}{3}} R$ $$F = \frac{S_T}{\nabla_T}\Big/\frac{S_S}{\nabla_S} = \left[\frac{4}{\left(K-\frac{1}{3}\right)}\;\frac{1}{\left(\frac{16}{3}\right)^{\frac{1}{3}}\left(K-\frac{1}{3}\right)^{-\frac{1}{3}} R}\right]\left(\frac{3}{R}\right)^{-1}$$

$$\boxed{F_T = \left(\frac{2}{3}\right)^{\frac{2}{3}} K\left(K - \frac{1}{3}\right)^{-\frac{2}{3}} \quad \text{WITH } K = L/B}$$

FIG. 62

THE PROLATE SPHEROID SHAPE FACTOR

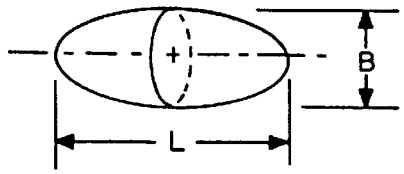

P. S. VOLUME ; $\nabla_E = \frac{4}{3}\pi\left(\frac{L}{2}\right)\left(\frac{B}{2}\right)^2 = \frac{\pi}{6}KB^3$ WITH $K = L/B$ P. S. SURFACE AREA; $S_E = 2\pi\left(\frac{B}{2}\right)^2 + 2\pi\left(\frac{L}{2}\right)\left(\frac{B}{2}\right)\frac{\sin^{-1}G}{G}$ ; $G = \sqrt{1-K^2}$ $$= \frac{3}{KB}\left(1 + K\frac{\sin^{-1}G}{G}\right)$$

$$\frac{S_E}{\nabla E} = (\pi B^2/2)\left(1 + K\frac{\sin^{-1}G}{G}\right)\left(\frac{\pi KB^2}{6}\right)^{-1} = \frac{3}{KB}\left(1 + K\frac{\sin^{-1}G}{G}\right)$$

LET $\nabla_E = \nabla_S = \frac{4}{3}\pi R^3$; $B = 2K^{-\frac{1}{3}}R$ $$F_E = \frac{S_E}{\nabla_E}\Big/\frac{S_S}{\nabla_S} = \frac{S_E}{\nabla_E}\Big/\frac{3}{R} = \frac{3}{K(2K^{-\frac{1}{3}}R)}\left(1 + \frac{K\sin^{-1}G}{G}\right)\left(\frac{R}{3}\right)$$

$$\boxed{F_E = \frac{K^{-\frac{2}{3}}}{2}\left(1 + \frac{K\sin^{-1}G}{G}\right) \quad \text{WITH } G = \sqrt{1-K^2} \text{ AND } K = L/B}$$

FIG. 63

PARTIALLY SUBMERGED SPHERE SHAPE FACTOR
(BASED ON HALF-SUBMERGED SPHERE)

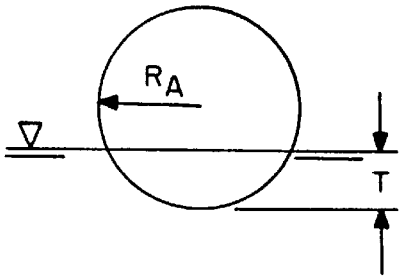

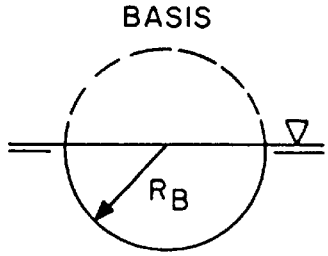

DISPLACEMENT; $\nabla_A = \frac{\pi}{3} T^2(3R_A - T) = R_A^3 \frac{\pi}{3} K^2(3-K)$, $K = T/R_A$ WETTED SURFACE; $S_{WA} = 2\pi R_A T = 2\pi R_A^2 K$ $$\frac{S_{WA}}{\nabla_A} = \frac{2\pi R_A^2 K}{R_A^3 \frac{\pi}{3} K^2(3-K)} = \frac{6}{R_A}\left[K(3-K)\right]^{-1}$$

$$\nabla_B = \frac{1}{2}\left(\frac{4}{3}\pi R_A^3\right), \quad S_{WB} = \frac{1}{2}\left(4\pi R_B^2\right); \quad \frac{S_{WB}}{\nabla_B} = \frac{3}{R_B}$$

LET $\nabla_A = \nabla_B$, $R_A^3 \frac{\pi}{3} K^2(3-K) = \frac{2}{3}\pi R_B^3$ ; $R_A = R_B\, 2^{\frac{1}{3}}\left[K^2(3-K)\right]^{-\frac{1}{3}}$ $$F_A = \frac{S_{WA}}{\nabla_A} \Big/ \frac{S_{WB}}{\nabla_B} = \frac{6}{\left\{R_B 2^{\frac{1}{3}}\left[K^2(3-K)\right]^{-\frac{1}{3}}\right\}} \frac{R_B}{3}$$

$$\boxed{F_A = 2^{\frac{2}{3}} K^{\frac{1}{3}}\left[K(3-K)\right]^{-\frac{2}{3}} \quad \text{WITH } K = T/R_A}$$

FIG. 65

SHAPE FACTOR FOR SUBMERGED CYLINDER WITH HEMISPHERICAL BOTTOM
(BASED ON HALF – SUBMERGED SPHERE)

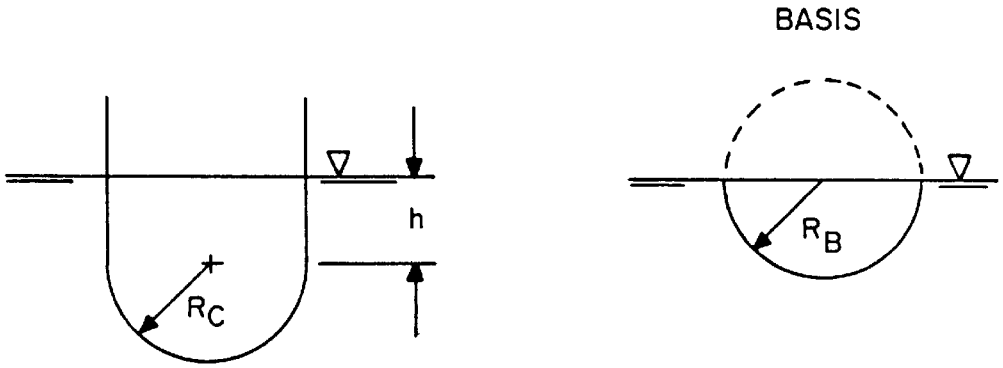

DISPLACEMENT ; $\nabla_C = \frac{2}{3}\pi R_C^3 + \pi R_C^2 h$

WETTED SURFACE ; $S_{WC}\ 2\pi R_C^2 + 2\pi R_C h$ $$\frac{S_{WC}}{\nabla_C} = \frac{2\pi R_C^2 + 2\pi R_C h}{\frac{2}{3}\pi R_C^3 + \pi R_C^2 h} = \frac{3}{R_C}\left(\frac{1+K}{1+\frac{3}{2}K}\right) ; \quad K = \frac{h}{R}$$

$$\frac{S_{WB}}{\nabla_B} = \frac{3}{R_B}$$ ( SEE FIGURE A-4 )

LET $\nabla_C = \nabla_B$ ; $\frac{2}{3}\pi R_C^3 + \pi R_C^2 h = \frac{2}{3}\pi R_B^3$ ; $R_C = R_B\left(1+\frac{3}{2}K\right)^{-\frac{1}{3}}$ $$F_C = \frac{S_{WC}}{\nabla_C} \Big/ \frac{S_{WC}}{\nabla_B} = \frac{3}{R_B}\left(1+\frac{3}{2}K\right)^{+\frac{1}{3}}\left(\frac{1+K}{1+\frac{3}{2}K}\right)\left(\frac{R_B}{3}\right)$$

$$\boxed{F_C = \frac{(1+K)}{\left(1+\frac{3}{2}K\right)\frac{2}{3}} \quad \text{WITH } K = h/R_C}$$

FIG. 66

SHT. # 1

U. S. MILITARY VESSELS

| NO. | DISCRIPTION | REF | LOA FT. | LWL FT. | DISPL. (TONS) | HP | DISPL./HP | $V_K$ MAX | $L/\nabla^{1/3}$ | $F_{ND}$ | $F_N$ | $R_T/W_T$ |
|---|---|---|---|---|---|---|---|---|---|---|---|---|
| 1 | CARRIER ENTERPRISE | 5 | 1123 | 1047 | 75,700 | 280,000 | 541 | 33 | 8.25 | 0.85 | 0.27 | 0.009 |
| 2 | CRUISER, ARKANSAS CL. | 5 | 585 | 566 | 11,000 | 70,000 | 314 | 30+ | 8.08 | 1.07 | 0.38 | 0.016 |
| 3 | DESTROYER A. BURKE CL. | 5 | 509 | 466 | 9,217 | 105,000 | 176 | 32 | 7.05 | 1.17 | 0.44 | 0.028 |
| 4 | FRIGATE | 5 | 445 | 405 | 3,600 | 41,000 | 177 | 29 | 8.39 | 1.24 | 0.43 | 0.030 |
| 5 | CORVETTE | 5 | 284 | 251 | 1,100 | 30,000 | 73 | 33 | 7.73 | 1.72 | 0.62 | 0.064 |
| 6 | PATROL, CYCLONE CL. | 5 | 170 | 163 | 334 | 13,400 | 50 | 35 | 7.46 | 2.23 | 0.81 | 0.089 |
| | (PLANNING TYPE) | | | | (LBS) | | | | | | | |
| 7 | MK II PATROL | 5 | 32 | 29 | 17,800 | 420 | 42 | 24 | 4.44 | 2.80 | 1.33 | 0.152 |
| 8 | STINGRAY CL PATROL | 5 | 35 | 31 | 14,800 | 600 | 25 | 38 | 5.05 | 4.57 | 2.03 | 0.165 |
| 9 | PEGASUS CL PATROL | 5 | 82 | 75 | 104,000 | 4,506 | 23 | 45 | 6.38 | 3.91 | 1.55 | 0.149 |

FIG. 68

SHT. # 2

| PRIVATE VESSELS (PASSAGEMAKERS) | | | | | | | | | | | | |
|---|---|---|---|---|---|---|---|---|---|---|---|---|
| NO. | DISCRIPTION | REF. | LOA FT | LWL FT | DISPL. LBS | HP | DISPL. / HP | $V_K$ MAX | $L/\nabla^{1/3}$ | $F_{ND}$ | $F_N$ | $R_T / W_T$ |
| 10 | DESIGN 256 (SEATON) | 4 | 59.8 | 53.5 | 226,000 | 403 | 561 | 9.3 | 3.51 | 0.71 | 0.38 | 0.030 |
| 11 | NORDHAVEN 46 | 4 | 45.8 | 38.5 | 48,320 | 101 | 478 | 8.8 | 4.23 | 0.86 | 0.42 | 0.037 |
| 12 | LITTLE SINBAD | 4 | 45.5 | 41.6 | 65,600 | 150 | 437 | 9.2 | 4.13 | 0.86 | 0.42 | 0.038 |
| 13 | SLUGGO (SEATON) | 4 | 52.8 | 48.3 | 81,000 | 195 | 415 | 9.8 | 4.46 | 0.89 | 0.42 | 0.038 |
| 14 | DIESEL DUCK | 4 | 38.3 | 36.7 | 32,600 | 80 | 407 | 9.0 | 4.59 | 0.94 | 0.44 | 0.042 |
| 15 | NEVILLE 39 | 4 | 39.9 | 36.3 | 40,250 | 105 | 383 | 9.1 | 4.24 | 0.93 | 0.45 | 0.044 |
| 16 | 3-POINT 49 | 4 | 48.5 | 40.0 | 70,000 | 200 | 350 | 9.6 | 3.88 | 0.89 | 0.45 | 0.046 |
| 17 | NEVILLE 48 | 4 | 48.0 | 43.3 | 69,555 | 200 | 348 | 10.0 | 4.21 | 0.93 | 0.45 | 0.044 |
| 18 | KROGEN 42 | 4 | 42.3 | 39.2 | 38,796 | 130 | 298 | 10.3 | 4.63 | 1.05 | 0.49 | 0.050 |
| 19 | NORDHAVEN 57 | 6 | 57.5 | 52.7 | 92,000 | 325 | 283 | 11.6 | 4.67 | 1.03 | 0.48 | 0.047 |
| 20 | WILLARD 40 | | 39.8 | 36.1 | 33,000 | 130 | 254 | 10.5 | 4.50 | 1.10 | 0.52 | 0.058 |

FIG. 69

SHT. # 3

| PRIVATE VESSELS | | | | | | | | | | | | |
|---|---|---|---|---|---|---|---|---|---|---|---|---|
| NO. | DISCRIPTION | REF. | LOA FT | LWL FT | DISPL. (LBS) | HP | DISPL / HP | $V_K$ MAX | $L/\nabla^{1/3}$ | $F_{ND}$ | $F_N$ | $R_T / W_T$ |
| 21 | NORDIC TUG 42 | | 42 | 40 | 25,000 | 300 | 83 | 14.0 | 5.47 | 1.54 | 0.66 | 0.133 |
| 22 | DUFFY 38 | | 38.5 | 37 | 25,000 | 420 | 60 | 23.0 | 5.06 | 2.53 | 1.13 | 0.113 |
| 23 | KROGEN EXPRESS 49 | | 49.5 | 47 | 36,400 | 700 | 52 | 20+ | 5.62 | 2.07 | 0.87 | 0.149 |
| 24 | SABRELINE 43 | | 43.5 | 41 | 32,500 | 700 | 46 | 24 | 5.14 | 2.53 | 1.12 | 0.139 |
| 25 | SABRELINE 47 | | 47.5 | 44 | 38,500 | 840 | 46 | 24 | 5.21 | 2.46 | 1.08 | 0.141 |
| 26 | HINKLEY 67 | | 67.0 | 61 | 70,000 | 1,640 | 43 | 28 | 5.92 | 2.60 | 1.07 | 0.129 |
| 27 | EASTBAY 40 | | 40.5 | 38 | 28,500 | 750 | 38 | 29.1 | 4.98 | 3.13 | 1.41 | 0.140 |
| 28 | (PLANNING) BLACKFIN 33 COMBI | | 32.9 | 29 | 20,000 | 750 | 26.7 | 28.4 | 4.27 | 3.24 | 1.57 | 0.204 |
| 29 | INTREPED 32 | | 32.2 | 25 | 3,500 | 500 | 7.0 | 52.0 | 6.59 | 7.94 | 3.10 | 0.425 |

FIG. 70

SHT # 4

MULTIHULLS

| NO. | DISCRIPTION | REF. | LOA | LWL | DISPL. | HP | DISPL./HP | $V_K$ MAX | $L/\nabla^{1/3}$ | $F_{ND}$ | $F_N$ | $R_T/W_T$ |
|---|---|---|---|---|---|---|---|---|---|---|---|---|
| | CATAMARANS | | | | | | | | | | | |
| 30 | AWESOME 72 (PER HULL) | | 74.8 | 68 | 33,000 | 600 | 55 | 35 | 8.48 | 3.68 | 1.26 | 0.080 |
| 31 | MARES 54 (PER HULL) | | 54 | 50 | 22,500 | 735 | 35 | 36 | 7.08 | 4.03 | 1.52 | 0.140 |
| 32 | CARRI-CRAFT 532 (PER HULL) | | 53 | 48.8 | 15,000 | 315 | 48 | 25 | 7.92 | 2.80 | 1.00 | 0.130 |
| | TRIMARANS | | | | | | | | | | | |
| 33 | MORRELL & MELVIN 60 | | 60 | 60 | 12,000 | 220 | 55 | 26.1 | 10.48 | 3.24 | 1.00 | 0.109 |
| 34 | ILAN VOYAGER | | 69 | 69 | 12,200 | 250 | 51 | 29 | 11.99 | 3.60 | 1.04 | 0.109 |
| 35 | EBENEZER SCROOGE | | 42.6 | 41 | 13,300 | 325 | 41 | 30.0 | 6.92 | 3.67 | 1.39 | 0.126 |

FIG. 71

WATER GOING VESSEL HULL AND METHOD FOR HULL DESIGN

Priority based on provisional application Ser. No. 60/044,192 filed May 31, 1997 and Ser. No. 60/082,606 filed Apr. 22, 1998 is claimed.

FIELD OF THE INVENTION

The present invention provides a water going vessel hull design and a method for determining useful hull design, and particularly a multihull vessel design and further particularly a trimaran hull design with applicability toward smaller vessels operating as displacement hulls but at speeds comparable to planing hulls. The present invention further relates to an improved boat hull design, particularly comprising a slender displacement type main hull with two outrigger hulls. More particularly, the invention relates to a boat hull that utilizes planing hulls or slender ellipsoidal displacement hulls as outrigger hulls, and an ellipsoidal hull (preferably, one which is longitudinally non-symmetric with and without a transom stern) as a main hull.

BACKGROUND OF THE INVENTION

There is a general need in the art for boat hull designs which provide reasonable combinations of efficiency, speed, displacement and length. Such boats hulls have practical applications for boats adapted for personal cruising and for fishing, among others.

General information regarding boat hull architecture is set forth in the three volume" Principles of Naval Architecture," Edward V. Lewis, ed., 2d rev. 1988, published by the Society of Naval Architects and Marine Engineers (hereinafter "PONA"). PONA does not cover trimaran hulls. Moreover, the discussion of catamaran concepts is restricted to slender planing hulls. While this reference sets forth information regarding slender monohull boats, such as destroyers and other "fast" displacement monohull boats, the data mostly covers speeds corresponding to Froude numbers ($F_N$) up to 0.45–0.60. Data on displacement hulls corresponding to Froude numbers in the range of 1.0–1.5 are included for the Series 64 model test data ($F_N$=1 for a 48' boat at a speed of 27 statute miles per hour). It appears that the Series 64 models generally go to extremes in reducing wave making resistance at the expense of increased friction resistance. Also, length to displacement ratios for the Series 64 models indicated reduced utility and practical application for full scale boats. See PONA, vol. II, pp. 95–98.

Existing art for power boats typically includes a single rigid hull; such boats are referred to as "monohull" vessels. Typically, the hulls of such vessels have either a deeply V-shaped cross section, which cuts deeply into the water and provides a relatively smooth ride through the water at the cost of high fuel consumption, or they have a flatter hull configuration that allows the vessel to plane, thereby reducing fuel consumption while providing a less smooth ride.

Existing art for boats also includes vessels constructed with two, three, or more hulls. These boats are referred to as catamarans, trimarans, or generally as multihull vessels. Multihull vessels have the advantage of more lateral stability than a monohull vessel, but with a wetted surface area that is normally higher than that of a monohull vessel of similar size.

There have been various attempts to overcome disadvantages of the existing art and to take advantage of certain features of multihulled vessels. For example, U.S. Pat. No. 4,494,477 to Matthews discloses a vessel that is capable of adjustment so as to be either a monohull vessel or a multihull vessel. The vessel includes means for moving portions of the hull so as to provide variable characteristics between monohull and multihull. The invention does not describe a solely trimaran-type vessel—one absent the additional features for variable hull adjustment—nor does Matthews provide a method for designing a vessel so as to account for the variable factors involved in trimaran operation.

U.S. Pat. No. 5,107,783 to Magazzù describes a generally monohulled vessel with twin adjustable side floats, which provides some features of a trimaran. Magazzù does not provide a solely fixed trimaran design nor a method for designing a vessel so as to account for the variable factors involved in trimaran operation.

U.S. Pat. No. 5,178,085 to Hsu describes a multihull vessel with slender hulls for wave cancellation. Hsu does not provide a method for designing a vessel so as to account for the variable factors involved in trimaran operation, including variabilities in size of boats and hulls.

U.S. Pat. No. 5,191,849 to Labrucherie, et al., provides for a multihulled boat with at least three hulls that utilizes the compressive force of air between hulls to lift the boat during operation. Labrucherie does not provide a method for designing a vessel so as to account for the variable factors involved in trimaran operation, including variabilities in size of boats and hulls.

U.S. Pat. No. 5,265,554 to Meredith describes a multihulled vessel with ski-like chines the provide additional lift to the vessel during operation. Meredith does not provide a method for designing a vessel so as to account for the variable factors involved in trimaran operation, including variabilities in size of boats and hulls.

U.S. Pat. No. 5,269,245 to Bystedt, et al., provides an onion-shaped cross-section multihull design structure using a split front to rear design that has variable characteristics that depend on boat speed. Bystedt does not provide a method for designing a vessel so as to account for the variable factors involved in trimaran operation, including variabilities in size of boats and hulls.

U.S. Pat. No. 5,529,009 to Faury describes a boat multihull design for a large ship based on the surface area of hull floats, the weight of the ship, and a formula involving the distance from the center of displacement to the center of gravity of the ship. Faury does not provide a generalized method for designing a vessel so as to account for the variable factors involved in trimaran operation, including variabilities in size of boats and hulls.

U.S. Pat. No. 5,237,947 to Manning and U.S. Pat. No. 5,325,804 to Schneider, generally describe vessels with outboard submersible extensions, which are distinguishable from fixed non-submersible hulled trimarans in both function and operation.

Other relevant sources of information about the existing art include the following: 1) "Principles of Naval Architecture Second Edition", Edited by Edward V. Lewis, The Society of Naval Architects and Marine Engineers (1988); 2) Dave Gerr, "Propeller Handbook", International Marine, A Division of the McGraw Hill Companies, (1988); 3) Lars Larsson and Rolf E. Eliason, "Principles of Yacht Design," International Marine, A Division of the McGraw Hill Companies (1994); 4) Captain Robert P. Beebe, Revised by James F. Leisaman, "Voyaging Under Power," International Marine, A Division of the McGraw Hill Companies (1994); 5) "Jane's Fighting Ships 1996–1997," Ninety-Ninth Edition, Edited by Captain Richard Sharpe RN (1996); 6) Chuck Paine, "Nordhavn 57," Yachting Magazine, 37

(August 1996); 7) George L. Petrie, "Capri-Craft 532 Catamaran," Power and Motoryacht Magazine, 38 (November 1996); 8) Captain Jim Gorant, "East to East," Power and Motoryacht Magazine, 120 (November 1996); 9) Captain Ken Kreisler, "Just Launched, Hinkley 67," Power and Motoryacht Magazine, 26 (October 1996); 10) "All the New Boats," Motorboating and Sailing Magazine, 40–76 (January 1995).

SUMMARY OF THE INVENTION

It is an object of the invention to provide an improved boat hull design that provides reasonable combinations of efficiency, speed, displacement and length, and which overcomes the limitations which characterize the prior art.

It is an object of the present invention to overcome the limitations of existing art by provides a trimaran boat hull design.

It is an object of the present invention to provide an improved boat hull for a trimaran by providing a slender hull that has less wave making resistance, but more friction resistance for a given displacement versus a beamy hull.

It is an object of the present invention to provide an improved boat hull for a trimaran by providing a slender hull that is less stable laterally than a beamy hull.

It is an object of the present invention to provide an improved boat hull for a trimaran taking into account the fact that there is a point of dimensioning return when the decrease in wavemaking resistance with increased slenderness is substantially offset by a corresponding increase in friction resistance.

It is an object of the present invention to provide an improved boat hull for a trimaran incorporating consideration that a catamaran has the advantage of stable slender hulls, but has more wetted surface area than a geometrically similar single hull of the same total displacement.

It is an object of the present invention to provide an improved boat hull for a trimaran incorporating consideration that a powered catamaran will distribute displacement evenly between two hulls.

It is an object of the present invention to provide an improved boat hull for a trimaran incorporating consideration that a single hull for carrying total load with outrigger (s) for stability only and with minimum load bearing (displacement) is advantageous over a catamaran hull, (e.g., a trimaran).

It is an object of the present invention to provide an improved boat hull for a trimaran incorporating consideration that a trimaran can carry its load with a lower center of gravity relative to its center of buoyancy than can a catamaran.

It is an object of the present invention to provide an improved boat hull for a trimaran incorporating consideration that a trimaran center hull is unusually long relative to a wide beam monohull of comparable displacement.

It is an object of the present invention to achieve significantly more efficient operation than planing hulls, but at speeds greater than those of current displacement monohulls and approaching that of planing hulls.

It is an object of the present invention to provide a hull design that has better ride characteristics than planing hulls in light to moderate seas.

It is an object of the present invention to avoid the displacement to planing hump experienced in planing hulls such that for given throttle settings boat speed would adjust to sea conditions based on wetted surface.

It is an object of the present invention to have safe sea keeping qualities in unavoidable heavier seas but at reduced speed and constant throttle setting.

It is an object of the present invention to penetrate moderate waves for smooth riding and to reduce slamming but to lift out of heavy waves to avoid waves breaking over the deck.

It is an object of the present invention to have good lateral stability both at rest and underway with differing sea conditions.

It is an object of the present invention to minimize tendency to yaw or poop in a heavy following sea.

It is an object of the present invention to run true while underway but be highly maneuverable when docking or operating close in to other boats and obstacles.

It is an object of the present invention to have a lower center of gravity relative to the center of buoyancy than catamarans have, therefore reducing the tendency to pitch or corkscrew.

It is an object of the present invention to be more efficient than powered catamarans or monohulls of equal displacement.

It is an object of the present invention to have minimum wind resistance.

It is an object of the present invention to retain positive flotation if holed or swamped.

It is an object of the present invention to provide a boat design that approaches the amenities and accommodations normally expected on comparable boats of either displacement or planing types.

It is an object of the present invention to have a design with pleasing functional lines uncontrived and compatible with the concept.

To achieve these objects, the present invention provides a boat hull and a method for determining useful boat hull design optimized for certain expected operation conditions with emphasis on applicability toward smaller vessels operating as displacement hulls but at speeds comparable to planing hulls. The present invention further relates to an improved boat hull design comprising a slender displacement type main hull with two outrigger hulls. More particularly, the invention relates to a boat hull which utilizes planing hulls or slender ellipsoidal displacement hulls as outrigger hulls, and an ellipsoidal hull (preferably, one which is longitudinally non-symmetric with or without a transom stern) as a main hull.

To achieve the stated and other objects of the present invention, as embodied and described below, the invention includes a method for displacement hull design of a water vessel having a hull, wherein the hull has a hull shape, a wetted length, a beam, a wetted surface area, a residuary resistance, a prismatic coefficient, a block coefficient, a maximum beam coefficient, and a water plane coefficient, comprising: constraining the hull such that the hull has slenderness, wherein the hull slenderness comprises the hull having a high ratio of the wetted length to the beam, and the residuary resistance is minimized; constraining the hull shape such that the hull has the minimum wetted surface area for the hull slenderness; and optimizing the hull shape wherein optimizing the hull shape includes varying the prismatic coefficient, the block coefficient, the maximum beam coefficient, and the water plane coefficient.

To further achieve the stated and other objects of the present invention, as embodied and described below, the invention includes a water going vessel, wherein the vessel includes at least one hull, and wherein the hull has a hull shape, a wetted length, a beam, a wetted surface area, a residuary resistance, a prismatic coefficient, a block coefficient, a maximum beam coefficient, and a water plane coefficient, produced by the method of: constraining the hull such that the hull has slenderness, wherein the hull slenderness comprises the hull having a high ratio of the wetted length to the beam, and the residuary resistance is minimized; constraining the hull shape such that the hull has the minimum wetted surface area for the hull slenderness; and optimizing the hull shape wherein optimizing the hull shape includes varying the prismatic coefficient, the block coefficient, the maximum beam coefficient, and the water plane coefficient.

To further achieve the stated and other objects of the present invention, as embodied and described below, the invention includes a water going vessel having at least a first longitudinally extending hull, the first hull having a stern wetted section area, a wetted section area, a maximum beam coefficient, a prismatic coefficient, a block coefficient, a water plane coefficient, a surface area, a displacement, a longitudinal center of buoyancy, a forward perpendicular, a length, a length of entry from the forward perpendicular, and a maximum wetted beam, wherein the first hull has a longitudinally non-symmetrical ellipsoidal shape.

Additional objects, advantages and novel features of the invention will be set forth in part in the description and figures that follow, and in part will become more apparent to those skilled in the art upon examination of the following; these features may also be learned by practice of the invention.

BRIEF DESCRIPTION OF THE FIGURES

In the figures:

FIG. 2 contains a table of reference hull shape data versus prolate spheroid for an embodiment of the present invention.

FIG. 3 shows displacement hull series data relevant to an embodiment of the present invention.

FIG. 4 is a table of reference hull data versus prolate spheroid data versus Series 64 hull data for an embodiment of the present invention.

FIG. 12 is a table of 20 knot and 30 knot values of various hull resistance factors for an embodiment of the present invention.

FIG. 20 contains a table of smaller hull multihull resistance versus hull #25, Appendix 3 (Sabreline 47) hull basis; $R_T/W_T$=0.148 at 24 knots, $L_W$=44', and $F_N$=1.08 for an embodiment of the present invention.

FIG. 22 is a table of larger hull multihull resistance versus hull #5, Appendix 3 (corvette) hull basis, $R_T/W_T$=0.064 at 33 knots, $L_W$=251', $F_N$=0.62 for an embodiment of the present invention.

FIG. 23 presents a plot and calculations for longitudinally nonsymmetrical versus symmetrical prolate spheroid for an embodiment of the present invention.

FIG. 23A contains a plot and calculations of LCB for the LNSPS hull shape for an embodiment of the present invention.

FIG. 24 shows a plot and calculations for an LNSPS with a transom stern for an embodiment of the present invention.

FIG. 29 is a figure and calculations for hull shape PR for an embodiment of the present invention.

FIG. 30 contains a figure and calculations for hull shape PR-T for an embodiment of the present invention.

FIG. 31 shows a figure and calculations for hull shape PR-TM for an embodiment of the present invention.

FIG. 62 is a tank shape diagram and calculations of a shape factor therefor according to an embodiment of the present invention.

FIG. 63 presents a prolate spheroid shape diagram and calculations of a shape factor therefor according to an embodiment of the present invention.

FIG. 65 shows a partially submerged sphere shape diagram and calculations of a shape factor (based on half-submerged sphere) therefor according to an embodiment of the present invention.

FIG. 66 is a submerged cylinder with hemispherical bottom shape diagram and calculations of a shape factor (based on half-submerged sphere) therefor according to an embodiment of the present invention.

FIG. 68 contains a table of U.S. military vessels information for an embodiment of the present invention.

FIG. 69 shows a table of private vessels (passagemakers) information for an embodiment of the present invention.

FIG. 70 is a table of private vessels information for an embodiment of the present invention.

FIG. 71 presents a table of multihulls information for an embodiment of the present invention.

DETAILED DESCRIPTION

Figure 1:
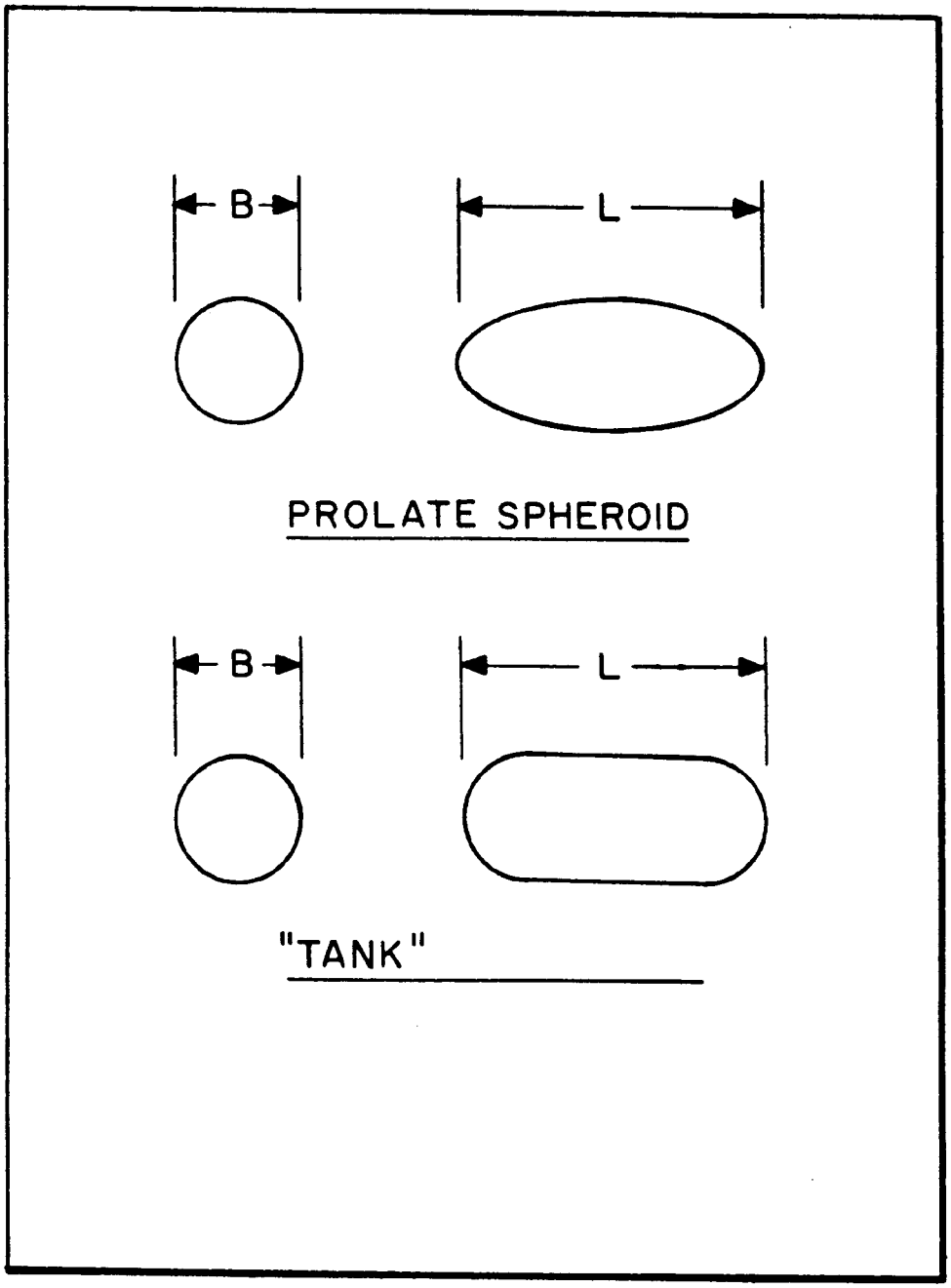
FIG. 1 presents a diagram for the prolate spheroid and the tank of an embodiment of the present invention.

The present invention provides a water going vessel hull design and a method for determining useful hull design, and particularly a multihull vessel design and further particularly a trimaran hull design with applicability toward smaller vessels operating as displacement hulls but at speeds comparable to planing hulls. The present invention further relates to an improved boat hull design comprising a slender displacement type main hull with two outrigger hulls. More particularly, the invention relates to a boat hull that utilizes planing hulls or slender ellipsoidal displacement hulls as outrigger hulls, and an ellipsoidal hull (preferably, one which is longitudinally non-symmetric with or without a transom stern) as a main hull.

While the majority of the detailed description relates to hull design with regard to a trimaran, it will be appreciated by those skilled in the art that portions of the analysis described herein also apply to a monohull design, catamaran design, and other multihull design. The detailed description is thus not intended to be limiting to a trimaran hull design or to a method of trimaran hull design.

The forward motion of a powered ship or yacht is opposed by two primary forces; wave making or residuary resistance ($R_R$) and friction resistance acting on the wetted hull surface ($R_F$). (A list of symbols and a summary of hull coefficients and parameters (wetted) is included at the end of this document.) The residuary resistance $R_R$ is the net force on the vessel's wetted surface due to fluid pressure acting normal to the surface integrated over the entire wetted surface. The friction resistance $R_F$ is the net force on the vessel wetted surface due to fluid shear stress acting tangentially along the wetted surface and integrated over the entire wetted surface.

The total hull resistance is expressible by the following equation:

$$R_T = R_F + R_R = (C_F + C_R)S_W \frac{\rho V^2}{2g} \tag{1}$$

For higher speed displacement hulls, lower residuary resistance ($R_R$) can be realized by using slender hulls; that is, hulls with high wetted length to beam ($L_W/B_W$) ratios. Slender hulls generally offer the improved sea keeping characteristics of small water plane area distribution along the hull length, which allows wave penetration and reduced pitching. Conversely, slender hulls provide poor lateral stability and have higher wetted surface area for a given displacement, which increases hull friction resistance ($R_F$).

The monohull vessel is limited in slenderness since it must provide primary lateral stability with beam width. The catamaran with two separate hulls rigidly connected above the waterline provides lateral stability, one hull for the other. The hulls can therefore be very slender without regard to single hull lateral stability. For a given total displacement, however, the twin slender hulls are disadvantaged with still more wetted surface area and hence more friction resistance. Moreover, mutual hull wave making interference can generate additional residuary resistance.

The trimaran is subject to the same sensitivities to wetted surface areas and multihull wave interference as is the catamaran. In fact, at first examination, it might seem that trimarans would be even more subject to these sensitivities than would the catamaran. However, the trimaran offers several configurational alternatives that maximize the advantages of the slender displacement hull while reducing the multihull sensitivity to increased wetted surface area and hull-to-hull wave interference.

Unlike the normal catamaran, the trimaran displacement distribution can vary to differing degrees between the center hull and the two outrigger hulls. Displacement distribution can range from the center hull bearing nearly all the displacement like that of a monohull—leaving the outriggers to serve primarily as stabilizers—to the outriggers bearing nearly all the displacement like a catamaran.

The trimaran concept can allow variation in the outrigger hulls' relationship to the center hull in the longitudinal direction, as well as in the transverse direction, to minimize counter wave-making interference among the hulls and provide constructive wave interference.

Further, trimaran design may be varied to take advantage of different characteristics, including the following: the outrigger hulls can be made adjustable vertically, longitudinally and angularly relative to the center hull; the outrigger hulls can be planing hulls, while the center hull is a displacement hull; the outrigger hulls can vary in length and shape from the center hull. These options are not available for a normal catamaran.

The present invention includes a method for determining useful trimaran design with emphasis on applicability toward smaller vessels operating as displacement hulls but at speeds comparable to planing hulls.

The trimaran and method of the present invention incorporate variabilities of design that depend on the flow regime for hulls, particularly slender displacement hulls. Hull residuary characteristics are conventionally determined by model testing the hull shape in basins and determining the dependent residuary coefficient $C_R$ as a function of the independent variable, the Froude number $F_N$, where:

$$F_N = \frac{V}{\sqrt{gL}} \tag{2}$$

When plotting typical $C_R$ vs. $F_N$ curves for displacement hulls, humps or local maximum values for $C_R$ occur at values of $F_N$ approximately equal to 0.24, 0.30, and 0.48, with their relative importance depending upon the speed and shape of the model (see, e.g., *Principles of Naval Architecture Second Edition,* Edited by Edward V. Lewis, The Society of Naval Architects and Marine Engineers, (1988), Vol. II, Pg. 67). The major hump and the last hump at $F_N$=0.48 is the limit below which most displacement hulls must operate.

By definition, slender hulls are able to penetrate or "slice" through the bow wave and operate at values of $F_N$ significantly greater than the hump value of 0.48. This capability gives slender hulls the potential to operate economically in the displacement mode, but at higher speeds comparable to that of planing hulls. For example, operating at $F_N$=1, a 50 foot waterline-length hull would be running at 24 knots—significantly higher than the 8–9 knots most common for normal displacement hull vessels of comparable length.

Another aspect of the present invention is hull shape. With regard to basic hull shape parameters, *Principles of Naval Architecture Second Edition,* Volume II, Chapter 5, Section 8, describes the relation of displacement hull form (shape) to resistance for vessels at Froude numbers up to $F_N$=0.6. The ships considered by the existing art are typically "large" vessels, such as cargo ships, ocean liners, and destroyers, and this size constraint limits the Froude Number at reasonable speeds.

The form or shape coefficients and elements of hull shape of importance to the present invention are those given in *Principles of Naval Architecture Second Edition* for the higher values of $F_N$. For destroyers in particular, Table 17 in *Principles of Naval Architecture Second Edition* lists the following form coefficient ranges for values of $F_N$>0.45;

| | | |
|---|---|---|
| Block coefficient | $C_B$ | = 0.46–0.54 |
| Max. Beam coefficient | $C_M$ | = 0.76–0.85 |
| Prismatic coefficient | $C_P$ | = 0.56–0.64 |
| Waterplane coefficient | $C_{WP}$ | = 0.68–0.76 |

Note that the hull form coefficients are interdependent to the extent that $C_B=C_M \times C_P$.

Also, FIG. 62 of *Principles of Naval Architecture Second Edition* illustrates "design lanes" for displacement hulls for prismatic coefficient and displacement to length ratio for values of $F_N$ up to 0.60:

Prismatic coefficient: $C_P$=0.62–0.64

Volume coefficient:

$$\frac{\nabla}{(0.10\times L)^3} = 1.2\text{–}1.8$$

Note that the expression for volume coefficient can be restated in the form $L/\nabla^{1/3}$, and the corresponding range in length to displacement ratio is:

Length to displacement ratio $$\frac{L}{\nabla^{\frac{1}{3}}} = 8.2\text{–}9.4$$

As indicated in *Principles of Naval Architecture Second Edition,* Vol. II, ch. 5, comparisons can be obtained for the $C_R$ for a design by calculating and plotting curves of the ratio of $P_E$ to that of a model, which is used as a reference, and the curves can also be used to find the effects of major changes in design parameters. A comparison for destroyers shows that the displacement volume is 2720 $m^3$ and the value of $L/\nabla^{1/3}$ is 8.7. In this example, for values of $F_N$ less than 0.30, the lowest $P_E$ is realized by using the smallest $C_P$ value of 0.50. At higher speeds, a different result occurs, and at $F_N$=0.60, which corresponds to about 40 knots, the $C_P$ is approximately 0.65 to 0.67.

*Principles of Naval Architecture Second Edition* also shows that an increase in B/T causes a moderate increase in $P_E$, but the effect may be larger in rough water than in smooth water. In some other experiments reviewed, the effects of shape of midship section on resistance was analyzed. The models all had a $C_P$=0.56, the same curve of areas, and the same maximum section area. The results indicated that the LWL curves were nearly the same shape. The midship-area coefficient $C_M$ varied from 0.7 to 1.1 in several model studied, based upon the beam at the LWL. The fuller area coefficient was shown to have a slight advantage up to $F_N$ well above 0.33, but the difference in $R_{R/W}$ for the whole series was very small. It was therefore concluded that the shape of the midship section was not an important factor in determining residuary resistance.

Further, another reference, Lars Larsson and Rolf E. Eliason, *Principles of Yacht Design,* International Marine, A Division of the McGraw Hill Companies (1994) p. 80, has found that for transom stern hulls, the optimum prismatic increases to about 0.70 at Froude numbers of 1.0 due to the fact that the transom should become larger as the speed increases.

The above coefficients/ratios ranges serve as the basis/points of departure for an embodiment of the present invention with regard to defining displacement hull forms/shapes, and in particular, hulls having Froude values of $F_N \geqq 0.5$.

Other relevant issues to trimaran hull design for an embodiment of the present invention include the relationship between hull slenderness and wetted surface, and the ellipsoidal shape of the hull. Intuitively, one would conclude that as a hull of given displacement becomes more slender (i.e., as the ratio L/B increases) eventually further reductions in residuary resistance ($R_R$) would be diminished and more than offset by an escalating increase in wetted surface area. As a result, one would expect a corresponding increase in friction resistance ($R_F$). An issue addressed by an embodiment of the present invention is as follows: as a displacement hull is made necessarily slender to reduce residuary resistance, shape(s) are identified that minimize the corresponding increase in surface area plus have the aforementioned form coefficients—ratios that have been empirically determined as desirable for $F_N$>0.5. A second issue relating to an embodiment of the present invention is as follows: once such slender hull shape(s) are defined, the optimal slenderness ratio L/B for the minimal combined residuary-friction resistance of a hull displacement and speed are identified.

In Appendix 1, an analysis is provided regarding hull shape(s) that best minimize wetted surface area to displacement ratio for different slenderness ratios (L/B). The analysis shows that two different shapes satisfy the conditions, but at different slenderness ratio ranges. Appendix 2 briefly discusses wetted hull surfaces and displacements.

In an embodiment of the present invention, it is determined that a special case of the ellipsoid, the prolate spheroid (see FIG. 1), provides minimum surface area to volume ratio from L/B=1 to L/B≅4.5. Above this value for L/B, a tank type shape consisting of a cylindrical section capped by hemispherical end caps has a very slight advantage over the ellipsoid (see FIG. 1). A cursory examination of the tank shape leads to the conclusion that a slender hull with the half body tank shape does not by itself have the desired shape for minimum wave making resistance, due to the abruptness of the hemispherical leading/trailing ends. However, a hull shaped as a half body prolate spheroid has shape characteristics (hull form coefficients) strikingly similar to and approaching those arrived at empirically for classical displacement hull shapes operating at higher Froude numbers.

Note that the equation for an ellipsoid generally is as follows:

$$x^2/a^2+y^2/b^2+z^2/c^2=1 \text{ (a prolate spheroid)}$$

In the special case of the ellipsoid, in which b=c, the ellipsoid equation reduces to the following:

$$x^2/a^2+(y^2+z^2)/b^2=1$$

Table 1, shown in FIG. 2, compares the hull form coefficients and ratios discussed above with those of the special ellipsoid (prolate spheroid) from different values of L/B (eccentricity) for the ellipsoid. The ellipsoid's ratio $L/\nabla^{1/3}$, dependent on L/B seems to best fit the empirical data range for values of L/B from approximately 12 to 15, and the other listed form coefficients are independent of L/B.

*Principles of Naval Architecture Second Edition* tabulates substantial empirical data based on model and prototype hull testing, but gives little theoretical or mathematical reasoning to support or explain testing results. The significance of Table 1, shown in FIG. 2, is that it supports determination of the present invention for empirically deriving hull form data: displacement hull forms for higher values of $F_N$ produce shapes that give minimum wetted surface to displacement (friction) for the required slenderness (residuary).

By using the shape characteristics of the ellipsoid and the ellipsoid's relationship to the above described tank shape, an embodiment of the present invention produces ellipsoidal hull shapes and hulls with cylindrical mid-sections, but with ellipsoidal forward and aft shapes, resulting in minimum wetted surface to displacement ratios for a given slenderness ratio (L/B). Moreover, such hulls have desirable hull shape characteristics (form coefficients).

However, the ellipsoid shape, if strictly adhered to, would not result in all desired hull characteristics. For example, the hull will not be longitudinally symmetrical; the entry angle may need to be modified; and a transom stern might best be included. The ellipsoid shape does, however, provide a refined point of departure for hulls of minimum wetted surface to displacement ratios. Thus, in an embodiment of the present invention, as these other hull characteristics are assigned to a particular hull, the deviation from minimum surface area is assessed by comparing it to ellipsoidal forms having the same displacement and L/B ratio. The effects of longitudinal non-symmetry and transom sterns are discussed in more detail below.

Factors relating to the scale of the slender hull for an embodiment of the present invention will now be discussed.

For any given volume shape enclosed by a generally convex surface area, the ratio of surface area to displacement ($S/\nabla$) varies inversely with any given dimension of the fixed shape. For instance, the surface to volume ratio for a sphere of radius R or diameter D is as follows:

$$\frac{S_W}{\nabla} = \frac{4\cdot\pi\cdot R^2}{\frac{4}{3}\cdot\pi\cdot R^3} = \frac{3}{R} = \frac{6}{D}$$

Similarly, for any given hull shape, the wetted surface area ($S_W$) to displacement ($\nabla$) ratio changes inversely with any given dimension L of the fixed shape, as follows:

$$\frac{S_W}{\nabla} = \frac{K}{L}$$

where K is a constant

The constant K is unique to the hull shape. So, a larger hull "A" shaped exactly as a smaller hull "B" has a surface area to displacement ratio less than that of the smaller hull, the difference being inversely related to the wetted length of the two hulls, as follows:

$$\frac{\left(\frac{S_W}{\nabla}\right)_A}{\left(\frac{S_W}{\nabla}\right)_B} = \frac{L_B}{L_A}$$

Equation (1) may thus be rewritten in the following form:

$$\frac{R_T}{W_T} = (C_R + C_F)\left(\frac{S_W}{\nabla}\right)\frac{V^2}{2g} \tag{3}$$

with, $$\frac{R_R}{W_T} - C_R\left(\frac{S_W}{\nabla}\right)\frac{V^2}{2g} \quad \text{and} \quad \frac{R_F}{W_T} = C_F\left(\frac{S_W}{\nabla}\right)\frac{V^2}{2g}$$

Equation 3 suggests that the specific total resistance for a given hull shape will be reduced for larger hulls and conversely increased for smaller hulls. This is indeed so as a first approximation. But the coefficients $C_F$ and $C_R$ are both related to scale and speed and their respective effects are considered with regard to an embodiment of the present invention, as will be described further below.

The following relevant equations will now be discussed:

$C_F = C_F(R_N)$ where $$R_N = \frac{VL}{\nu} \tag{4}$$

$C_R = C_R(F_N)$ where $$F_N = \frac{V}{\sqrt{gL}} \tag{5}$$

The friction coefficient $C_F$ can be calculated from existing tables and empirically derived equations. For the purposes of an embodiment of the present invention, $C_F$ is given as follows:

$$C_F(R_N) = \frac{0.075}{[\mathrm{Log}R_N - 2]^2} \tag{6}$$

(See *Principles of Naval Architecture Second Edition,* Vol. II, Pg. 59.)

The residuary coefficient is a unique function of hull shape and $F_N$. Therefore $C_R(F_N)$ has to be determined by testing models or prototypes of a particular hull shape or correlating similar existing data.

Since no residuary data exists on ellipsoidal hulls, an embodiment of the present invention includes analysis and use of existing residuary data for similar hulls to examine the effects of shape and scale for slender hulls operating at $F_N$ in the ranges>0.48. The results, which are discussed further below, include the effects of $C_F$ and $C_R$ changing in value with shape, scale, and speed.

Factors relating to extrapolation from existing hull data on shape and scale for an embodiment of the present invention will now be discussed.

The Series 64 Data were considered in relation to an embodiment of the present invention. *Principles of Naval Architecture Second Edition,* Vol. II, Chapter 5, Section 9 "High Speed Craft and Advanced Marine Vehicles", includes performance data for fast displacement craft. Table 2, shown in FIG. 3, lists the hull form data and $F_N$ ranges for the various series that are discussed in *Principles of Naval Architecture Second Edition.* Of those, the Series 64 data is relevant to an embodiment of the present invention because of the included $F_N$ ranges, the hull forms, and the extent of data. Table 3, shown in FIG. 4, combines Table 1 data, shown in FIG. 2, with the details of the hull forms tested in Series 64.

Pertinent issues discussed in *Principles of Naval Architecture Second Edition* relating to Series 64 include the following. With regard to Series 64 methodical tests, the reference discusses the Taylor Standard Series models, which were run only up to a Froude number $F_N$=0.60. Increasing speeds demanded of naval ships led to exploration of the relationship of resistance to higher values of $F_N$, including methodical model experiments.

With regard to Series 64 in particular, *Principles of Naval Architecture Second Edition* discusses tests of low-wave-drag, displacement-type hulls, up to speeds corresponding to $F_N$=1.50. In these tests, three parameters were included as primary variables: block coefficient, $C_B$, length-displacement ratio, $L/\nabla^{1/3}$,and beam-to-draft ratio, B/T; and the prismatic coefficient $C_P$ was kept constant at 0.63. Other factors for the test included the following. The models had a heavily raked stern, no bulb, fine entrance angles, and a transom stern with a round knuckle. The maximum area and maximum beam were at 60 and 70 percent of the length from the forward perpendicular, respectively, and the LCB was at 56.6 percent of the length from forward. A total of twenty-seven models were tested, all having 3.048 m length.

According to *Principles of Naval Architecture Second Edition,* above a value of $F_N$=0.90, the wave resistance was found to no longer an important factor, with frictional resistance dominating. As a result, at high values of $F_N$ wetted surface should be minimized. Due to the rather extreme type of hull forms discussed in the reference, the resistance results for the individual models are not directly useful to the present invention. Average resistance values for the results, however, are frequently adopted for use in parametric studies for slender ships and other purposes.

A particularly noteworthy aspect of these results with regard to the present invention is the emphasis placed on the need to keep wetted surface to a minimum as slenderness is increased.

A point on the utility of slender hulls for an embodiment of the present invention is that the displacement should be maximized for a given length and speed, while the desired low friction and residuary resistance should also be achieved. That is, lower values for $L_W/\nabla^{1/3}$ indicate a more "useful" vessel. Therefore, when examining the Series 64 hulls, the interest is in those hull shapes with lower values for $L_W/\nabla^{1/3}$. An embodiment of the present invention includes determining and applying hulls' utility, sea keeping, efficiency, and low resistance.

Also, it should be noted that the Series 64 is a series for monohulls with B/T=3 and that the special ellipsoidal shape (the prolate spheroid, in particular) has a semicircular section throughout with B/T=2. Partly because of this, an embodiment of the present invention includes determination that the ellipsoidal hull provides lower values of $L_W/\nabla^{1/3}$ for given values of L/B than does Series 64. This indicates that ellipsoidal shapes have potential for better utility, sea keeping, efficiency, and speed than the Series 64. Thus, an embodiment of the present invention includes use of the Series 64 data as a conservative estimate of the ellipsoidal hull potential.

Figure 5:
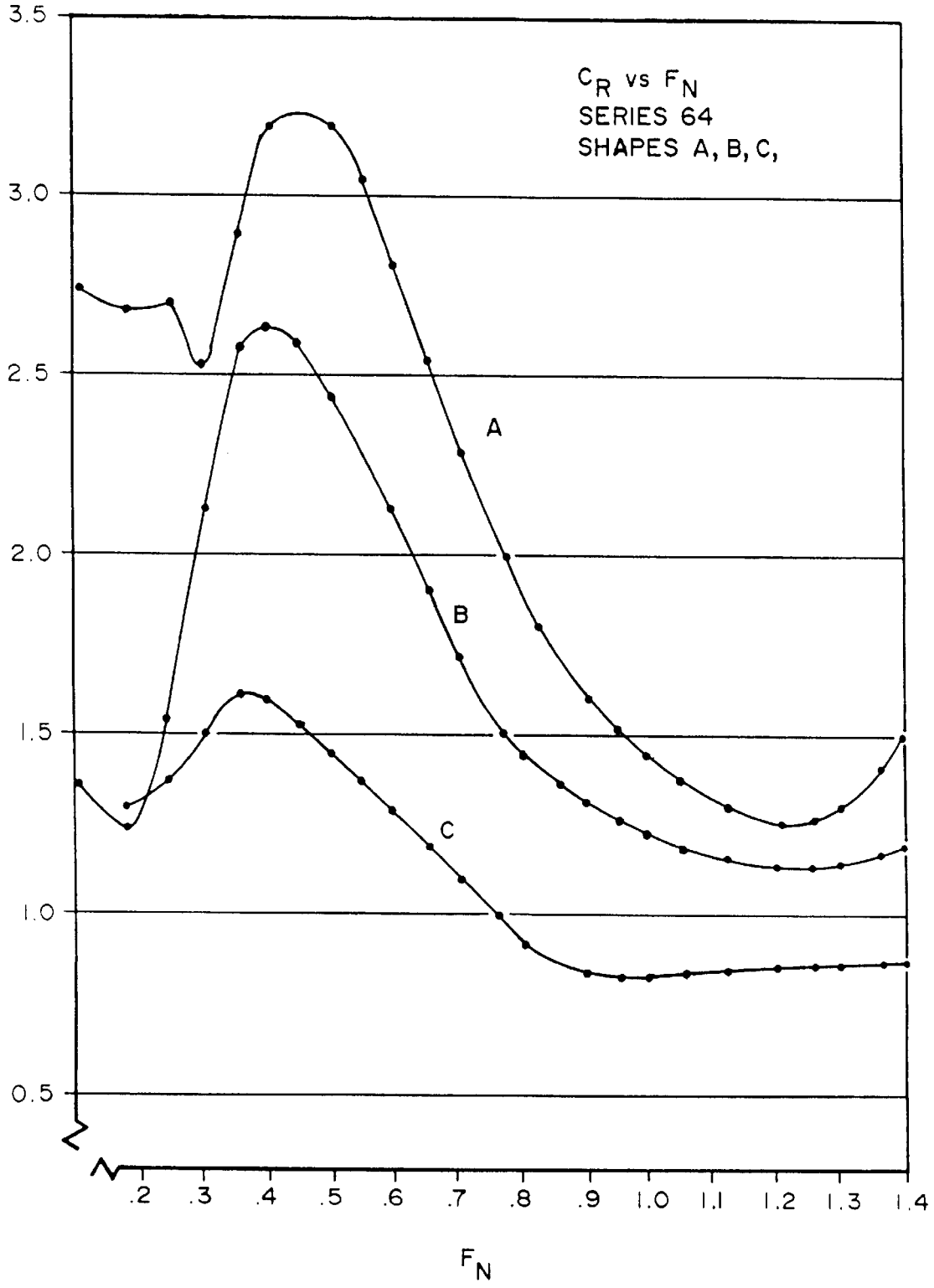
FIG. 5 presents a plot of $C_R$ versus $F_N$ for Series 64 shapes A, B, and C for an embodiment of the present invention.

Plots of $C_R$ vs. $F_N$ for hulls "A", "B", and "C" Series 64 are shown in FIG. 5. Note that the humps at $F_N$=0.24 and 0.30 are not clearly defined but the major and last hump at $F_N$=0.48 is well defined and approximates a minimum value of $F_N$ for use in an embodiment of the present invention. The curves do indicate the hulls "slicing" through the bow wave at $F_N$>0.48, with the corresponding diminishing values for $C_R$. Since both $C_R$ and $C_F$ are reduced for values of $F_N$>0.48, this curve illustrates that in reality the specific resistance is proportional to $V^N$,where N is some value less that 2. $C_R$ and $C_F$ became "modifiers" of equation (7) to fit the conventional $V^2$ relationship with real data.

By substituting equation (3) for $S_W/\nabla$ into equation (4), the specific resistance can be stated as $$\frac{R_W}{W_T} = K(C_R + C_F)\frac{V^2}{2gL_W} = K(C_R + C_F)\frac{F_N^2}{2};$$

with $$K = \frac{S_W L_W}{\nabla} \tag{7}$$

where $L_W$ is the wetted waterline length and K is unique to the hull shape or form. Equation (7) shows that for a given speed V, the specific resistance is inversely proportional to the given hull form's length and also directly proportional to changes in $C_R$ and $C_F$ that occur as the waterline length changes as shown in equations (5) and (6).

Figure 6:
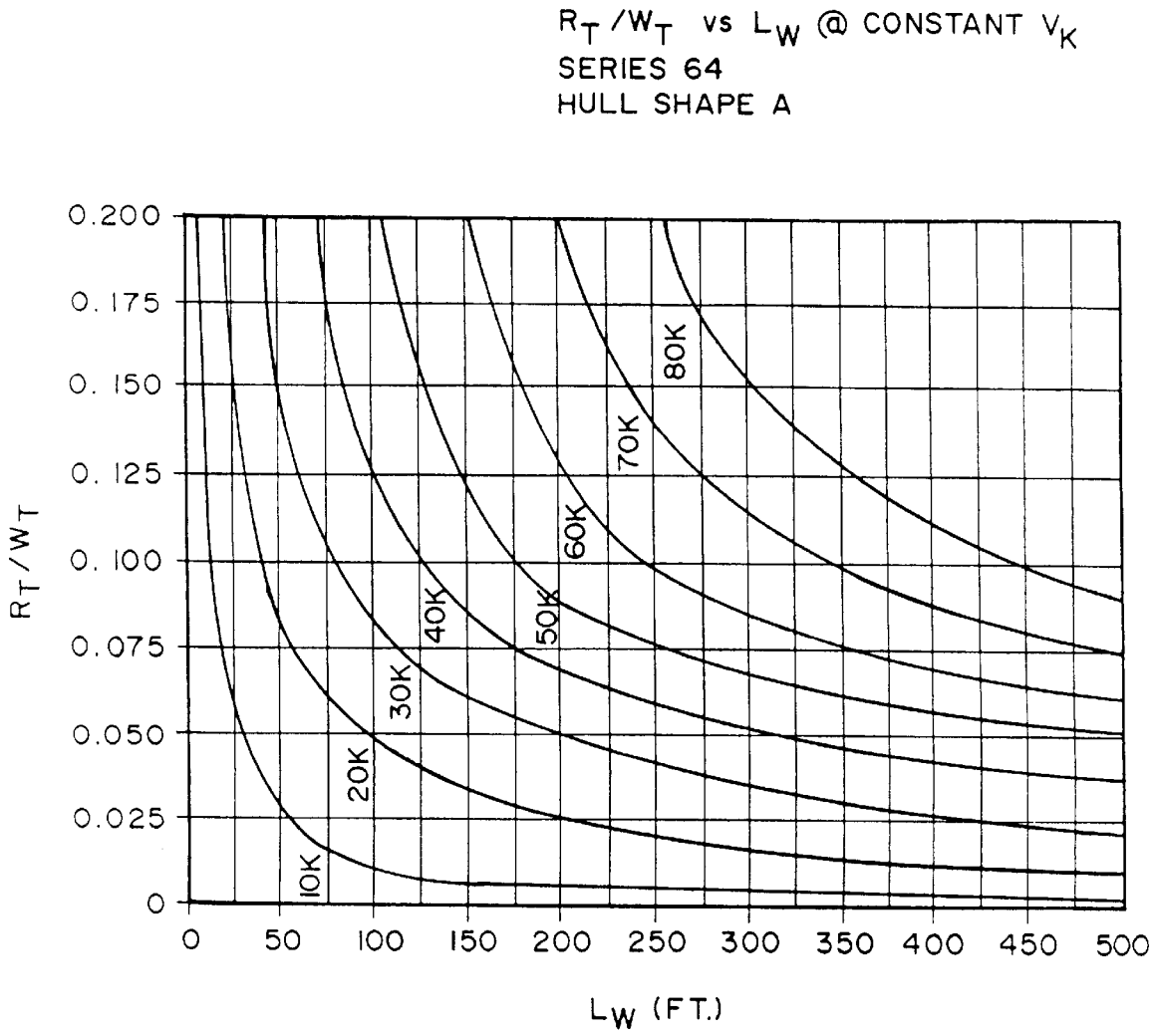
FIG. 6 contains a plot of $R_T/W_T$ versus $L_W$ at constant $V_K$ for Series 64 hull shape A for an embodiment of the present invention.

FIG. 6 illustrates the $R_T/W_T$ vs. $L_W$ for hull "A" Series 64 at different hull speeds, which includes the effects on $C_R$ ($L_W$), $C_F$ ($L_W$), and $L_W$ combined. As can be seen from FIG. 6, the dominance of the inverse relationship with $L_W$ perse is obvious regardless of changes in $C_R$ and $C_F$. The "economy of scale" for displacement hulls is clearly illustrated in FIG. 6. Conversely, there is a significant rise in specific resistance for hull "A" at lengths of less than 100 ft. and speeds in the 20–30 knot range.

Figure 7:
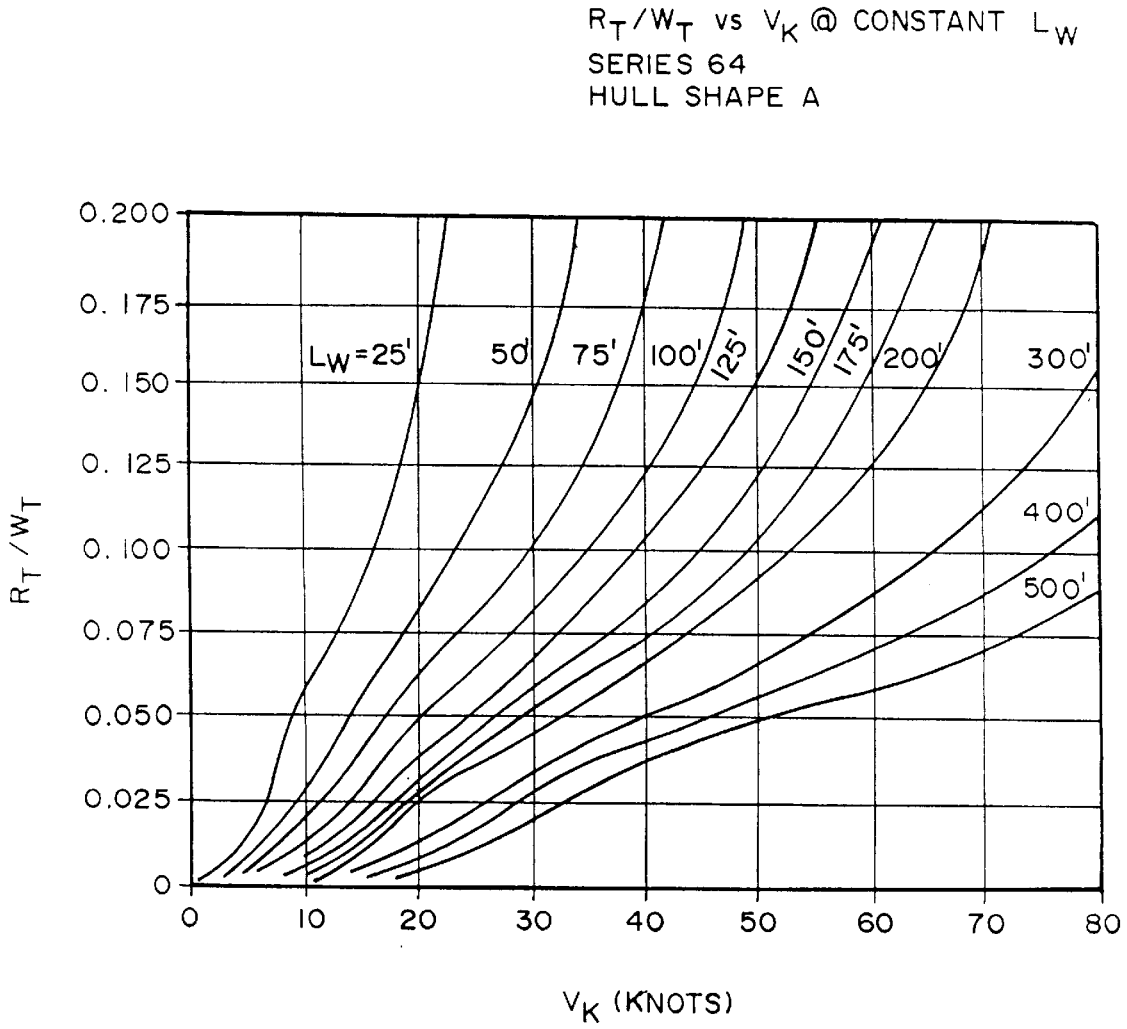
FIG. 7 shows a plot of $R_T/W_T$ versus $V_K$ at constant $L_W$ for Series 64 hull shape A for an embodiment of the present invention.

FIG. 7 presents the same data for hull "A" in a more conventional manner by presenting $R_T/W_T$ VS. $V_K$ for different values of $L_W$. The wave making hump ($F_N$~0.48) is discernible, but not an obstacle. Further, the curves all continue to increase in slope past the hump, as is the case normally with displacement hulls at $F_L$<0.48. However, friction versus residuary becomes the major resistance at higher speeds for hull "A" whereas the opposite is true for normal displacement hulls operating at $F_N$<0.48.

Next considered with regard to an embodiment of the present invention is shape and scale at comparable speeds. The emphasis is on assessing the feasibility of smaller displacement vessels operating at speeds greater than 20 knots up to approximately 30 to 35 knots, or even higher. This is the same range of speed at which larger vessels, such as destroyers, operate. Large and small vessels operating at the same speed range are inherently operating at significantly different Froude numbers ($F_N$) and Reynolds numbers ($R_N$). The effect of different Froude and Reynolds numbers (but comparable speeds) on shape and scale is examined below.

Figure 8A:
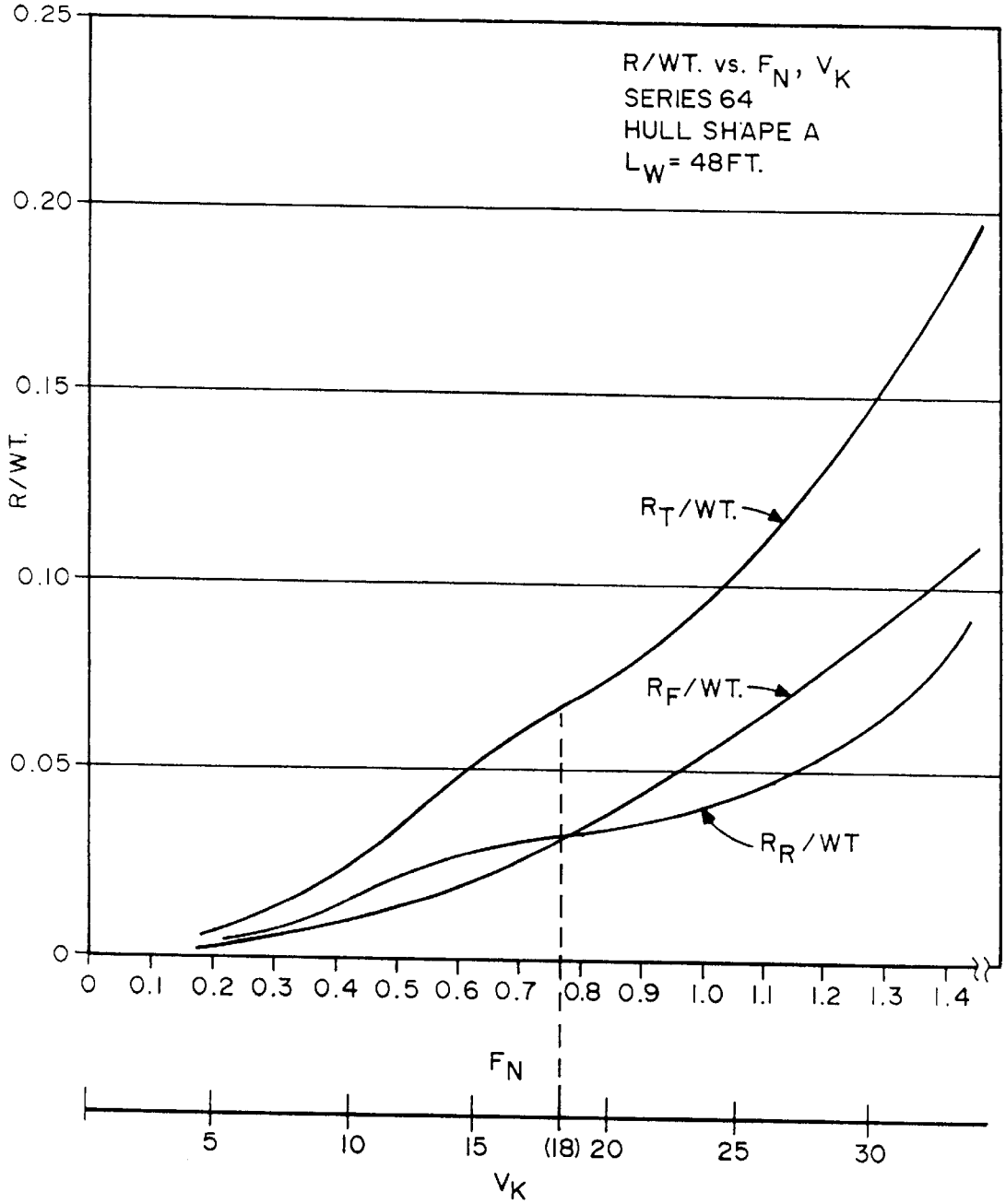
FIG. 8A is a plot of $R_T/W_T$, $R_R/W_T$, and $R_F/W_T$, versus $F_N$, $V_K$ for Series 64 hull shape A with $L_W$=48' for an embodiment of the present invention.
Figure 8B:
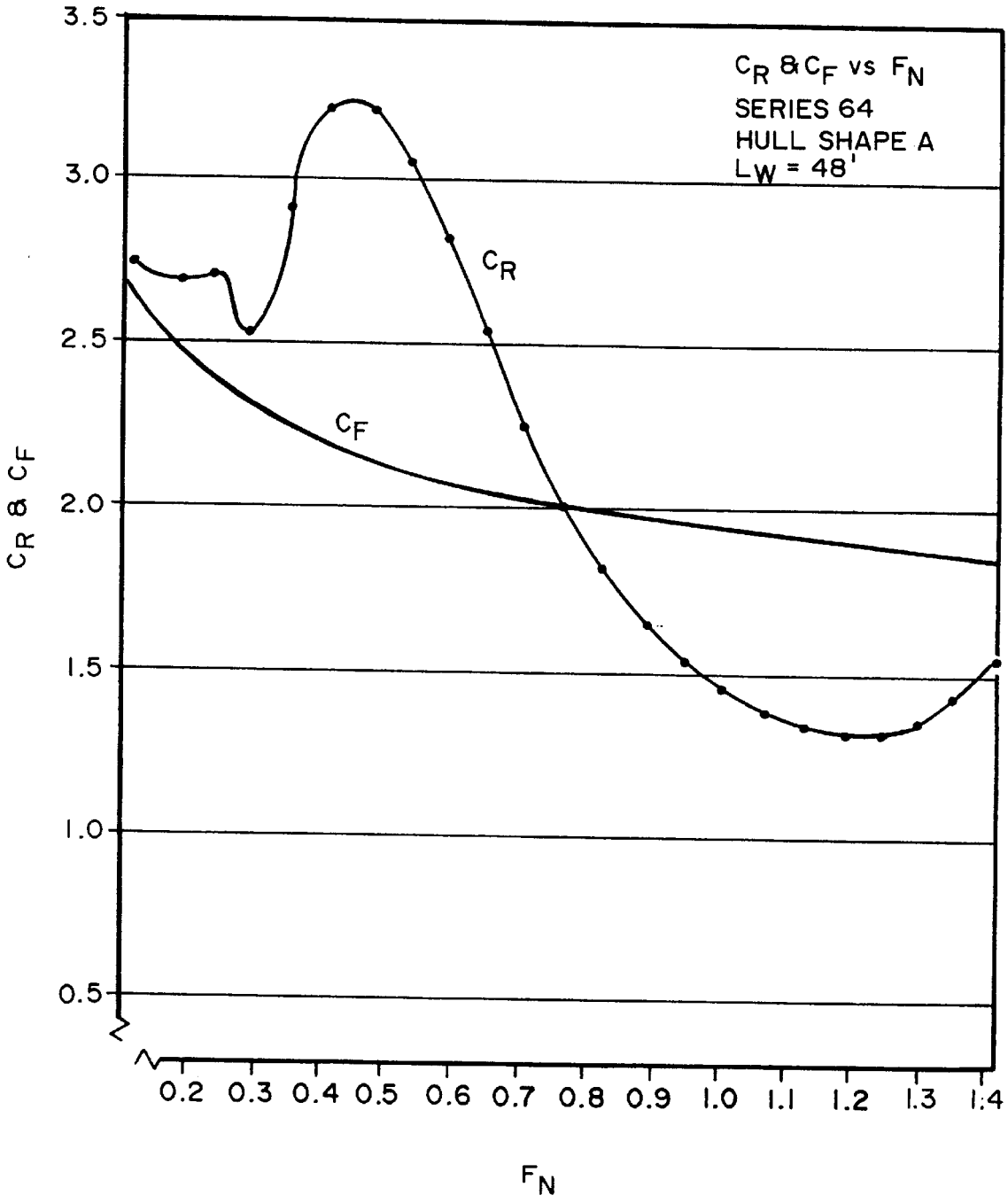
FIG. 8B presents a plot of $C_R$ and $C_F$ versus $F_N$ for Series 64 shape A with $L_W$=48' for an embodiment of the present invention.

FIG. 8A illustrates the combined contribution of friction and residuary resistance on hull "A" shape, but for a "smaller" scale vessel ($L_W$=48', $W_T$=13,619 lbs.). FIG. 8B illustrates $C_R$ vs. $F_N$ and $C_F$ vs. $F_N$ for the hull "A" where $C_F$ vs. $F_N$ is valid only for the particular scale being considered. The $C_F$ vs. $F_N$ curve therefore has a corresponding speed vs. $F_N$ as indicated. While the $C_R$ vs. $F_N$ is valid for any combination or speed and scale for hull "A", it is clear in FIGS. 8A and 8B (for the hull "A" with $L_W$=48 ft.) that at speeds in excess of about 18 knots ($F_N$=0.755) the friction resistance exceeds residuary resistance. Although, the series 64 data for hull "A" does not show it, the friction resistance also exceeds the residuary resistance at very low speeds. The characteristic of residuary resistance beginning to dominate friction resistance as $F_N$ increases is the normal response for conventional displacement hulls operating up to $F_N$=0.48.

Figure 9A:
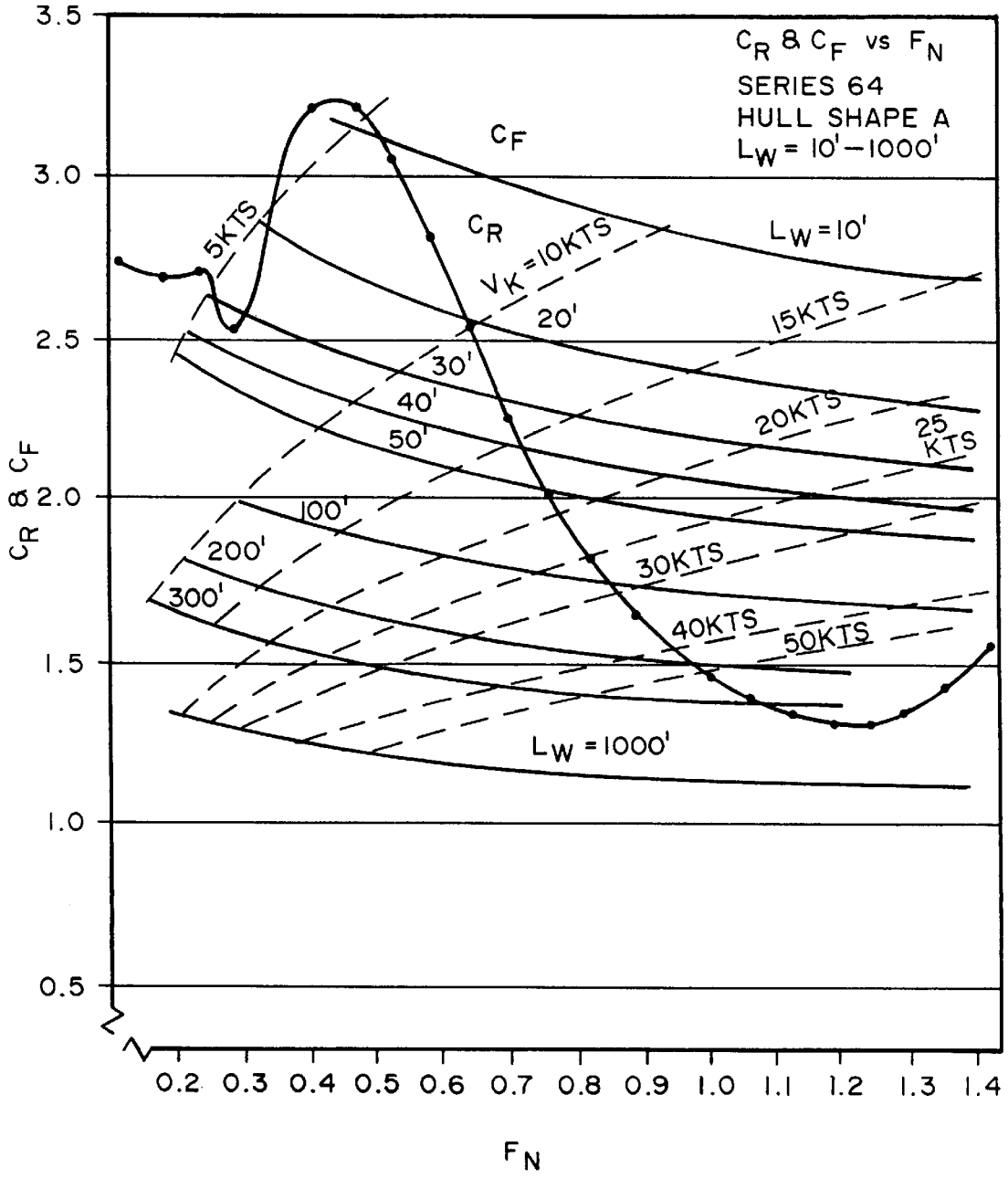
FIG. 9A contains a plot of $C_R$ and $C_F$ versus $F_N$ for Series 64 shape A with $L_W$=10'–1000' for an embodiment of the present invention.
Figure 9B:
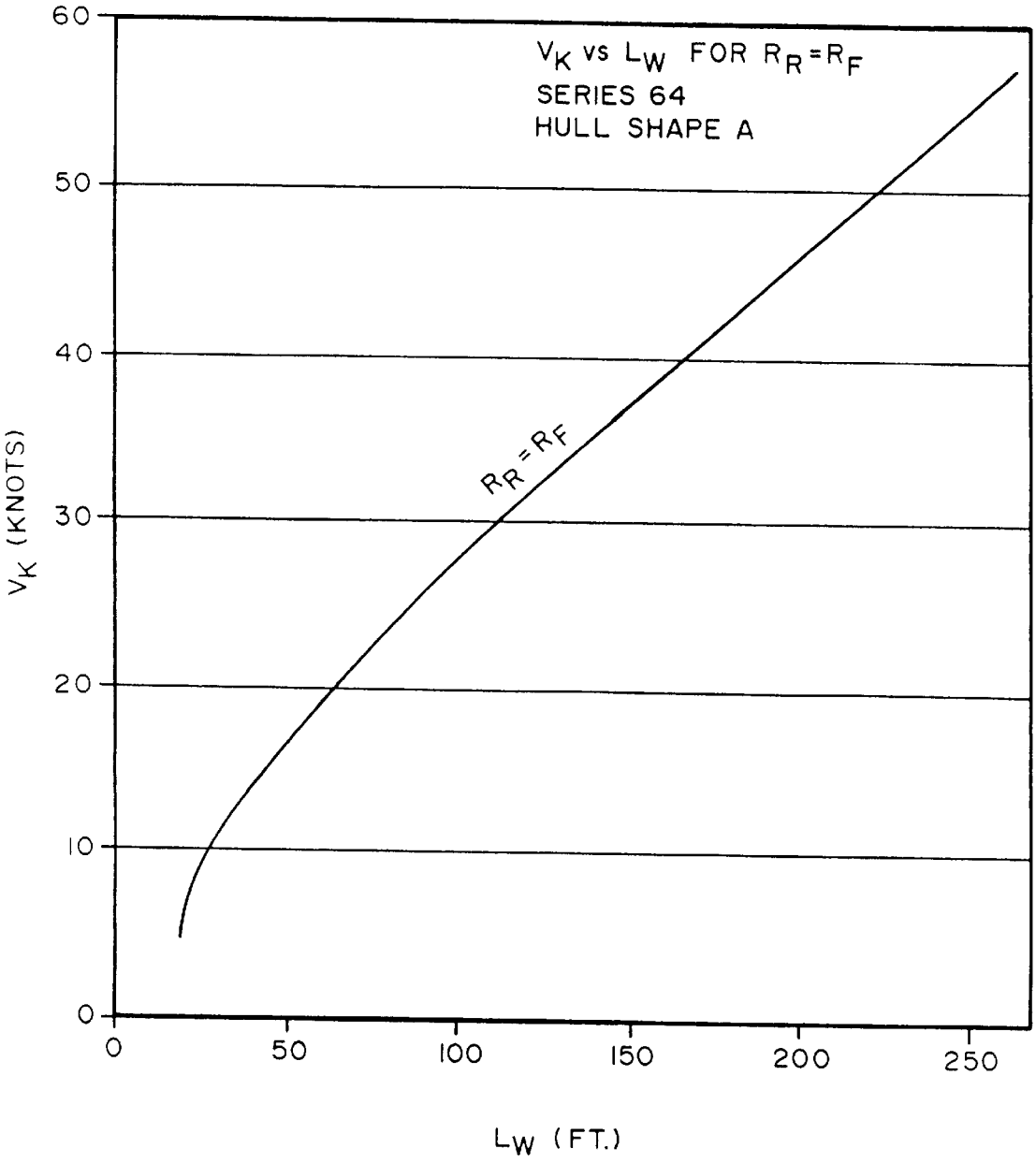
FIG. 9B shows a plot of $V_K$ versus $L_W$ for $R_R$=$R_F$ for Series 64 hull shape A for an embodiment of the present invention.

FIG. 9A presents the $C_R$ vs. $F_N$ curve for hull "A" shape, but the $C_F$ vs. $F_N$ curves are shown for several hull "A" sizes, along with the corresponding speeds. In an embodiment of the present invention, the hull "A" shape of differing sizes but at comparable speed ranges is examined, as shown in FIG. 9A. For example, a 50 ft. vessel operating in the 20–30 knot speed range experiences more friction resistance than residuary, while a 200 ft vessel of the same shape and operating in the same speed range experiences significantly more residuary resistance than friction resistance. In an embodiment of the present invention, the intersection points of the $C_R$ curve are plotted with the multiple $C_F$ curves, producing a curve of hull speed vs. hull length at which $C_F$=$C_R$ can be made for hull "A" shape (see FIG. 9B). At conditions above the curve, friction is the greater resistance while below residuary resistance is greater.

Since slenderness (L/B) is an important aspect of the present invention, its relative impact on "smaller" and "larger" vessels resistance at comparable speeds is an important response to understand. Hull "C" in Table 3, shown in FIG. 4, represents a substantial change in hull slenderness vs. hull "A", while other hull parameters remain essentially unchanged. A comparison of hull "A" and "C" for both smaller and larger vessels is given below.

To examine the effect of hull form changes separately from that of scale, in an embodiment of the present invention, two hull forms are compared at the same displacement. At the same speed, the two hull forms are compared at the same volume Froude number $F_{N\nabla}$ where:

$$F_{N\nabla} = \sqrt{\frac{L_W}{\nabla^{\frac{1}{3}}}}\, F_N = \frac{V}{\sqrt{g\nabla^{\frac{1}{3}}}} \tag{8}$$

For hull "A" with $L_W$=48 ft. (the smaller vessel) and hull "C" to be compared at the same displacement, the length of hull "C" is $L_W$=62.39 ft. Likewise for hull "A" with $L_W$=200 ft. (the larger vessel) to be compared to hull "C", the length of hull "C" is $L_W$=259.95 ft.

Figure 10A:
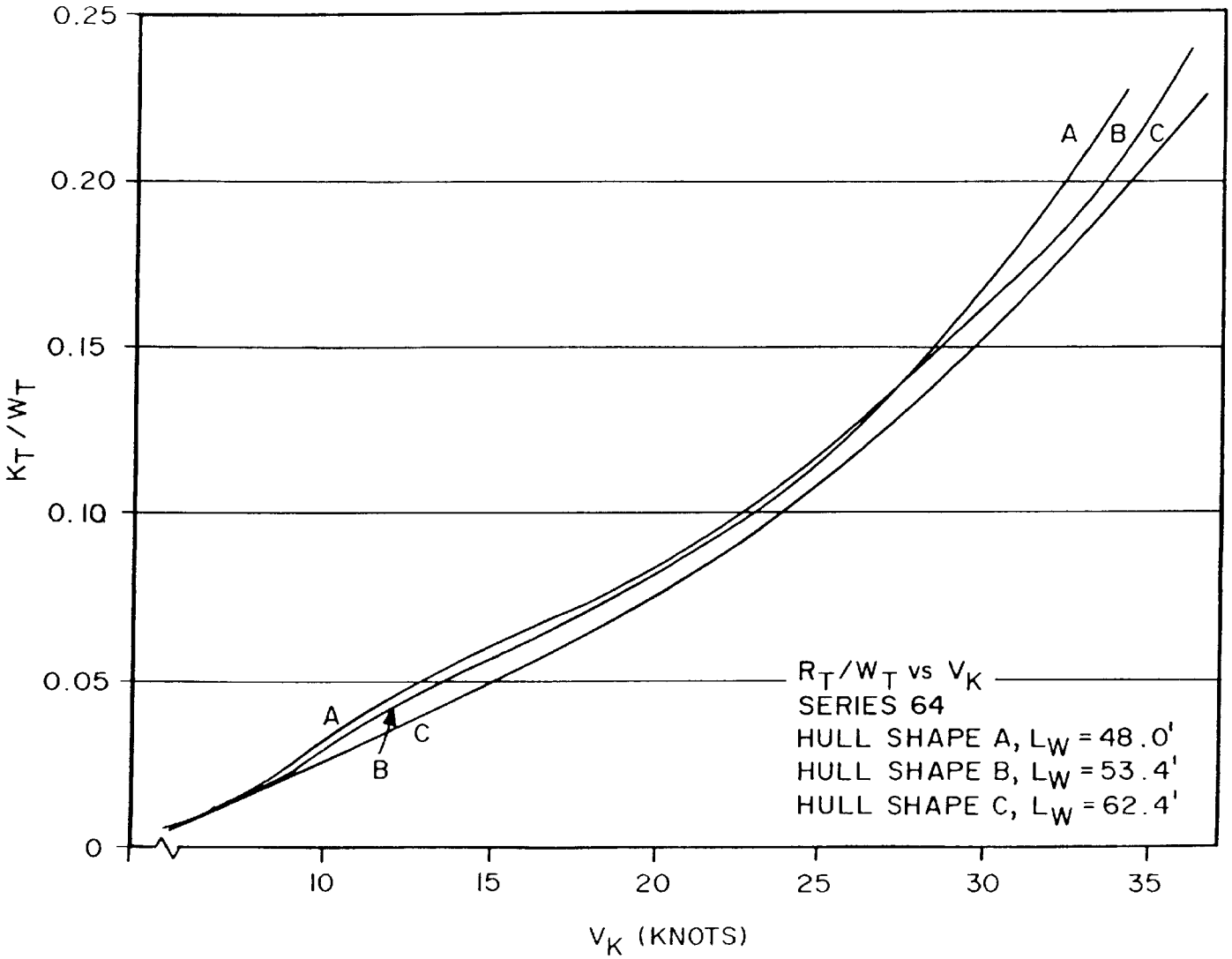
FIG. 10A is a plot of $R_T/W_T$ versus $V_K$ for Series 64 hull shape A with $L_W$=48.0', hull shape B with $L_W$=53.4', and hull shape C with $L_W$=62.4' for an embodiment of the present invention.
Figure 10B:
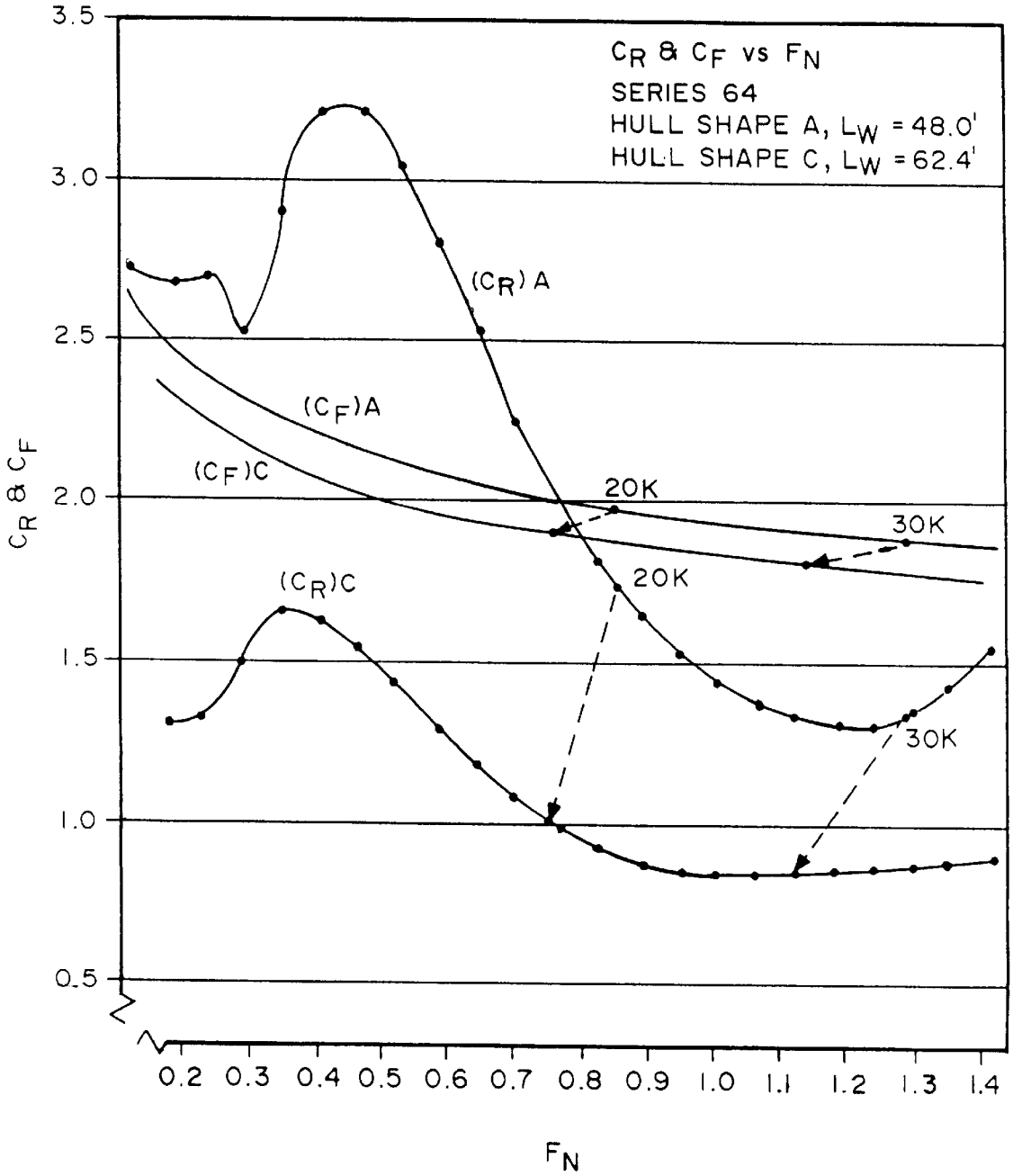
FIG. 10B presents a plot of $C_R$ and $C_F$ versus $F_N$ for Series 64 shape A with $L_W$=48' and shape C with $L_W$=62.4' for an embodiment of the present invention.
Figure 11A:
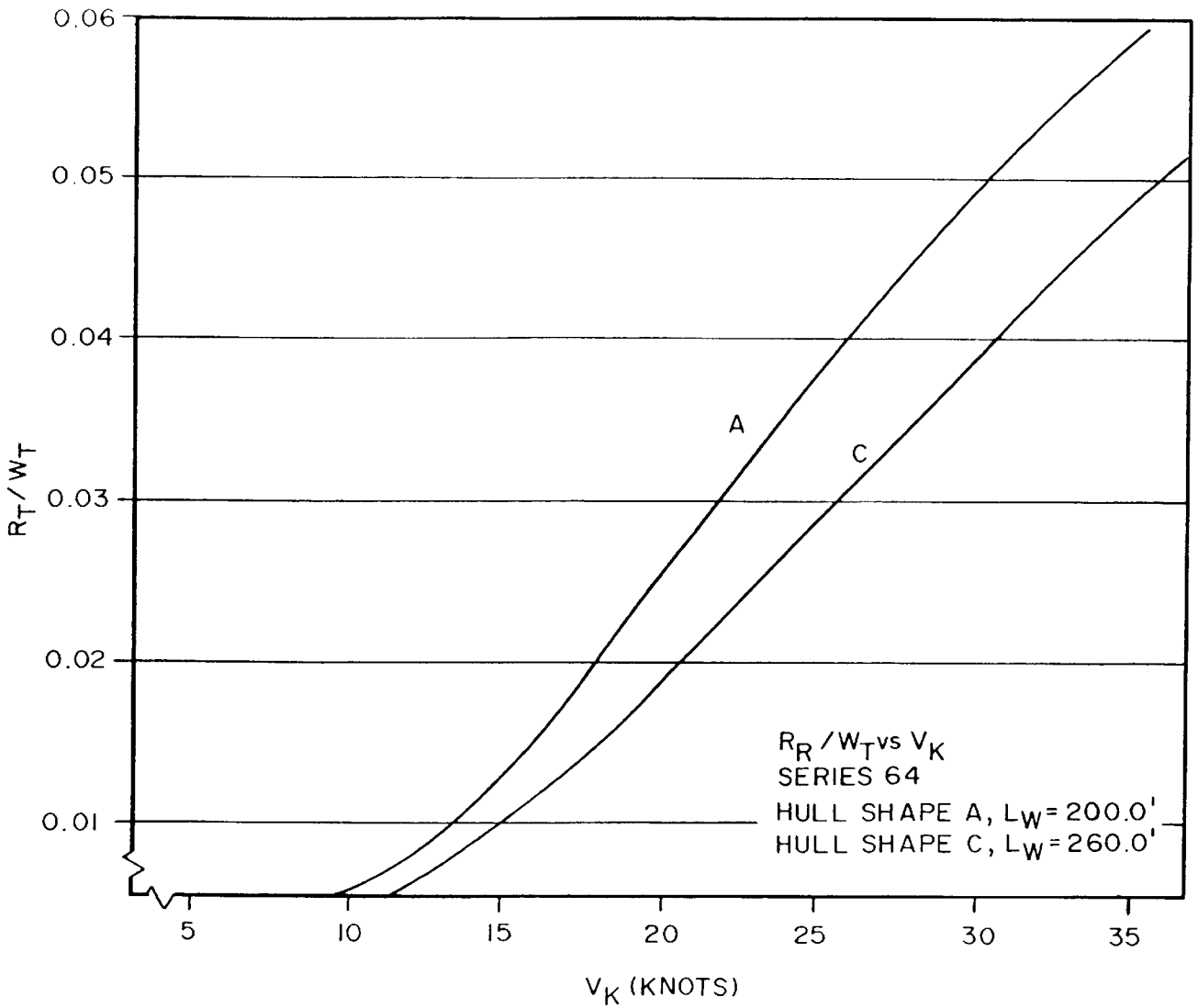
FIG. 11A contains a plot of $R_T/W_T$ versus $V_K$ for Series 64 hull shape A with $L_W$=200.0' and hull shape C with $L_W$=260.0' for an embodiment of the present invention.
Figure 11B:
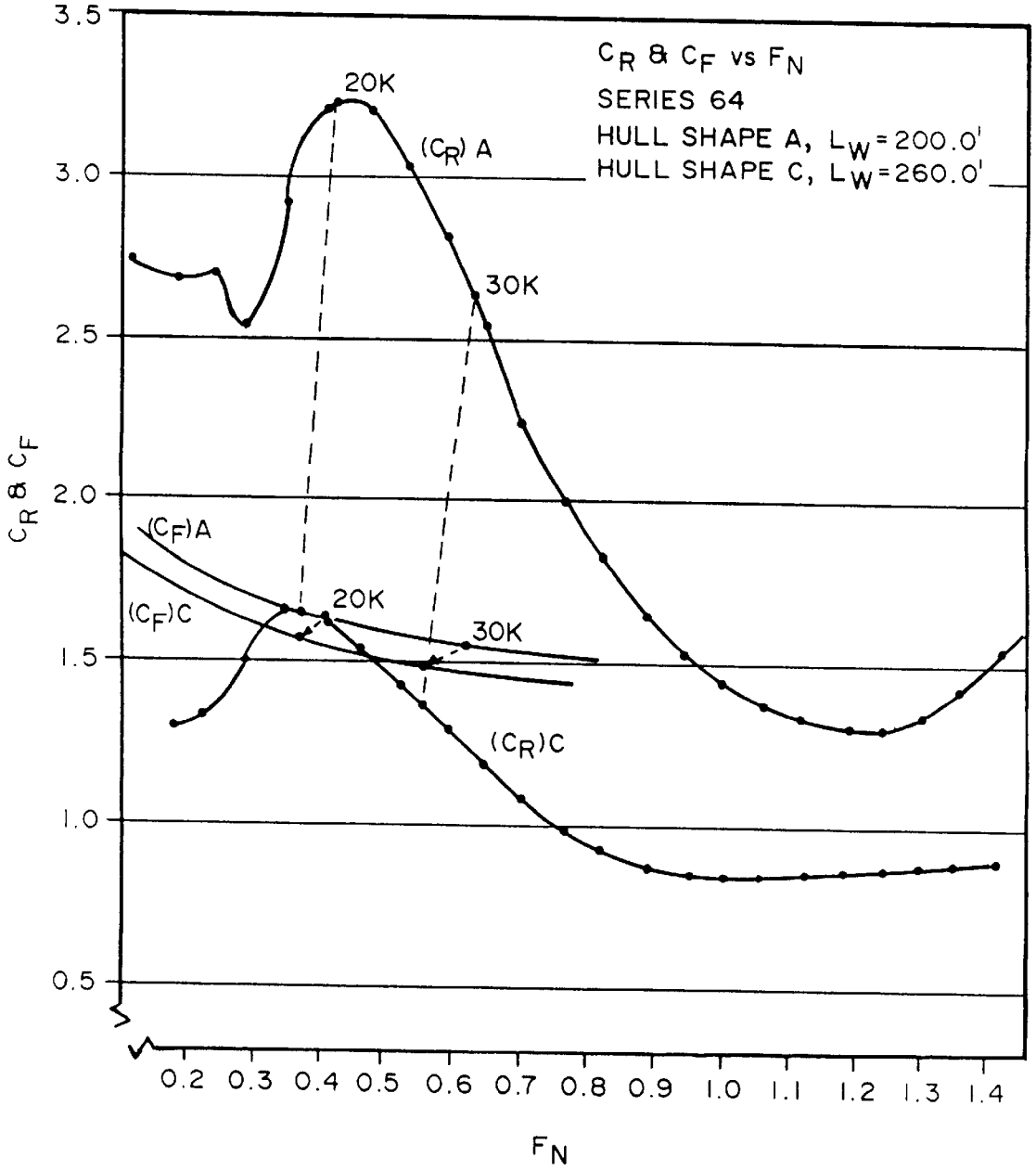
FIG. 11B shows a plot of $C_R$ and $C_F$ versus $F_N$ for Series 64 shape A with $L_W$=200.0' and shape C with $L_W$=260.0' for an embodiment of the present invention.

FIGS. 10A and 10B illustrate the effects of changing hull form from hull "A" to hull "C" for the small 48 ft. vessel, and FIGS. 11A and 11B represent the same for the larger 200 ft. vessel. It is immediately apparent that the slenderness change from L/B=9.762 for hull "A" to L/B=14.479 for hull "C" is much more effective in reducing the specific resistance for the larger vessel than it is for the smaller vessel. This is especially so in the considered speed range of 20 to 30 knots.

From Equation (3) and FIGS. 10A and 10B, Table 4, shown in FIG. 12 was generated. It can be seen in Table that for the "smaller" vessels, friction resistance is dominant versus residuary resistance, and the increase in surface area and subsequent increase in friction resistance for hull "C" vs. hull "A" substantially offsets the lowering of the residuary resistance. However, for the "larger" vessels operating at lower Froude Numbers but in the same speed range, the residuary resistance is dominant and the increased slenderness of hull "C" vs. hull "A" is more effective in reducing total hull resistance.

Interestingly, the resistance curves for hulls "A", "B", and "C" nest one with another such that there are no crossovers of curves even for smaller vessels. Stated differently, there is some reduction in resistance with increased slenderness throughout the $F_N$ range considered. However, there are likely hull shapes with such a high $L/\nabla^{1/3}$ value that the resistance actually exceeds that of shapes having lower values of $L/\nabla^{1/3}$, especially for smaller vessels at higher speeds.

Figure 13:
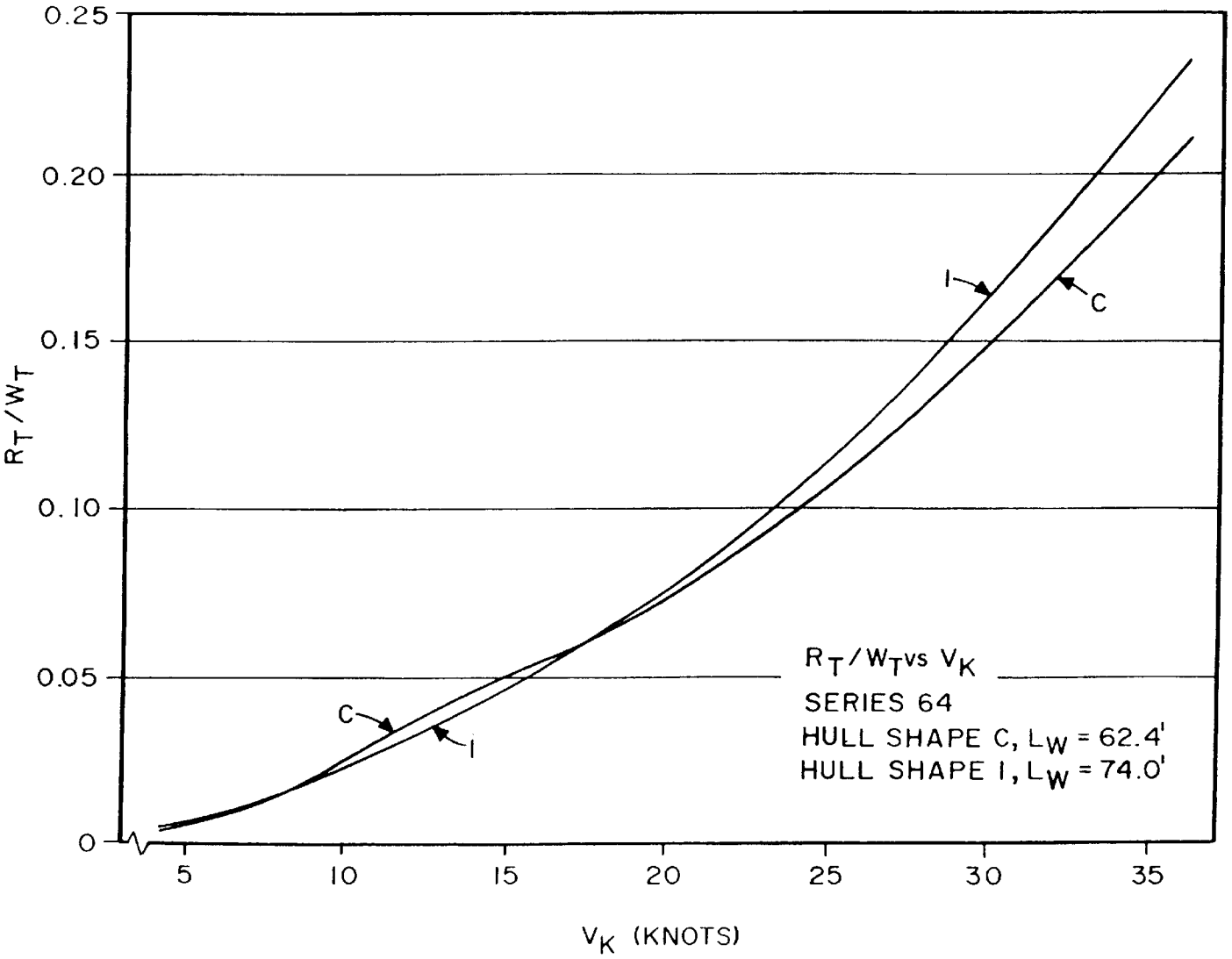
FIG. 13 contains a plot of $R_T/W_T$ versus $V_K$ for Series 64 hull shape C with $L_W$=62.4' and hull shape I with $L_W$=74.0' for an embodiment of the present invention.

Of the shapes given in Series 64, hull "I" has the largest values of $L/\nabla^{1/3}$ and $SL/\nabla$. But hull "I" has a lower value of $C_B$ than hulls "A", "B", and "C". Hull "I" does, however, illustrate where slenderness and fineness can result in higher resistance than less slender hulls. FIG. 13 illustrates this for the smaller hulls at the speed ranges of interest. But for the smaller vessel at low speeds and for the larger vessels at speeds of interest, even hull "I" gives somewhat lower resistance than the other hull shapes.

An embodiment of the present invention thus incorporates use of the concept that for displacement hull vessels, hull shape and size are coupled, such that for a given design speed, smaller vessels have a slenderness less than that of a larger vessel, when considering both resistance and practical usefulness. As a result, the longer slender hull of the same displacement as a somewhat less slender hull is not justified with the diminishing reduction in resistance. Taken to the extreme, resistance increases with slenderness.

Coupling of design speed with hull shape and scale, as used in an embodiment of the present invention, will now be discussed.

Unlike planing hulls, where there may be a maximum range speed other than dead slow, resistance of a displacement hull increases continually with speed, and correspondingly the range decreases with speed. There is not a clear, optimum speed for displacement hulls. An embodiment of the present invention thus addresses the design speed in relation to hull shape and scale. Of particular interest is determining a relationship rationale for hull speed, shape, and scale in the domain where friction and residuary resistance are of comparable magnitudes.

In an embodiment of the present invention, a total resistance basis is used for determining design speed. Following is a technique of an embodiment of the present invention for estimating $R_T$ for a wide range of vessels based on published horsepower vs. speed data using definitions estimates as given in *Principles of Naval Architecture Second Edition,* Vol. II Pgs. 129–131 and in Dave Gerr, *Propeller Handbook,* International Marine, A Division of the McGraw Hill Companies, Camden, Me. (1988), pp. 1–2.

Effective Power=$P_E$=$R_T$ V

Indicated Power=$P_I$

Brake Power=$P_B$ $$\frac{P_E}{P_I} \approx 0.5, \quad \frac{P_I}{P_B} \approx 0.95$$

For published vessel data $P_B$ is usually the brake power delivered at the vessel's maximum speed $V_{MAX}$. From the above, the following equation for estimating can be determined.

$$R_T \approx 0.475\, \frac{P_B}{V_{\mathrm{MAX}}} \tag{9}$$

In units of horsepower, knots, and pounds force the equation can be written as:

$$\frac{R_T}{W_T} = \frac{154.685\ (BHP)}{(V_K \max)\ (W_T)}\ \text{(Dimensionless)} \tag{10}$$

Appendix 3 contains of a tabulation of published data of several types of vessels, along with calculated hull characteristics and performance data, including estimated values of $R_T/W_T$. Although Appendix 3 data is discussed in more detail below, immediate attention is paid to the estimated values for $R_T/W_T$.

The military ship hulls 1–6 discussed in Appendix 3—being displacement hulls—all have relatively large values for $L/\nabla^{1/3}$, $F_N$ numbers of 0.27–0.81, and reflect the economy of scale with $R_T/W_T$ values of From 0.009 to 0.090, which corresponds well with $F_{N\nabla}$. The military patrol planing vessels 7–9 are characterized with low values for $L/\nabla^{1/3}$,$F_N$ values from 1.30–2.00, and correspondingly higher values for $R_T/W_T$—ranging from 0.157 to 0.174.

Displacement hulls 10–18, which are classified as passagemakers, are designed for long range, and range is inversely proportional to $R_T/W_T$. With their low values for $L/\nabla^{1/3}$ they must operate at really low speeds to achieve the necessary low values of $R_T/W_T$. of 0.031 to 0.053.

Hulls 19–27 exhibit the transition from displacement to semi-planing hulls, with total speeds moving into the range of interest for an embodiment of the present invention, but the values $R_T/W_T$ rise from 0.05 to 0.167—well beyond the economy potential for displacement hulls.

Hulls 28 and 29 represent popular planing vessels with correspondingly high values of $R_T/W_T$ and limited range.

Hulls 32–34 are catamarans with data presented on a per hull basis. Hull 32 "The Awesome 72" is of particular interest, with the relatively high value or $L/\nabla^{1/3}$, the speed (estimated), and the relatively low value or $R_T/W_T$=0.085. Hulls 33 and 34 appear to be narrow planing hulls with the relatively high values for $R_T/W_T$ of 0.148 and 0.136, respectively. Vessels 35 and 36 are high performance trimarans designed for long range and higher speeds, having very large values for $L/\nabla^{1/3}$ and values for $R_T/W_T$ slightly greater than $R_T/W_T$=0.100.

Figure 14:
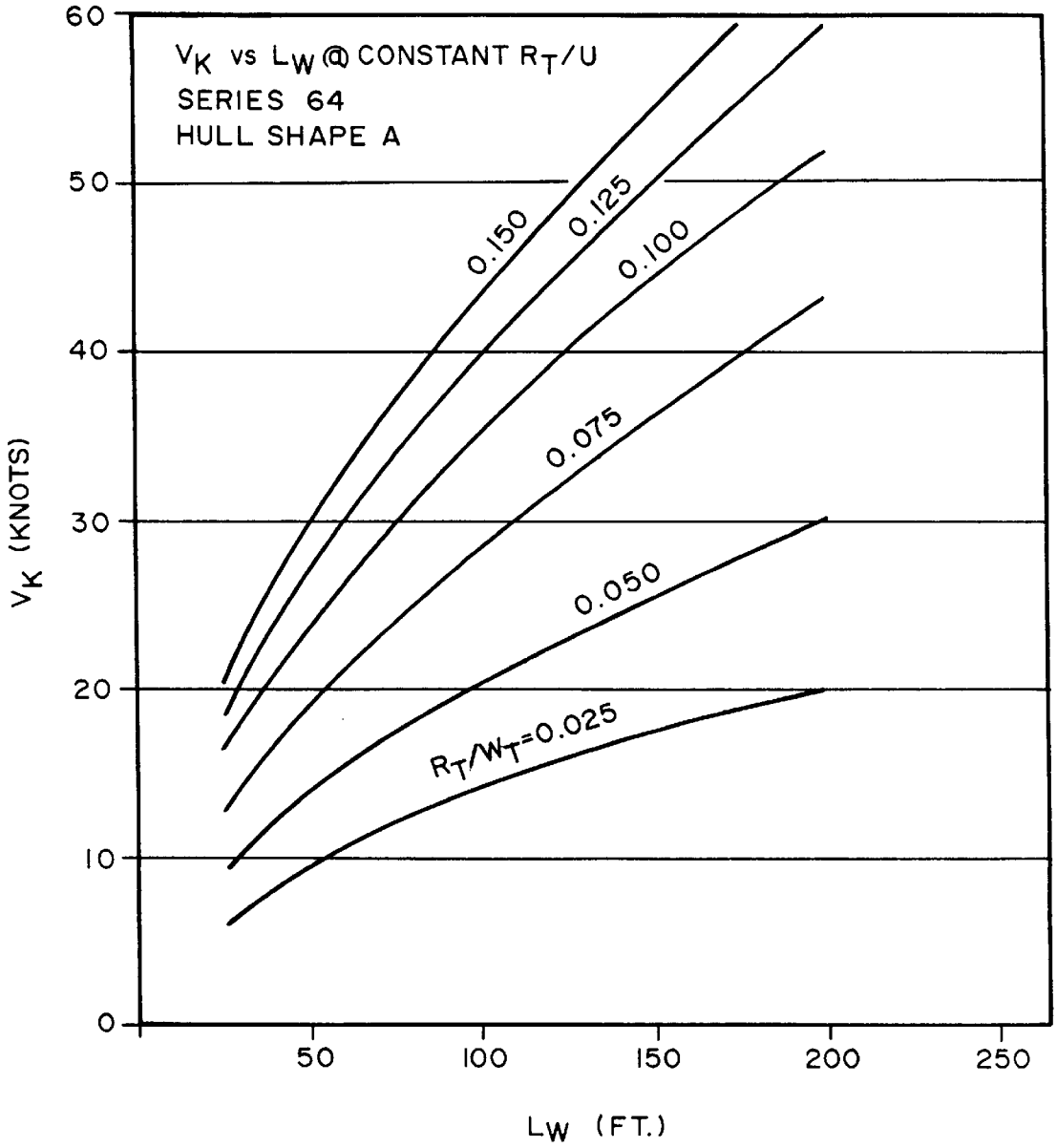
FIG. 14 shows a plot of $V_K$ versus $L_W$ at constant $R_T/W_T$ for Series 64 hull shape A for an embodiment of the present invention.

Close examination of the Appendix 3 data with regard to an embodiment of the present invention suggests that for a slender displacement hull to offer utility and economy at speeds of interest, $R_T/W_T$ should best not exceed a value of about 0.10. Values for $R_T/W_T$>0.10 encompasses vessels with semiplaning and planing characteristics with more efficiency than purely displacement hulls. This of course is of no constraint on large vessels like hulls 1–6 in Appendix 3. Of relevance to smaller vessels, referring back to Series 64 hull "A", FIG. 14 illustrates curves of constant $R_T/W_T$, which provides the hull speed-length relationship constraint. For hull "A" shape, the curve shows that at the speeds of 20 and 30 knots the hull "A" shape length should not be less than 36 to 75 ft. respectively in order for the criterion $R_T/W_T \leqq 0.10$ to be satisfied.

Another consideration of an embodiment of the present invention is a residuary vs. frictional resistance basis for determining hull speed. It was .indicated above that for a smaller displacement hull, increasing $L/\nabla^{1/3}$ to reduce residuary resistance can be significantly diminished in effect by the corresponding increase in friction resistance. Moreover, the data in Appendix 3 clearly illustrates the utility tendency for smaller vessels to have reduced values for $L/\nabla^{1/3}$,even at the expense of reduced speed and/or significantly increased power requirements at speed. Thus, in an embodiment of the present invention, slenderness for smaller displacement hulls is approached from the perspective of "just slender enough but no more" in order to realize a reasonably useful, fast, efficient vessel. As a result, smaller displacement vessels of interest have shapes more like those of Series 64 hull "A" and hull "B" where $C_R$ and $C_F$ are comparable, as opposed to hull "C", in which $C_F$ exceeds $C_R$ at all speeds for smaller vessels. (See FIG. 10B.) A factor addressed by an embodiment of the present invention is whether there is a "best" speed for these hull types. Hull "A" characteristics with regard to this embodiment are examined below.

FIG. 8A illustrates total resistance, as well as the residuary and fraction resistance separately, for hull "A" with $L_W$=48 feet. Note that at extremely low values of $F_N$, $R_F$ is about equal to $R_R$, and there is a region where $R_R$ is greater than $R_F$ and finally at higher values for $F_N$, $R_F$ again exceeds $R_R$. Intuitively it would seem that the crossover point at $F_N$=0.773—where $R_R$ is equal to $R_F$—might be a distinct point to operate, but $R_T$ does not show any apparently significant characteristic at this point, except that the slope of $R_T$ might be minimal: at the crossover point, the rate of change of $R_T$, with increasing speed, might be a decreasing value. Stated differently, since range is inversely proportional to resistance, the cross over point might be where speed is increased with the least loss of range.

Figure 15:
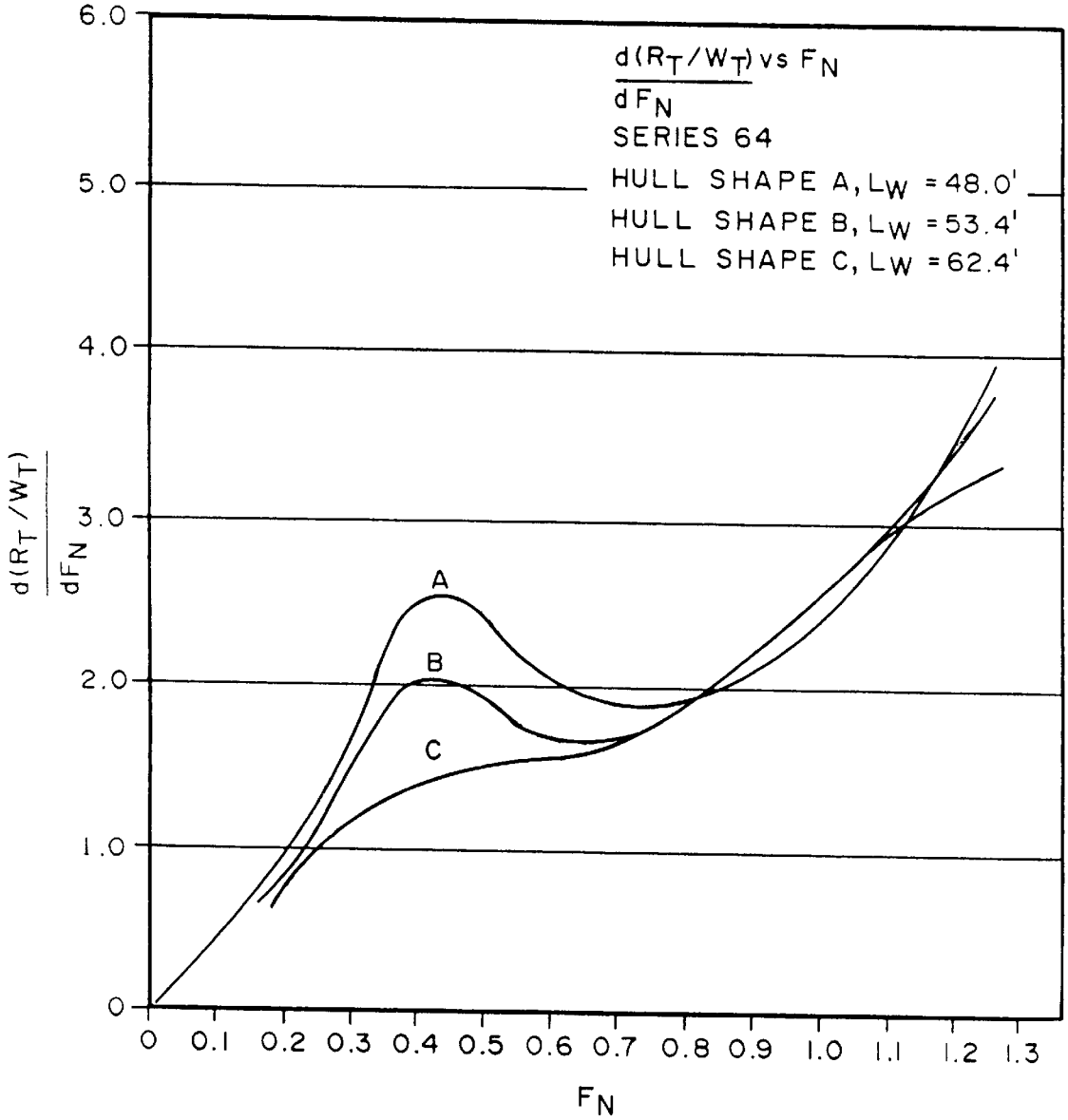
FIG. 15 presents a plot of $d(R_T/W_T)/d(F_N)$ versus $F_N$ for Series 64 shape A with $L_W$=48.0', shape B with $L_W$=53.4', and shape C with $L_W$=62.4' for an embodiment of the present invention.

FIG. 15 shows the rate of change of $R_T$ with respect to speed for hull "A", "B", and "C" at equal displacement. Characteristics of the curves include the following: 1) at lower values of $F_N$—where residuary resistance is significant—the rate of change of $R_T$ vs. speed is greatest for hulls of reduced slenderness, as would be expected; 2) hulls "A" and "B" both have a minimum value for rate of change at the point where $R_F$=$R_R$; and 3) hull "C" does not exhibit such a minimum value since $R_F$ is greater than $R_R$ for all values of $F_N$; at higher values of $F_N$—where $R_F$ is greater than $R_R$ for all three hulls—the rate of change values for all three hulls converge; in fact hull "A" exhibits a lower resistance rate of change over a significant range of $F_N$, which is less than that of the more slender hulls "B" and "C".

FIG. 10A illustrates in a different way the same phenomenon: 1) at speeds above which $R_F$ is greater than $R_R$, the $R_T$ vs. speed curves for hulls "A", "B", and "C" converge, and the advantage of increased slenderness is diminished (although not eliminated); and 2) at lower speeds—where residuary resistance is greater—the advantage of hull slenderness is still clear and distinct, even for the "small" hulls being considered.

Figure 16:
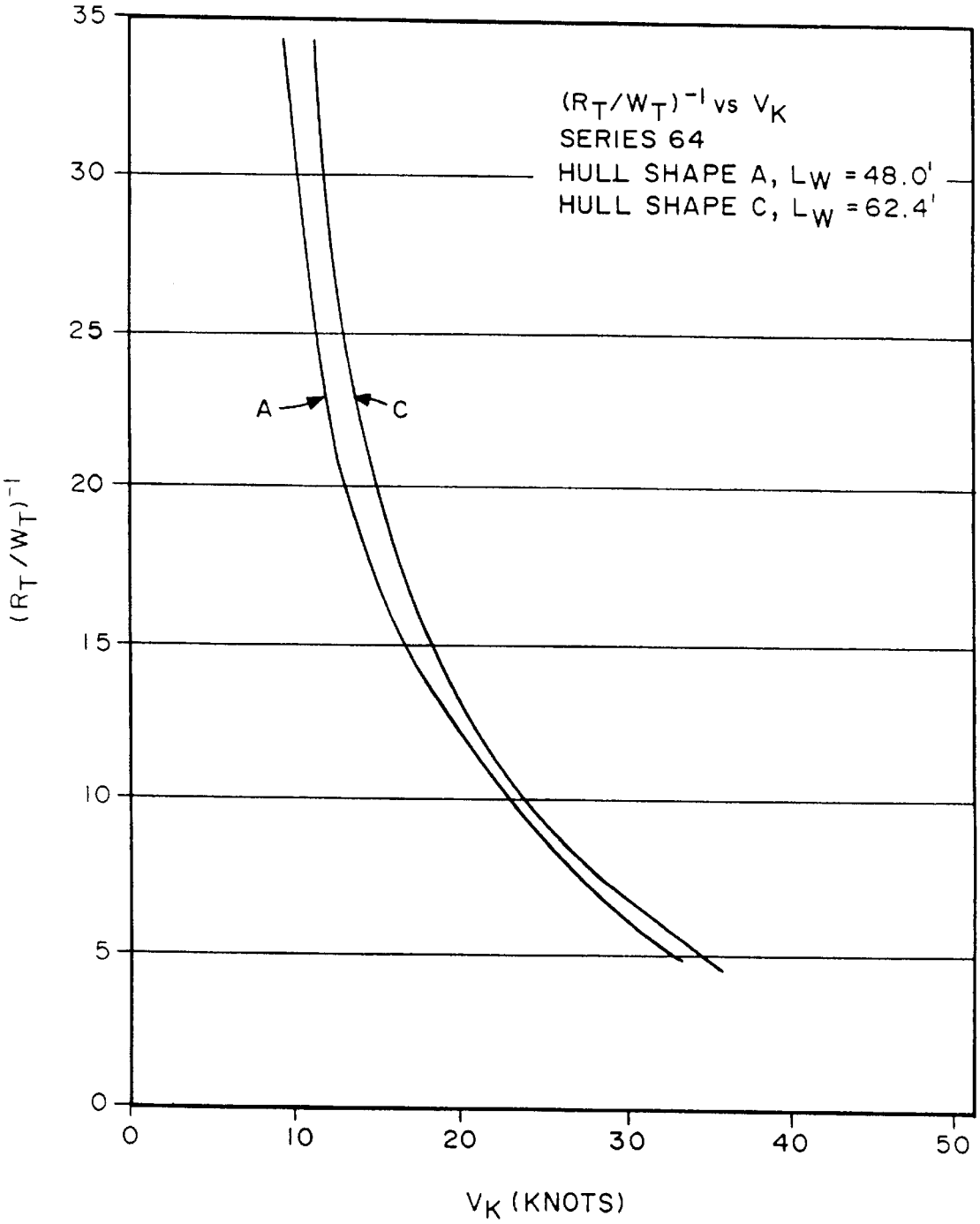
FIG. 16 contains a plot of $(R_T/W_T)^{-1}$ versus $V_K$ for Series 64 hull shape A with $L_W$=48.0' and hull shape C with $L_W$=62.4' for an embodiment of the present invention.

Assuming the power transmission efficiencies remain constant, in an embodiment of the present invention, hull range comparisons are made by plotting reciprocal values of $R_T$. FIG. 16 illustrates such a comparison of hull "A" vs. hull "C". In FIG. 16, hull "C" has a significantly greater range than hull "A" at low speeds, but the range curve for hull "A" approaches that of hull "C" at the higher speeds of interest.

In an embodiment of the present invention, for smaller displacement hulls having lower values of $L/\nabla^{1/3}$ (like hull "A" vs. hull "C"), for purposes of more utility and lower friction resistance, the penalty of increased residuary resistance is mitigated by operating at speeds where $R_F$ is greater than $R_R$. This is the criterion for specifying a lower "design speed" limit for the hull shape and scale being considered. While this is the case for smaller vessels—where $R_F$=$R_R$ at desired speeds of about 30–35 knots—it is not so for larger vessels, where the speed for $R_F$=$R_R$ is greater than desired. For larger vessels, $F_N$ is reduced to the point that the residuary resistance is the major of the two, and further slenderness might be desired. (Of course this does not preclude operating below the lower limit design speed when such factors as weather and fuel economy determine it prudent to do so.)

Figure 17:
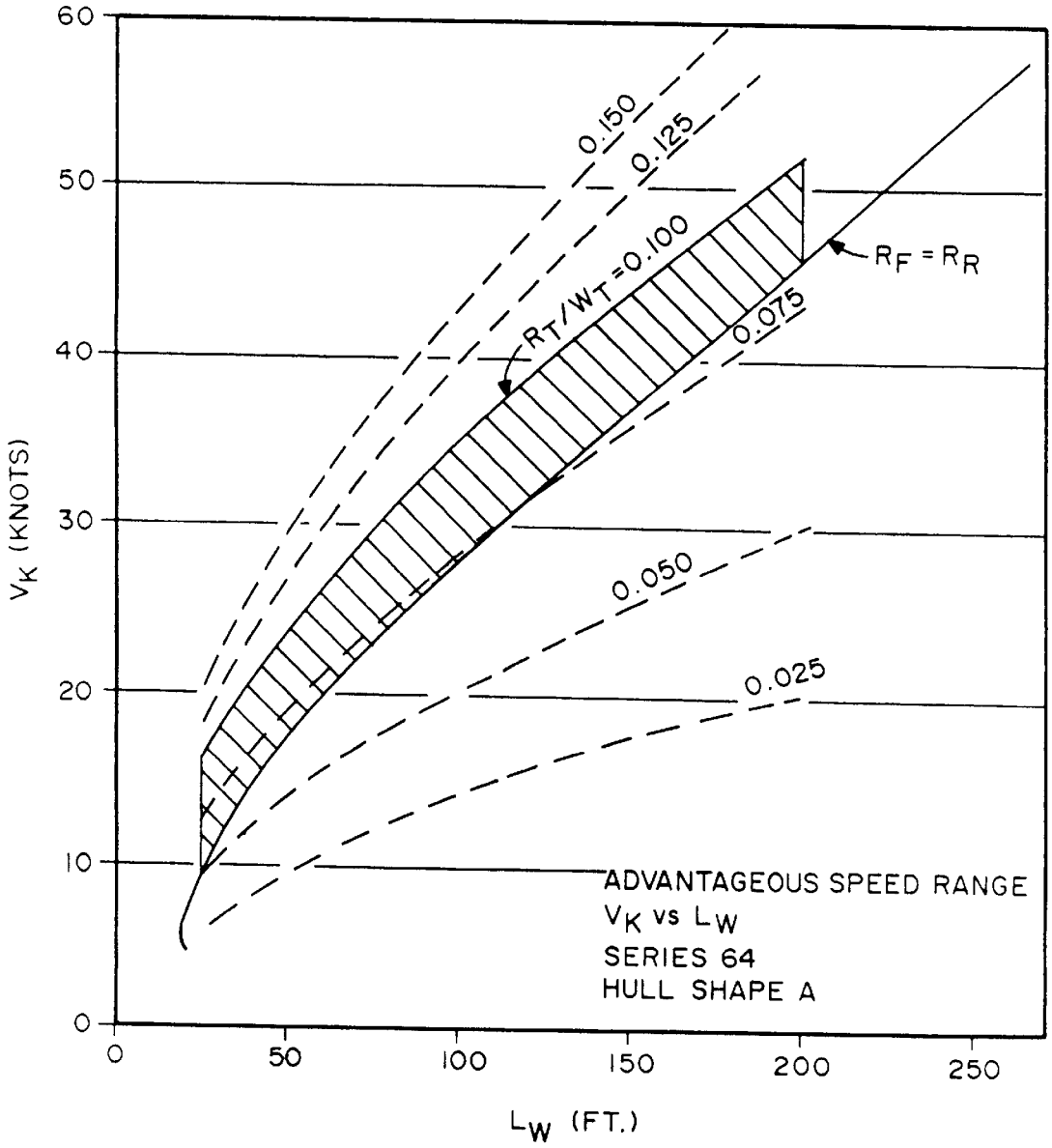
FIG. 17 shows a plot of advantageous speed range $V_K$ versus $L_W$ for Series 64 shape A for an embodiment of the present invention.

Combining the results of FIG. 6B, which shows $R_F$=$R_R$ for the hull "A" shape in a speed-length field, with the results of FIG. 10, which shows constant $R_T$ curves in a speed-length field for hull "A", in an embodiment of the present invention, a range of design speeds for hull "A" shape hull size is determined, as shown in FIG. 17. Based on the above arguments, hull "A" functions advantageously at a minimum cruising speed somewhat greater than the $R_F$=$R_R$ curve, with a maximum speed in the range of the $R_T/W_T$=0.10 curve.

An embodiment of the present invention for combining hulls will now be described, using guidelines based on the above discussion.

An embodiment of the present invention addresses sensitivity to displacement distribution. When a given displacement is distributed among two or more hulls, the displacement per hull is reduced, and the scale effect results in more wetted surface ($S_W$) and reduced water line length ($L_W$) for a given shape versus the same displacement and shape for a monohull. Stated differently, if outrigger hulls are added to a hull of given displacement, the resulting wetted surface area ($S_W$) and waterline length ($L_W$) are greater and less, respectively, than for a monohull of the same shape but scaled up to a displacement equal to the three hulls combined. According to an embodiment of the present invention, hull shape advantages achievable with multihulls must be substantial to offset the deleterious reduced scale effect of multihulls, especially when considering smaller vessels. (See Appendix 4 for more information regarding outrigger hulls.)

The following example of the practice of an embodiment of the present invention illustrates the scale effect on wetted surface to displacement ratio from a monohull to multihulls with hull shapes remaining unchanged (geometrically similar). For a trimaran with a fraction (x) of its total displacement being born by the center hull, each outrigger bears (1−x)/2. Since wetted surface is proportional to $L_W^2$ and displacement is proportional to $L_W^3$ for a given hull shape, the following equation describes the relationship among variables:

$$\frac{(S_W)_t}{(S_W)_M} = X^{\frac{2}{3}} + 2\left(\frac{1-X}{2}\right)^{\frac{2}{3}} \tag{11}$$

Where $(S_W)_t$ is the total wetted surface of a trimaran's center hull plus its two outriggers and $(S_W)_M$ is the total wetted surface of a monohull of the same displacement and shape as the trimaran.

Figure 18:
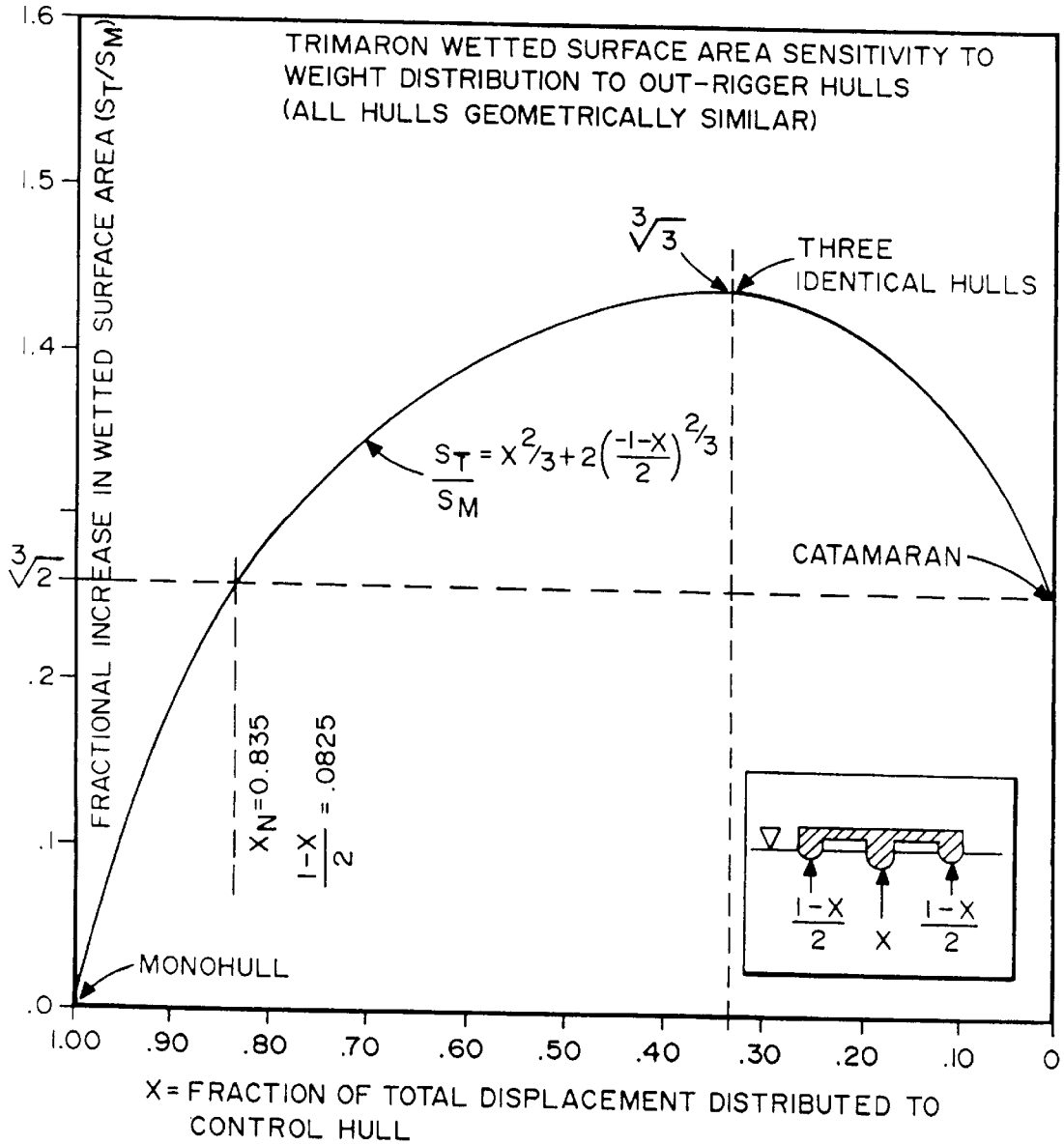
FIG. 18 is a plot of trimaran wetted surface area sensitivity to weight distribution to outrigger hulls (all hulls geometrically similar) for an embodiment of the present invention.

Equation 11, which is plotted in FIG. 18, presents the limiting cases where x=1 for a monohull, x=0 for a catamaran, and x=⅓ for a trimaran with three identical hulls. It is noteworthy that the wetted surface of the trimaran quickly approaches that of a catamaran with less than 17% of the total displacement being born by the outriggers. Such sensitivity indicates that for designing trimarans using an embodiment of the present invention, outrigger displacement is relegated only to that required for stability, with the preponderance of load carrying displacement remaining with the center hull.

The above discusses the displacement distribution effect on wetted surface areas ($S_W$) for multihulls. Next will be presented an embodiment of the present invention for addressing the effect of displacement distribution on actual total resistance ($R_T$) for multihulls and to compare the resulting resistance to those calculated for monohull vessels, as shown in Appendix 3.

Figure 19:
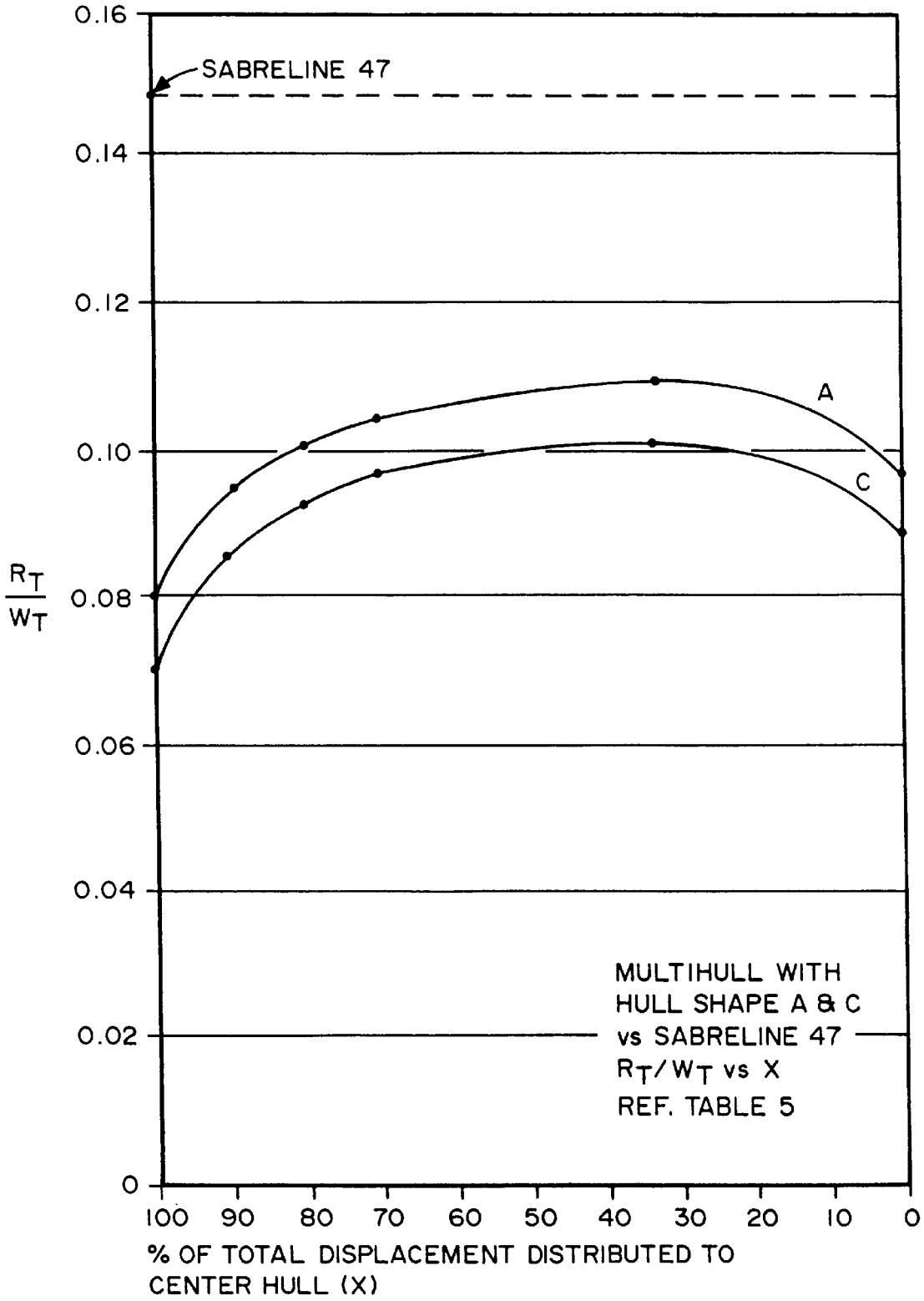
FIG. 19 presents a plot of multihull with hull shape A and C versus Sabreline 47 $R_T/W_T$ versus x, reference table 5, for an embodiment of the present invention.

Operating at the same volumetric Froude number ($F_{N\nabla}$), first a smaller vessel is considered. Hull #25 in Appendix 3 (The Sabreline 47) has both displacement and speed of interest exemplifying the smaller vessel. FIG. 19 compares multihull total resistance versus displacement distribution at comparable displacements and speeds ($F_{N\nabla}$). Table 5, shown in FIG. 20, supplements FIG. 19 with a tabulation of hull characteristic and resistance components for shape A and C multihulls at various displacement distributions, along with that of hull #25 of Appendix 3. Some observations based on FIG. 19 and Table 5, shown in FIG. 20, are provided below.

Compared to hull #24, the multihulls show significantly less resistance, primarily because of their increased slenderness $L/\nabla_{1/3}$, but by the same token, the multihulls are significantly longer (center hull). Total hull resistance for the multihull fall within the range where $R_F>R_R$ but $R_T<0.10$ at the lower displacement distribution. However, at the lower displacement distribution, the outrigger hulls provide a significant portion of the total resistance, and the $F_N$ values, $R_F/R_R$ ratios, and $R_T/W_T$ values are greater than the ranges suggested from Appendix 3 for displacement hulls. Thus, an alternative planing hull form is suggested (see Section B). The outrigger hulls offer greater than 23% of the total resistance at only 10% of the total displacement. Finally, as concluded earlier, the slenderness advantage of the shape of hull "C" vs. hull "A" is diminished considering the still greater hull lengths.

Figure 21:
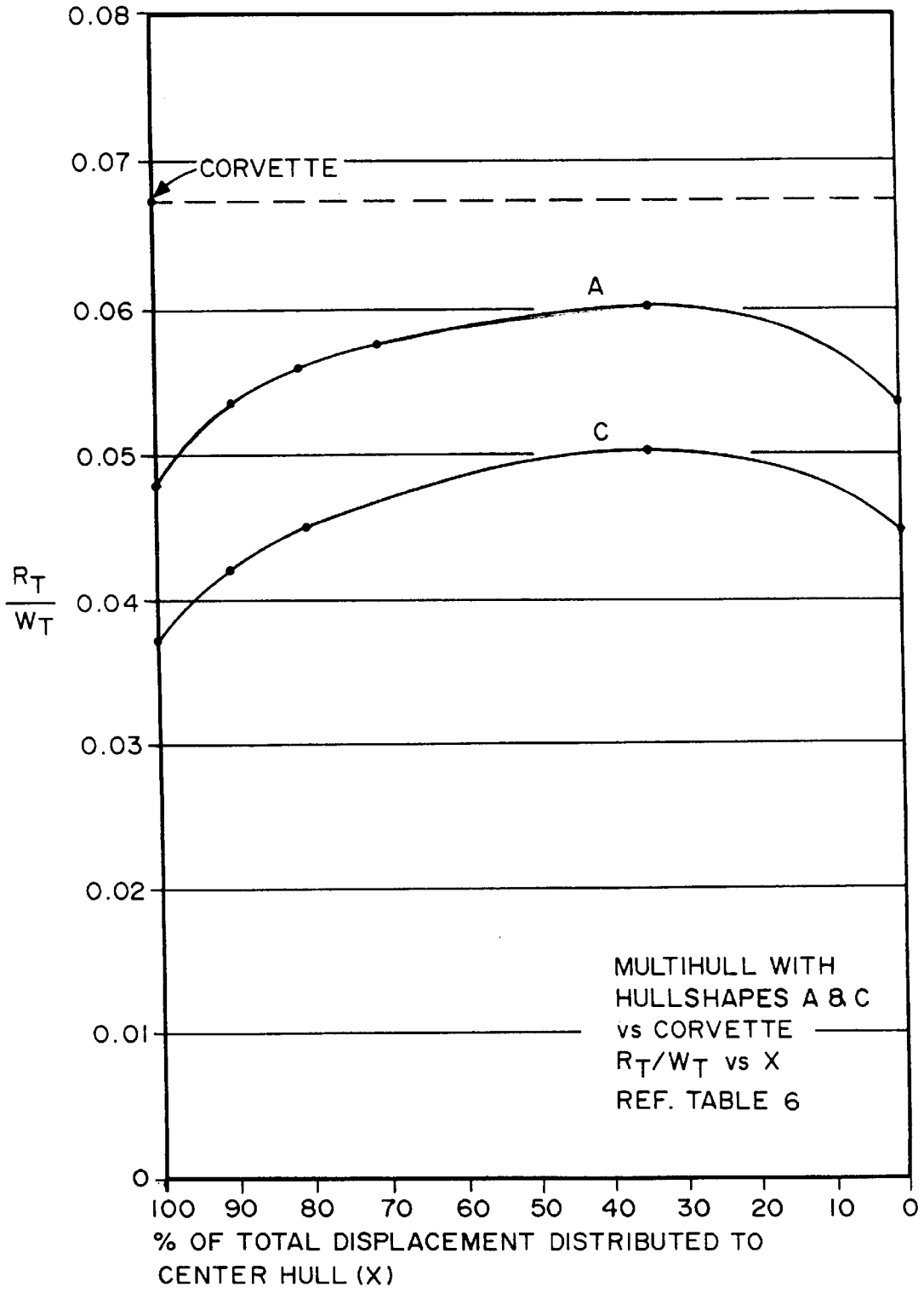
FIG. 21 shows a plot of multihull with hull shapes A and C versus hull #5, Appendix 4 (corvette) for $R_T/W_T$ versus x, reference table 6 (FIG. 22), for an embodiment of the present invention.

Next a "larger" vessel is considered. Hull #5 in Appendix 3 (The Corvette) has both the displacement and speed of interest representative of a "larger vessel". FIG. 21 compares the shape of hull "A" and "C" multihulls with monohull #5, illustrating multihull total resistance vs. displacement distribution at equal displacements and speeds (equal values for $F_{N\nabla}$). Table 6, shown in FIG. 22, supplementary to FIG. 21, tabulates hull characteristics and resistance components for multihull shapes at various displacement distributions along with that of hull #5 in Appendix 3. Some observations based on FIG. 21 and Table 6, shown in FIG. 22, are provided below.

Compared to hull #5 the multihulls show not quite the fractional decrease in resistance as was shown earlier for the "smaller" hull comparisons but the decrease is still significant. Conversely, the increase in multihull lengths vs. hull #5 is not as significant as was the case for the "smaller" hulls. Again the primary association is the slenderness $L/\nabla^{1/3}$, where the slenderness of hull #5 is closer to that of the multihulls than was the case for the "smaller" vessel comparisons.

The larger vessels are shifted to a lower range or Froude Number ($F_N$) at speeds of interest. A consequence is that the residuary resistance ($R_R$) becomes the greater for the center hulls and the residuary-friction components become more balanced for the outriggers. Thus, for the "larger" multihulls, increased center hull slenderness for further residuary resistance reduction is appropriate. Moreover the balanced residuary friction components of the outriggers and their relatively low specific resistance in ranges $R_F>R_R$ and $R_T/W_T<0.1$ indicate the displacement type hull to be appropriate as outriggers.

Factors relating to adjustable planing outrigger hulls for an embodiment of the present invention will now be described.

When discussing the "smaller" multihulls above, it was suggested that planing outrigger hulls might be appropriate when the displacement distribution to outrigger hulls was in the 10–20% range. The high value of $F_N$, the large fraction of friction resistance $R_F$, the high total specific resistant ($R_T/W_T$) for the displacement outrigger hulls, and Appendix 3 showing such conditions being out of range for displacement hulls, were the noted indications (see Table 5, shown in FIG. 20). However this was not the case for "larger" multihulls at speeds of interest. (See Table 6, shown in FIG. 22). Aspects of planing outrigger hulls with a displacement center hull for use with an embodiment of the present invention are discussed below.

As a free planing hull accelerates, the center of gravity rises, and the trim angle transitions from a maximum before coming up on a plane to a minimum angle at planing speed. This is a result of the planing hull being hydrostatically supported while at rest while the hull is primarily supported by hydrodynamic lift at speed. In an embodiment of the present invention, if the planing outrigger hulls were not free but rigidly attached to a displacement center hull, the outrigger hulls would retain substantial hydrostatic lift while also developing substantial hydrodynamic lift at speed, resulting in the outrigger hulls trying to lift out the center hull. Therefore, both vertical and rotational degrees of freedom should be available to planing outriggers hulls, relative to the displacement center hull. Several different linkage geometries satisfy this requirement. In a simple embodiment, the outriggers are hinged to the center hull beyond their outrigger bows, with the outrigger hull sterns being raised or lowered hydraulically or otherwise.

In the context of "smaller" trimarans, adjustable planing outrigger hulls (APOHs) are lowered to provide hydrostatic stability when the trimaran is stopped or moving slowly, and they may be raised to provide hydrodynamic stability at speed. At speed, the APOH acts as trim, providing little net lift other than that required for overall trim and lateral stability for the trimaran. At such a trimmed state, the trimaran performs approaching zero displacement distribution to the outriggers and essentially functions as a very slender monohull (see FIG. 19). Operating independently one from the other, in another embodiment, APOHs are used for lateral trim to counter imbalance in cross loading and with the appropriate control mechanism, APOHs may also function as stabilizers as needed in a cross-sea.

Further aspects of the ellipsoid hull shape of an embodiment of the present invention will now be described.

In the discussion above, the Series 64 hull data was used in a general sense to establish an interrelationship of hull shape, hull size, and hull speed for slender displacement vessels. The ellipsoidal hull shape (the prolate spheroid in particular) was used to initiate an analytical basis for an embodiment of the present invention, which empirically arrives at slender displacement hull shape parameters. The discussion below combines the analytical basis and the empirically arrived at hull shape parameters, such that the analytical basis may be used to extrapolate/interpolate a clearer definition of hull shape parameters, sizes, and speeds for trimaran center hulls and the outrigger hulls for an embodiment of the present invention.

Various dissimilarities and a discussion of Series 64 versus the prolate spheroid for an embodiment of the present invention will now be presented.

The Series 64 data provided in *Principles of Naval Architecture Second Edition* is only for hulls with B/T=3, while the prolate spheroid has a value of B/T=2. Ellipsoidal hulls in general could of course have values of B/T>2. The approach for trimaran hulls having B/T=2 was based on minimum wetted surface and the fact that multihulls did not need single hull lateral stability.

The prolate spheroid discussed so far is longitudinally symmetrical, while the Series 64 hulls are not. Moreover, the Series 64 hulls have transom sterns. Longitudinally non-symmetrical ellipsoidal hulls and ellipsoidal hulls with transom sterns are discussed below.

A longitudinally non-symmetrical prolate spheroid (LNSPS) is shown in FIG. 23. The LNSPS includes two connected semi-ellipsoids rotated about a common axis and having the same major radius of rotation, but different major dimensions along the axis of rotation. FIG. 23 illustrates that the LNSPS has the same displacement (▽) and "water plane" area ($A_{WP}$) as a symmetrical prolate spheroid of the same major radius of revolution and the same overall length along the axis of rotation. Therefore, the hull form coefficients $C_{WP}$, $C_B$, $C_M$, and $C_P$ are the same also.

There is some minor change in the LNSPS surface area versus that of a symmetrical prolate spheroid of the same volume. Referring again to FIG. 23 the surface area for a symmetrical prolate spheroid is give by the equation:

$$S_{III} = 2\pi \cdot b^2 + 2\pi \cdot b\left(\frac{L}{2}\right)\frac{\mathrm{SIN}(\epsilon)}{\epsilon} \tag{12}$$

where:

$$\epsilon = \sqrt{1-\left(\frac{2b}{L}\right)^2}$$

The surface area for an LNSPS can therefore be stated as:

$$S_I + S_{II} = S_{I,II} = \frac{1}{2}\left[2\pi \cdot b^2 + 2\pi(fL)b\frac{\mathrm{SIN}^{-1}(\epsilon_1)}{\epsilon_1}\right] + \frac{1}{2}\left[2\pi \cdot b^2 + 2\pi(1-f)L\frac{b \cdot \mathrm{SIN}^{-1}\epsilon_2)}{\epsilon_2}\right] \tag{13}$$

where:

$$\epsilon_1 = \sqrt{1-\left(\frac{b}{fL}\right)^2}\ ; \quad \epsilon_2 = \sqrt{1-\left(\frac{b}{(1-f)L}\right)^2}$$

From this, the surface area to volume ratio can be derived:

$$\frac{S_{I,II}L}{\nabla} = 3 + \frac{3L}{2b}\left[f\frac{\mathrm{SIN}^{-1}(\epsilon_1)}{\epsilon_1} + (1-f)\frac{\mathrm{SIN}^{-1}(\epsilon_2)}{\epsilon_2}\right] \tag{14}$$

In the extreme case for an LNSPS, one end becomes hemispherical (a first end, "I") and f=b/L. (If f<b/L the end I becomes an oblate spheroid and equation 12 no longer holds.) In this case, Equation 14 reduces to:

$$S_{I,II} = 4.5 + \frac{3}{2}\left(\frac{L}{b}-1\right)\frac{\mathrm{SIN}^{-1}(\epsilon_2)}{\epsilon_2} \tag{15}$$

where, $$\epsilon_2 = \sqrt{1-\left(\frac{L}{b}-1\right)^{-2}}$$

Referring back to Equation 14, by either finding the first derivative with respect to f, setting the result equal to zero, and solving for f, or by simply plotting Equation 14 vs. f for various values of L/b, it can be seen that f=0.5 gives the minimum value for $S_{I,II}L/\nabla$ (i.e., the symmetrical prolate spheroid is the minimal case for surface to volume ratio and the case f=b/L is the maximum case for surface to volume ratio for the LNSPS). The maximum difference ratios in surface to volume ratio for various values of Lib are given below.

For L/b=10, (L/B=5):

$$\frac{\left(\frac{S_{I,II}}{\nabla}\right)_{f=\frac{b}{L}}}{\left(\frac{S_{I,II}}{\nabla}\right)_{f=0.5}} = \frac{24.3254}{23.9652} = 1.0150$$

For L/b=20, (L/B=10)

$$\frac{\left(\frac{S_{I,II}}{\nabla}\right)_{f=\frac{b}{L}}}{\left(\frac{S_{I,II}}{\nabla}\right)_{f=0.5}} = \frac{47.8271}{47.3411} = 1.0103$$

For L/b=40 (L/B=20)

$$\frac{\left(\frac{S_{I,II}}{\nabla}\right)_{f=\frac{b}{L}}}{\left(\frac{S_{I,II}}{\nabla}\right)_{f=0.5}} = \frac{94.9212}{94.3608} = 1.0059$$

Thus, in the hull shape vernacular, slender ellipsoidal hulls may be designed substantially longitudinally non-symmetrically with very little change in wetted surface to displacement ratio compared to that of the symmetrical prolate spheroid. This is a significant point when considering hull shape variables, such as entrance length to overall length ($L_E/L_W$) and the LCB (see FIG. 23A), both of which give rise to the use of longitudinal non-symmetrical hulls. Both ($L_E/L_W$) and LCB can vary significantly with essentially no change in wetted surface using the LNSPS basic hull shape.

It appears that wetted transom sterns for displacement hulls have evolved along with higher speed to length ratios. The exact mechanistic reasons for transom sterns are not clearly stated in the references, but probably they are associated with diminishing normal pressure recovery in the stern area at higher speed to length ratios and when reduced wetted surface area is needed. The application of transom sterns to basic ellipsoidal hull shapes is examined below with regard to an embodiment of the present invention for determining how various hull shape parameters are impacted, and to provide a basis for comparison with empirically arrived at transom stern slender displacement hull shapes, such as Series 64.

An LNSPS hull water plane is shown in FIG. 24 with a transom stern such that the overall wetted length is $L_W=(x_1+a_2)$ with beam B and draft T=B/2. The calculations for $\nabla$ and LCB are shown also. Inspection of the formula in FIG. 24 reveals that when $x_1=a_1$, the case reduces back to the LNSPS without a transom stern, with the hull form coefficients $C_{WP}$, $C_P$, and $C_B$ being invariant with longitudinal non-symmetry perse. Such is not the case when $x_1$ is less than $a_1$.

Consider first the block coefficient $C_B=\nabla/LBT$. Inspection indicates that when x,=0 or $x_1$=a the value of $C_B$ is the same: $C_B=\pi/6$. But $C_B$ must have some greater value at intermediate values of $x_1$. From equation 17 in FIG. 24, an expression for the block coefficient can be written:

$$C_B = \frac{\pi}{4}\left[\left(a_1\left(\frac{x_1}{a_1} - \frac{x_1^2}{3a_1^3}\right) + \frac{2a_2}{3}\right)\right](x_1 + a_2) - 1 \tag{20}$$

Now if between $x_1=0$ and $x_1=a_1$, a greater value for $C_B$ exists, then there exists a maximum such that at some value $0 \leqq x_1 \geqq a_1$ $$\frac{dC_B}{dx_1} = 0$$

Differentiating the expression for $C_B$ with respect to $x_1$, and setting the result equal to 0 yields the expression.

$$2x_1^3+3a_2x_1^2-a_1^2a_2=0 \tag{21}$$

This equation indicates that for any combination of $a_1$ and $a_2$, there exists a value for $x_1$ in the range $0 \leqq x_1 \geqq a_1$ where $C_B$ is maximum. Consider the case of the ellipsoid hull that is longitudinally symmetrical except for the transom stern ($a_1=a_2=a$). The maximum equation 21 reduces to the following:

$$2x_1^3+3ax_1^2-a^3=0$$

Iterative testing of values for $x_1$ reveals that the value $x_1=a_1/2$ satisfies the equation. The corresponding maximum value for the block coefficient is as follows:

$$C_B = \frac{3\pi}{16}$$

(vs. $C_B=\pi/6$ with no transom)

The corresponding maximum value for the prismatic coefficient is as follows:

$$C_P = \frac{C_B}{C_M} = \frac{3\pi}{16} \Big/ \frac{\pi}{4} = \frac{3}{4}$$

($C_P=2/3$ with no transom)

Consider next the LNSPS where $a_2=2a_1$, with a transom stern at $x_1$, and with $0 \leqq x_1 \leqq a_1$. The maxima equation 21 for $C_B$ becomes:

$$2x_1^3+3a_2X_1^2-a_1^2a_2=2x_1^3+3(2a_1x_1^2)-a_1^2(2a_1)=0 \text{ or } x_1^3+3a_1x_1^2-2a_1^3=0$$

Again iterative testing of values reveals the value $x_1=0.532089$ a, satisfies the equation. This is the value of $x_1$ for which $C_B$ and $C_P$ are maximum (the location of the transom stern for the LNSPS $a_2=2a_1$ that provides the maximum value for $C_B$ and $C_P$). The corresponding maximum value for the block coefficient is $$C_B=0.56304$$

And the corresponding maximum value for the prismatic coefficient is as follows:

$$C_P=0.7168814$$

Note that the maximum values for $C_B$ and $C_P$ for the LNSPS with $a_2>a_1$ are less than the corresponding maximum values of $C_B$ and $C_P$ for the symmetrical prolate spheroid hull (symmetrical except for the transom stern). Thus, all values for $C_B$ and $C_P$ for the LNSPS shaped hull with or without transom stern lie within the ranges between a symmetrical prolate spheroid without a transom stern and a symmetrical prolate spheroid with a transom stern at x=a/2 (see FIG. 24). That is:

$$\pi/6 \leqq C_B \leqq 3\pi/16 \text{ For } a_2 \geqq a_1 \text{ and a transom stern}$$

$$2/3 \leqq C_P \leqq 3/4 \text{ For } a_2 \geqq a_1 \text{ and a transom stern}$$

Figure 25:
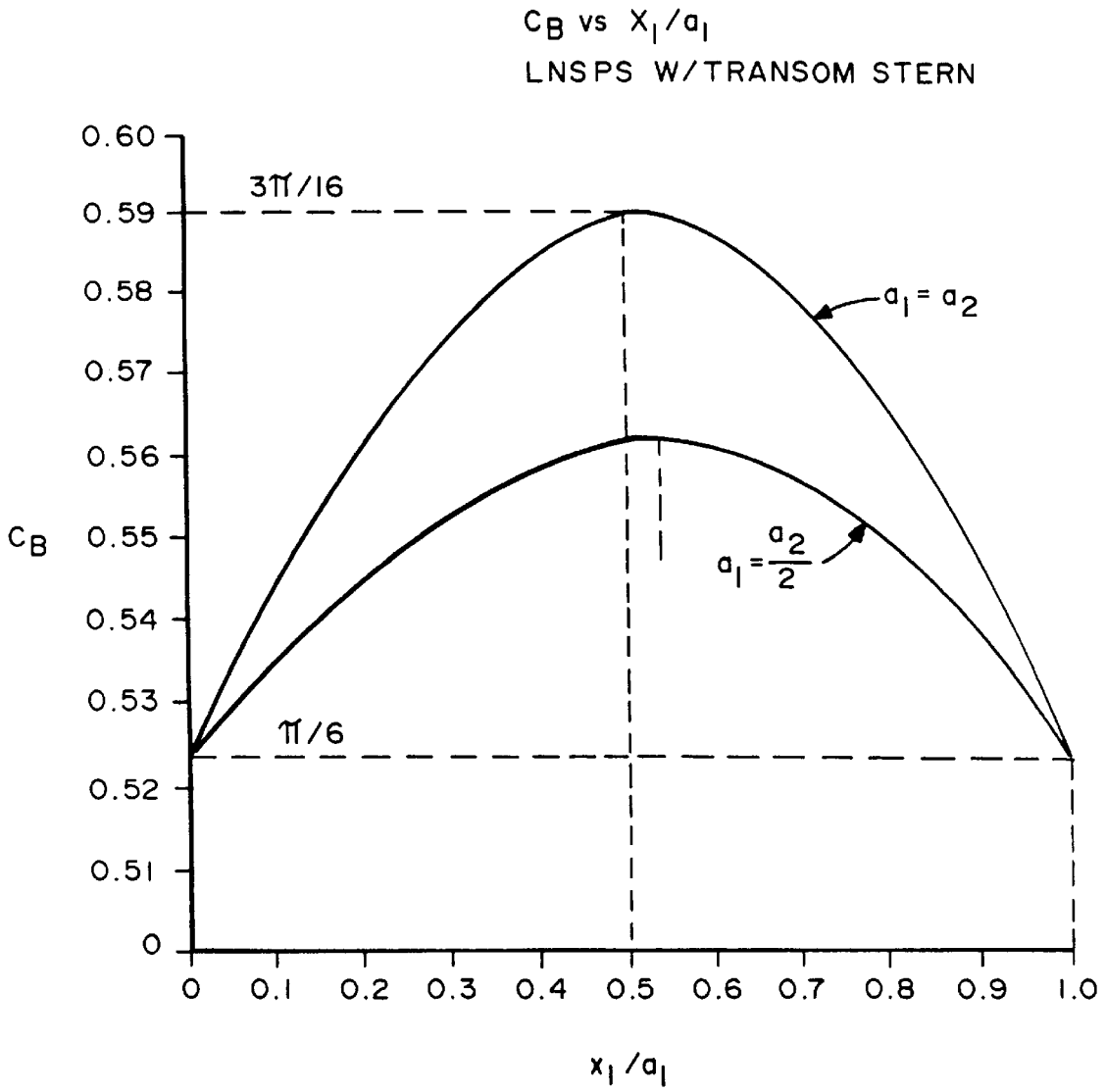
FIG. 25 is a plot of $C_B$ versus $x_1/a_1$ for LNSPS with a transom stern for an embodiment of the present invention.
Figure 26:
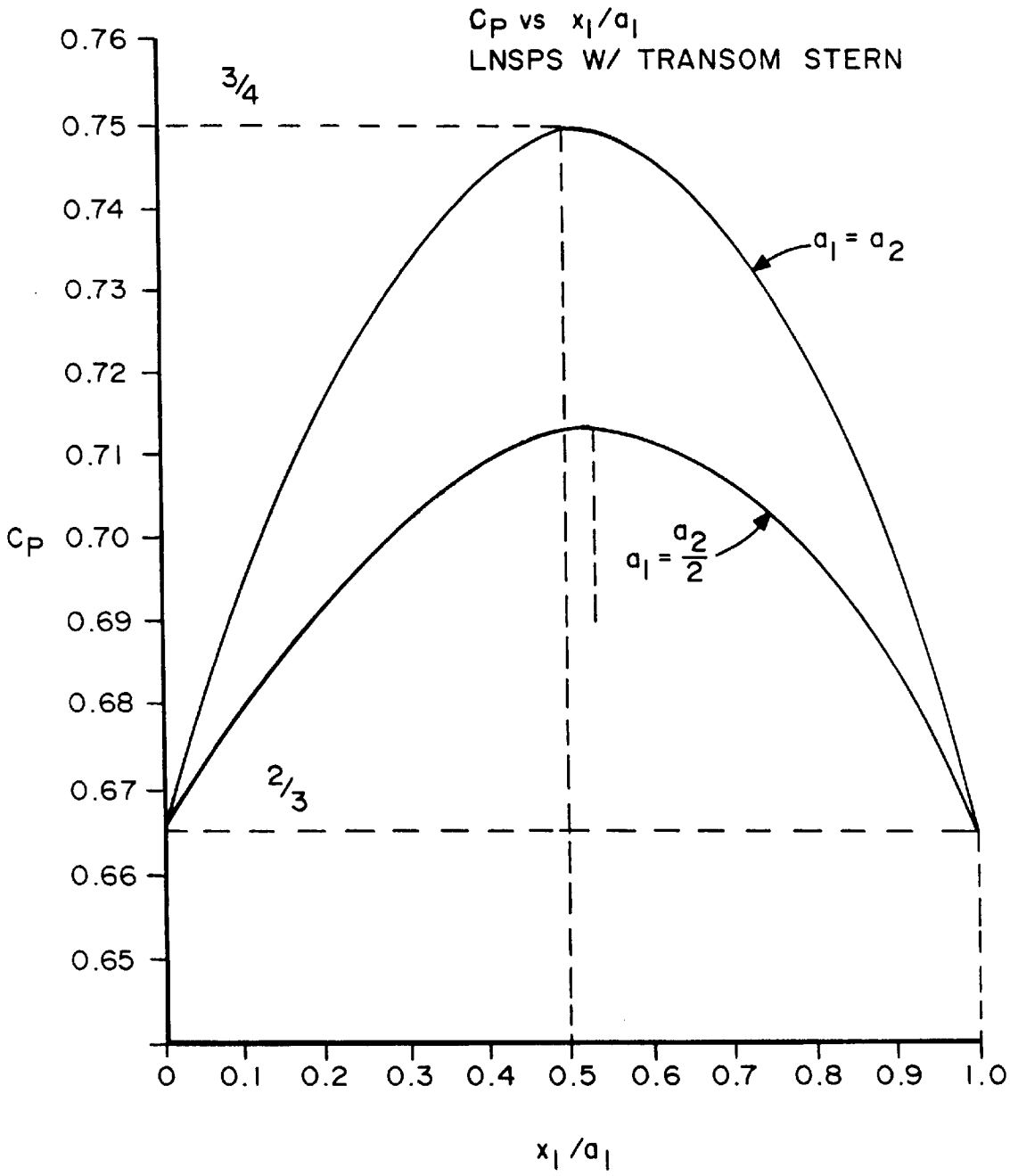
FIG. 26 presents a plot of $C_P$ versus $x_1/a_1$ for LNSPS with a transom stern for an embodiment of the present invention.

These limits are illustrated in FIGS. 25 and 26.

The water plane coefficient $C_{WP}$ will next be determined for the transom stern prolate spheroid by referring back to FIG. 24:

$$C_{WP} = \frac{A_{WP}}{LB} = \frac{A_{WP}}{(x_1 + a_2)2b} = \frac{1}{2(x_1 + a_2)}\left[x_1\sqrt{1-\left(\frac{x_1}{a_1}\right)^2} + a_1\sin^{-1}\left(\frac{x_1}{a_1}\right) + \frac{\pi \cdot a_2}{2}\right] \tag{22}$$

$$C_{WP} = \frac{a_2}{2(x_1 + a_2)}\left[\frac{x_1}{a_1}\sqrt{1-\left(\frac{x_1}{a_1}\right)^2} + \sin^{-1}\left(\frac{x_1}{a_1}\right) + \frac{\pi \cdot a_2}{2a_1}\right]$$

As previously reasoned for $C_P$ and $C_B$, if between $x_1=0$ and $x_1=a_1$ a greater value for $C_{WP}$ exists, then there exists a maxima such that at some value $0 \leqq x_1 \leqq a_1$, the following is true:

$$\frac{dC_{WP}}{dx_1} = 0$$

Differentiating equation 22 with respect to $x_1$ and setting the result equal to 0 yields the expression $$\left(\frac{2x_1}{a_1} + \frac{4a_2}{a_1}\right)\sqrt{a_1^2 + x_1^2} - 2a_1\sin^{-1}\left(\frac{x_1}{a_1}\right) + \pi \cdot a_2 = 0 \tag{23}$$

Equation (23) indicates that for any combination of $a_1$ and $a_2$ there exists a value for $x_1$ between $0 \leqq x_1 \leqq a_1$, where $C_B$ is maximum.

Consider first the case where the ellipsoid hull is symmetrical except for the transom stern ($a_1=a_2$). Equation 23 reduces to:

$$\left(2 + \frac{x_1}{a}\right)\sqrt{1-\left(\frac{x_1}{a}\right)^2} - \sin^{-1}\left(\frac{x_1}{a}\right) - \frac{\pi}{2} = 0$$

Iterative testing reveals the value of x=0.53827 to satisfy the equation. Substitution into Equation 22 gives:

$$C_{WP}=0.8427710$$

Note that the maxima for $C_{WP}$ is at a different value for $x_1$ than the maxima for $C_P$ and $C_B$.

Figure 27:
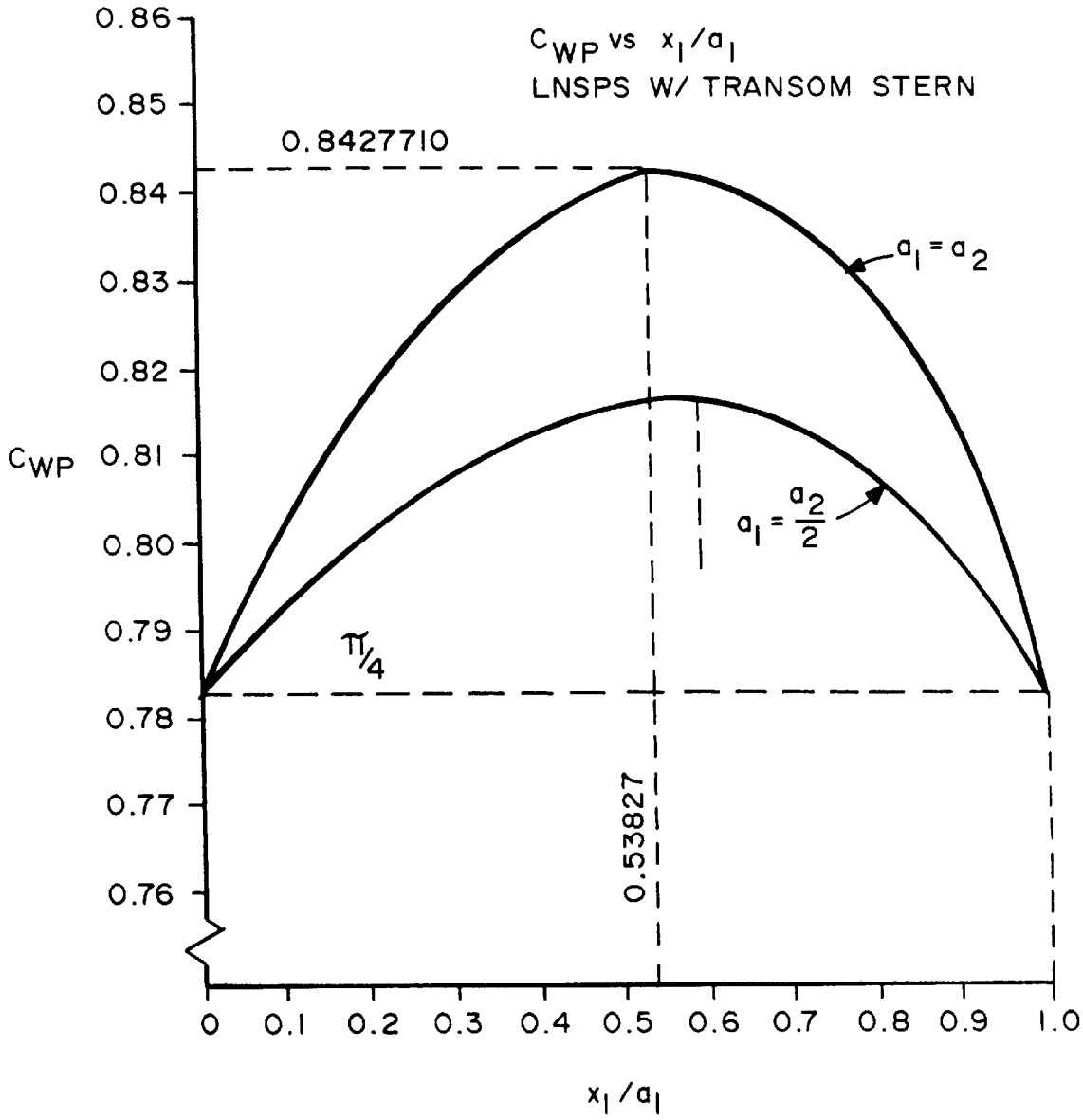
FIG. 27 contains a plot of $C_{WP}$ versus $x_1/a_1$ for LNSPS with a transom stern for an embodiment of the present invention.

Plots of $C_{wp}$ vs. $x_1$ for the cases $a_1=a_2$ and $a_2=2a_1$ are shown in FIG. 27. As similarly shown for $C_P$ and $C_B$ above, the maximum value for $C_{WP}$ for the LNSPS with $a_2>a_1$ is less than the maximum value $C_{WP}$ for the symmetrical prolate spheroid (symmetrical except for the transom stern), indicating that all values of $C_{WP}$ for the LNSPS shaped hull with or without transom sterns lie within the ranges between a symmetrical prolate spheroid with a transom stern at x/a=0.53877 and a symmetrical prolate spheroid without a transom stern, as follows:

$$\pi/4 \leqq C_{WP} \leqq 0.8427710 \text{ for } a_2 \geqq a_1 \text{ and a transom stern}$$

Determining the wetted surface $S_W$ for the transom stern involves the transom stern being below the water line, but flow separation results in the submerged section being "unwetted". Therefore, the transom stern surface area is not included in the determination of $S_W$.

Figure 28:
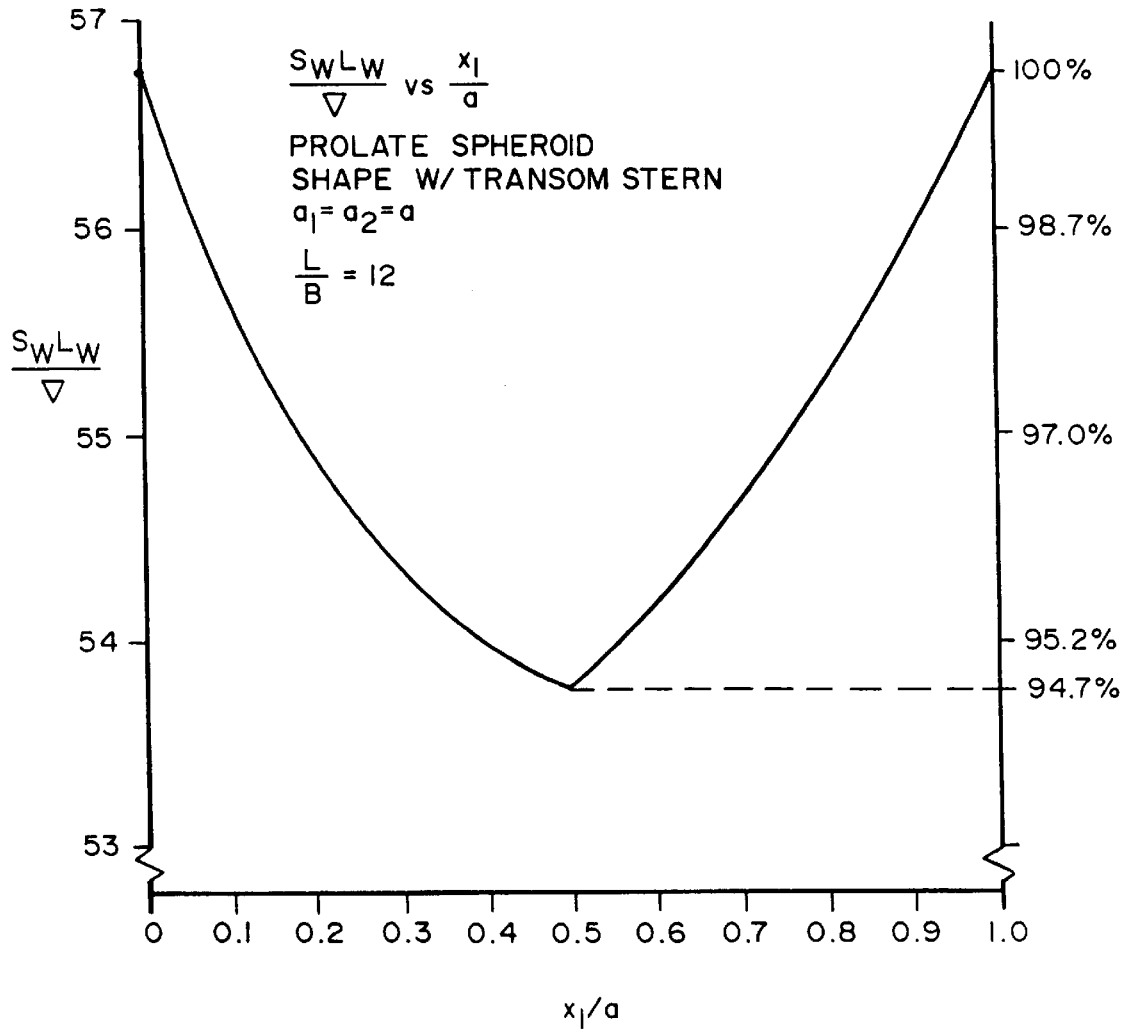
FIG. 28 shows a plot of $S_W L_W/\nabla$ versus $x_1/a$ for prolate spheroid shape with transom stern, $a_1$=$a_2$=a, and L/B=12 for an embodiment of the present invention.
Figure 28A:
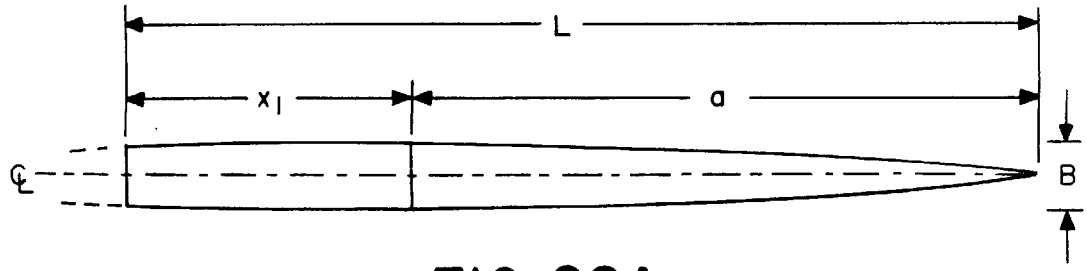
FIG. 28A shows the corresponding figure for the plot shown in FIG. 28 for an embodiment of the present invention.

The calculus for determining $S_W$ for the LNSPS with a transom stern is shown in FIG. 28. FIG. 28A presents the corresponding hull shape. It should be noted that, unlike the calculus for calculating $\underline{\nabla}$ and $\underline{A}_{wp}$, where the differential element dx alone was involved, the differential surface area element is given as:

$$dS_W=2\pi.y_1 ds \text{ where}$$

$$ds = \sqrt{1+\left(\frac{dy_1}{dx}\right)^2}\,dx$$

The result, given in terms of surface area to volume and being dependent on shape only and not scale is as follows:

$$\frac{S_W L}{\nabla} = \frac{(x_1 + a_2)}{b}\left[\frac{2\int_0^{x_1}\left[1-\left(1-\frac{b^2}{a_1^2}\right)\left(\frac{x}{a_1}\right)^2\right]^{\frac{1}{2}}dx + \frac{a_2\sin^{-1}\epsilon}{\epsilon} + b}{x_1 - \frac{x_1^3}{3a_1^2} + \frac{2a_2}{3}}\right] \tag{24}$$

where:

$$\epsilon = \sqrt{1-\left(\frac{b}{a_2}\right)^2}$$

The integral in equation 24, which is an "elliptical integral", is not solvable in closed form and must be solved numerically. So, conclusions with respect to the transom stern effect on the surface area to volume ratio have to be reached indirectly.

Since the wetted surface area to volume ratio, $S_W L/\nabla$ is a function of the length to beam ratio L/B, the effect of the transom stern on $S_W L/\nabla$ should be compared with an LNSPS having the same value for L/B. FIG. 28 illustrates the transom stern effect for a particular case, where L/B=12 and $a_1=a_2$, which is a symmetrical prolate spheroid except for the transom stern. The surface area to volume ratio in this case is a minimum at approximately, $x_1=0.5a$. The minimal location seems to be about the same for any value or L/B calculated.

It was determined earlier that, according to an embodiment of the present invention, at higher values for $F_N$ slenderness should be approached cautiously in reducing residuary resistance since the corresponding increase in surface area and friction resistance quickly diminish the residuary advantage of slenderness. It was also concluded that the prolate spheroid as a basic streamlined geometry for hull shape offers the minimum surface area to displacement approach to slenderness and has shape characteristics similar to those arrived at empirically for fast displacement hulls. In addition, longitudinal non-symmetrical prolate spheroid shapes with and without transom sterns have been evaluated in order to further simulate high speed displacement hull characteristics that have been arrived at empirically and to determine probable analytical extrapolations using an embodiment of the present invention.

FIG. 29 (hull shape PR) is a summary of the analytical findings of the effect of non-symmetry perse on certain hull form coefficients/characteristics for the prolate spheroid. $C_M$ of course does not change since the sectional area remains circular. Neither do the hull form coefficients $C_P$, $C_B$, and $C_{wp}$ change. There is a slight change in $S_W L/\nabla$ with non-symmetry. However, the change is less than 1% over the more probable ranges of L/B, and therefore, in an embodiment of the present invention, $S_W L/\nabla$ can also be considered practically invariant with non-symmetry. Such a hull shape allows design flexibility in L/B, LCB, and $L_E/L$, while keeping the aforementioned hull form coefficients constant and maintaining minimal wetted surface area to displacement.

The lack of a transom stern might be reasoned based on performance needs ranging into lower values of $F_N$, as well as higher values. (Note how Hull Shape PR resembles that of a modern attack submarine but with the blunter end forward instead of aft.) FIG. 30 (hull shape PR-T) illustrates that $C_P$, $C_B$, $C_{WP}$, and $S_WL/\nabla$ all vary with transom stern location for a prolate spheroid shaped hull. Of particular note is the facts that $C_P$, $C_B$, and $C_{wp}$ approach values greater than that without a transom stern and that $S_WL/\nabla$ approaches a value even less than the minimum that can be reached for a prolate spheroid without a transom stern, the prolate spheroid being cited earlier as the streamlined body geometry with minimum total surface area to volume ratio. Additionally, it is noted that the maximum values for the hull form coefficients $C_P$, $C_B$, and $C_{wp}$ and the minimum value for the surface area to displacement ratio $S_WL/\nabla$, occur at essentially the same relative location for the transom stern and when $a_2=a_1$ (i.e., when the ellipsoidal shape is symmetrical only with the exception of the transom stern). (See FIGS. 25–30.)

FIG. 31 (hull shape PR-TM) illustrates the resulting shape when $C_P$, $C_B$, and $C_{wp}$ are maximized and $S_WL/\nabla$ is minimized, with transom stern location being the independent variable and the prolate spheroid being symmetrical except for the transom stern. (Recall that when $a_2>a_1$ the above maximum and minimum values are intermediate to the case $a_1=a_2=a$, as illustrated in FIGS. 25 and 26.

The hull shape PR-TM illustrated in FIG. 31 incorporates the following:

$$L/B=3/4\,a/b$$

This shape represents the minimum surface area to displacement ($S_WL/\nabla$) achievable for the prolate spheroid hull shape with a transom stern and a given slenderness, L/B. It also represents the maximum achievable value for $C_P$ and $C_M$, and the near maximum value of $C_{wp}$ for a prolate spheroid with a transom stern and for any slenderness L/B. In addition, the ratios LCB/L and $L_E/L$ are fixed and independent of slenderness L/B. Finally, the transom stern section area to maximum hull section area ratio ($A_o/A_M$) is fixed and independent of slenderness L/B.

From the empirically arrived at data in references, it appears that the hull shape PR-TM and its corresponding hull form coefficients and characteristics are approached for displacement hulls operating at higher $F_N$ values. An embodiment of the present invention incorporates the factor of hull shape PR-TM representing the basic limiting case for high $F_N$ value displacement hull shapes perse. However, this does not exclude further hull shape refinements, such as entry angle, shape modification for improved trim angle at speed, and characteristics lending to hydrodynamic lift and reducing wetted surface area at speed. As stated above with regard to ellipsoidal shapes in general, the hull shape PR-TM provides a still further refined point of departure for hulls of minimum wetted surface area to displacement ratios. As the further refinements are assigned to a particular hull shape the deviation from minimum surface area according to an embodiment of the present invention is assessed by comparing the deviation to the hull shape PR-TM having the same displacement and slenderness (L/B).

Figure 32:
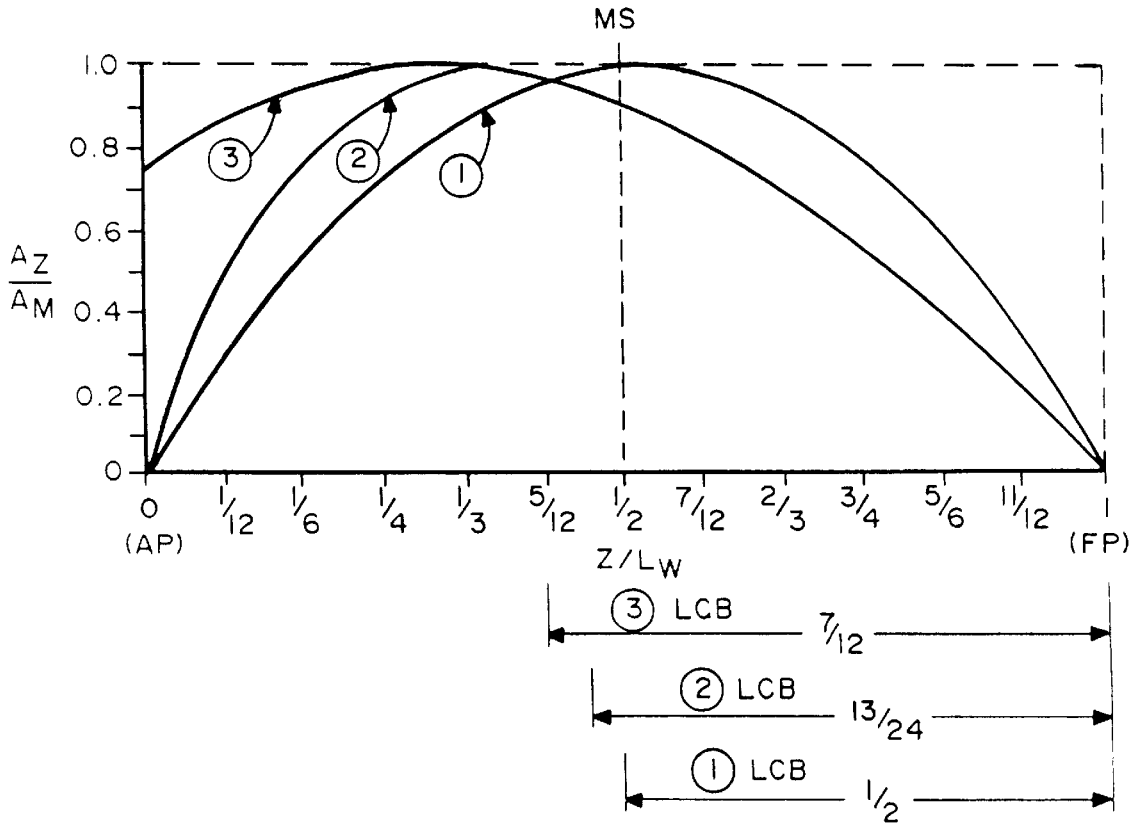
FIG. 32 is a plot and table for sectional area curves for an embodiment of the present invention.

Sectional area curves for hull shapes PR and PR-TM are shown in FIG. 32. Curve 1 represents shape PR where $a_1=a_2$, corresponding to a longitudinally symmetrical prolate spheroid. The sectional area curve is a fundamental drawing in the design of a vessel, particularly in relation to hull resistance. The sectional area curve represents the longitudinal distribution of displacement along the wetted hull length. If the ordinate and abscissa of the sectional area curve are 1) the station sectional area divided by the maximum sectional area and 2) the station location divided by the wetted length respectively, the curve is dimensionless, and the area under the curve is equal to the prismatic coefficient $C_P$. The sectional area curve also reflects the hull shapes' entry, forebody, run, and afterbody; and the longitudinal centroid of the area under the curve represents the hull LCB (see *Principles of Naval Architecture Second Edition,* Vol. I, p. 6). Curve 2 represents shape PR, where $a_1=a_2/2$, which is an LNSPS with a forebody or entry identical in shape to PR-TM, which is represented by Curve 3. The curves of FIG. 32 serve as a reference for streamlined displacement hulls with minimum wetted surface to displacement ratio.

Figure 33:
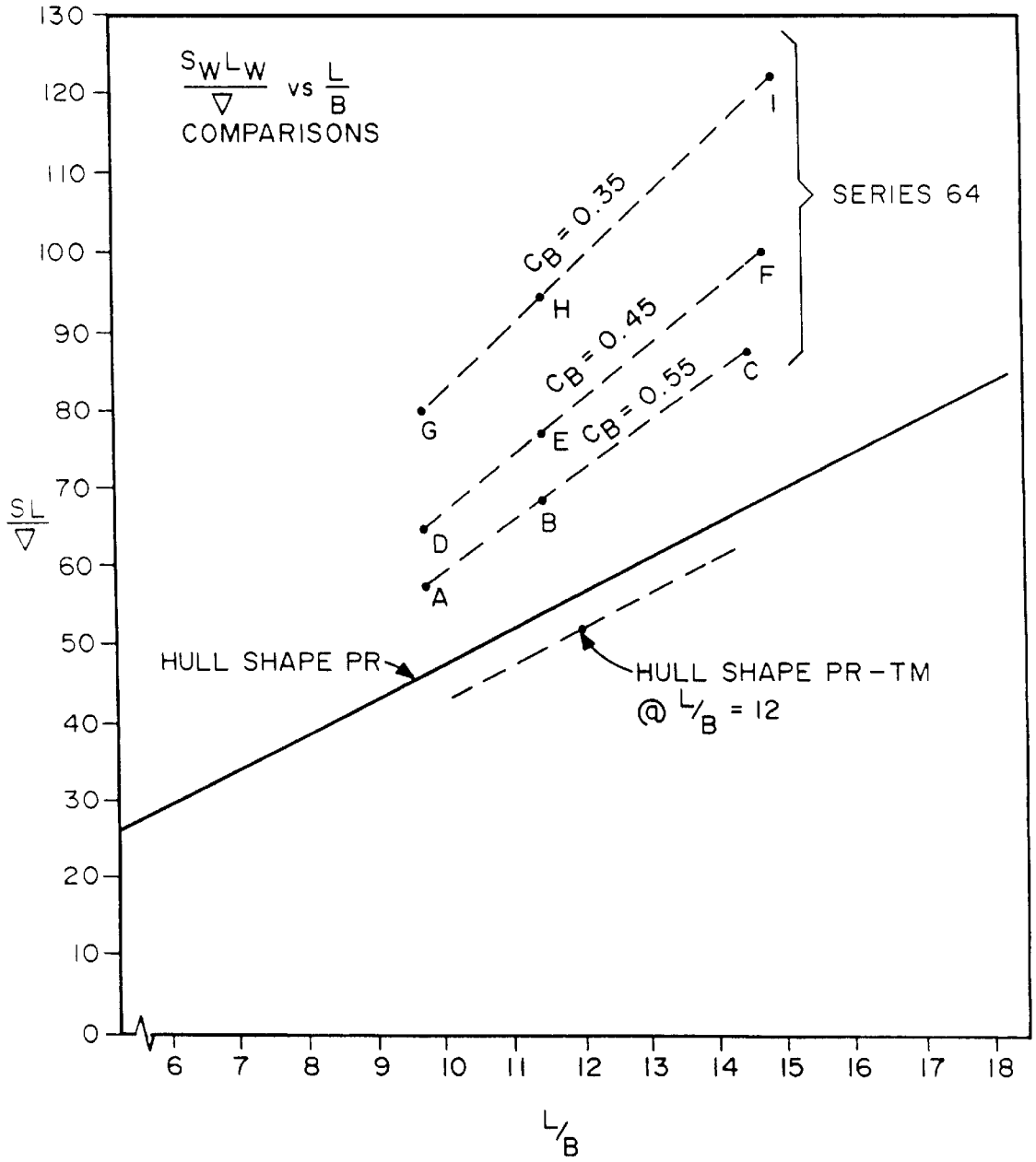
FIG. 33 presents a plot of $S_W L_W/\nabla$ versus $L_W/B$ comparisons for an embodiment of the present invention.

FIG. 33 illustrates the reduction in wetted surface to displacement ratio vs. slenderness offered by the PR, and PR-TM hull shapes, as compared to the slender Series 64 displacement hulls discussed above. Information from this approach supports an embodiment of the present invention, which includes refining hulls shapes for smaller displacement hulls operating at higher speeds using the PR, PR-T, and PR-TM shapes as points of departure for still further hull refinements.

Figure 34:
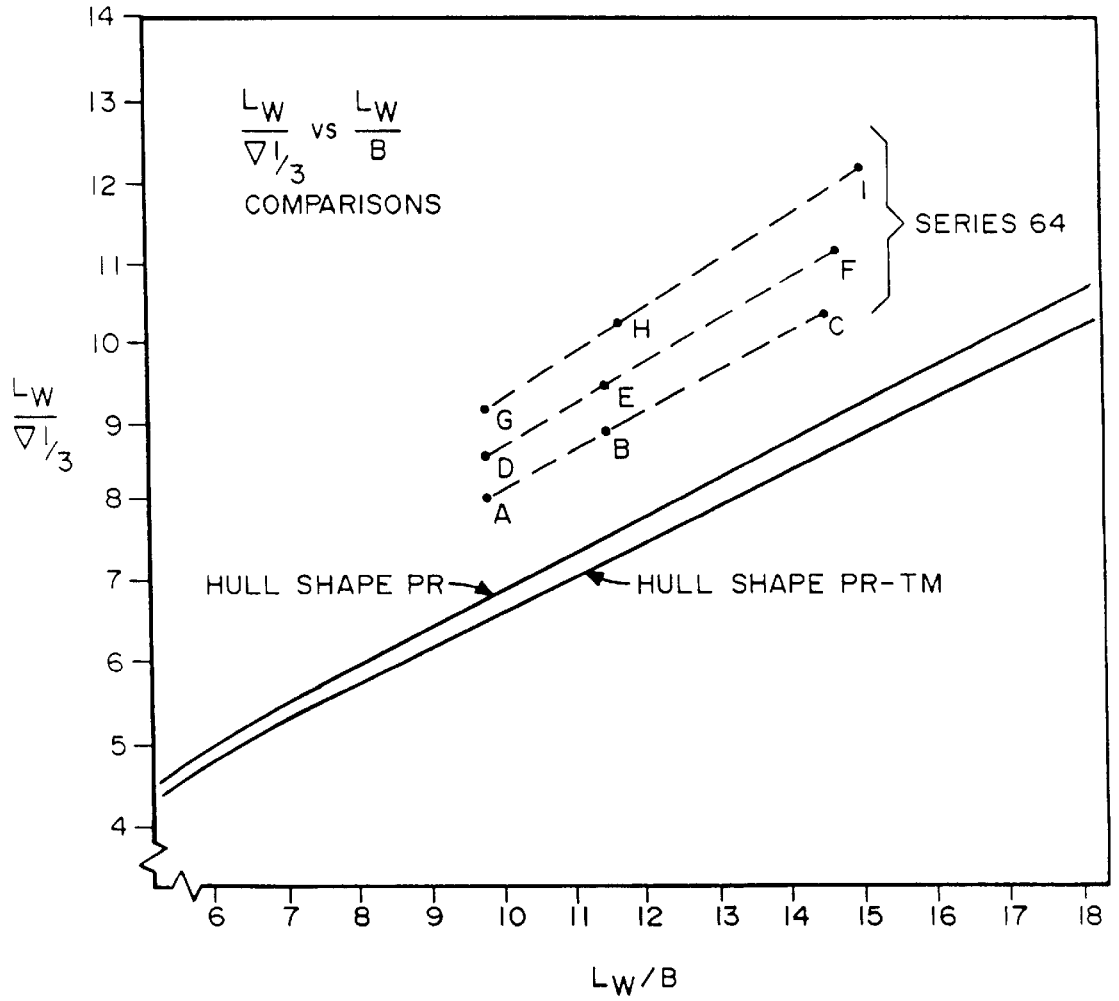
FIG. 34 contains a plot of $L_W/\nabla^{1/3}$ versus $L_W/B$ comparisons for an embodiment of the present invention.
Figure 35:
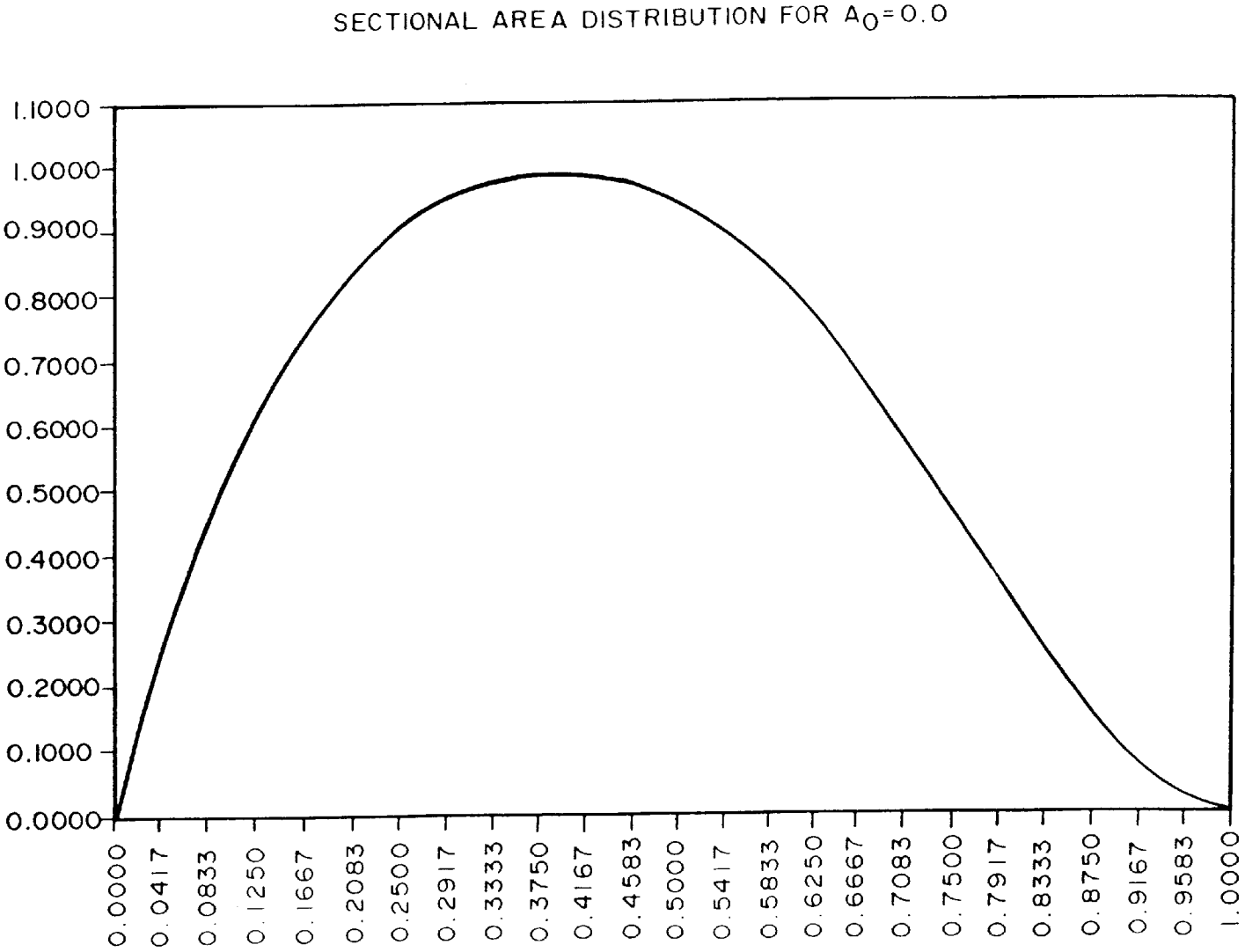
FIG. 35 shows a plot of a sectional area distribution for $A_0$=0.0 for an embodiment of the present invention.
Figure 36:
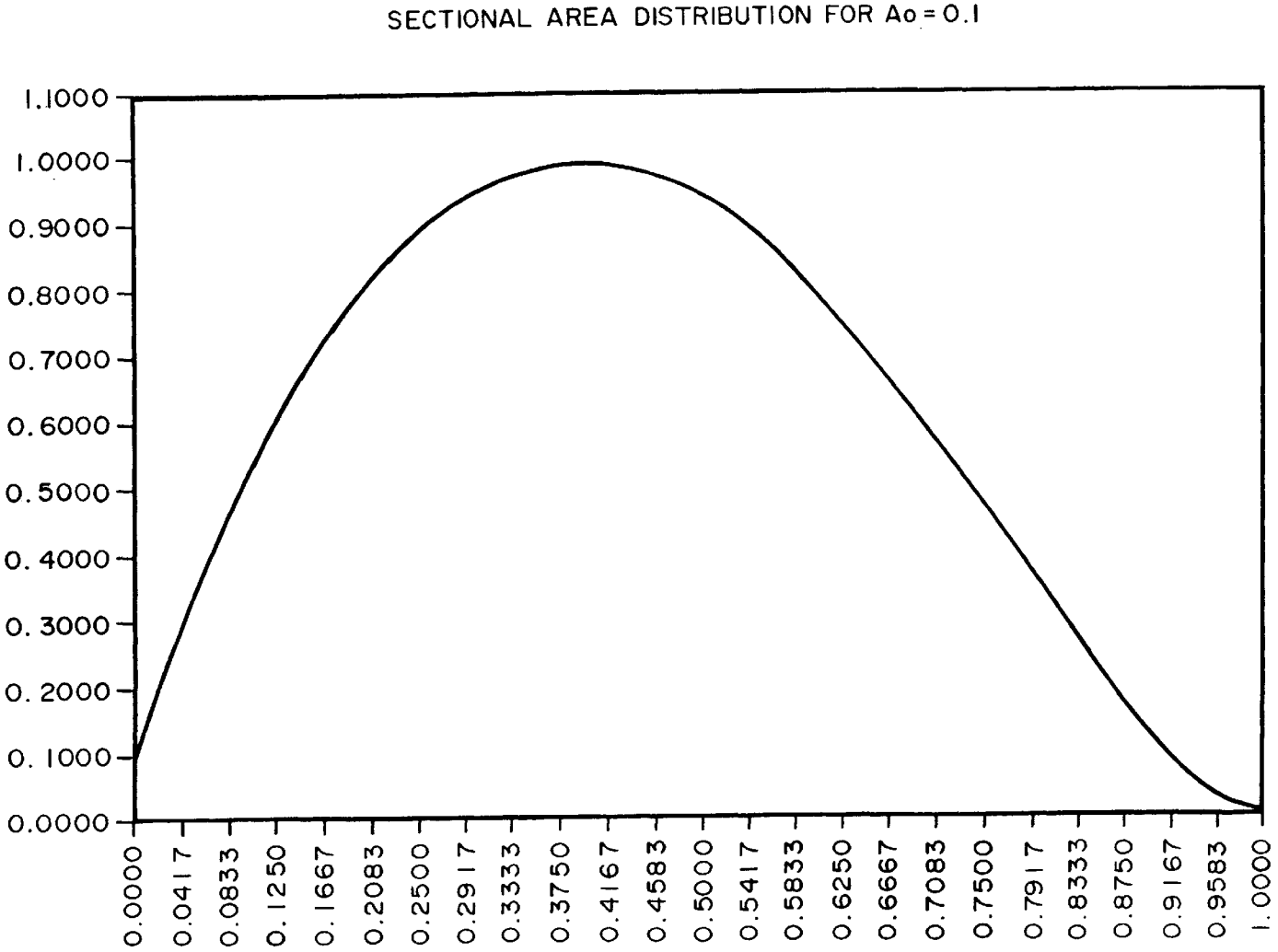
FIG. 36 is a plot of a sectional area distribution for $A_0$=0.1 for an embodiment of the present invention.
Figure 37:
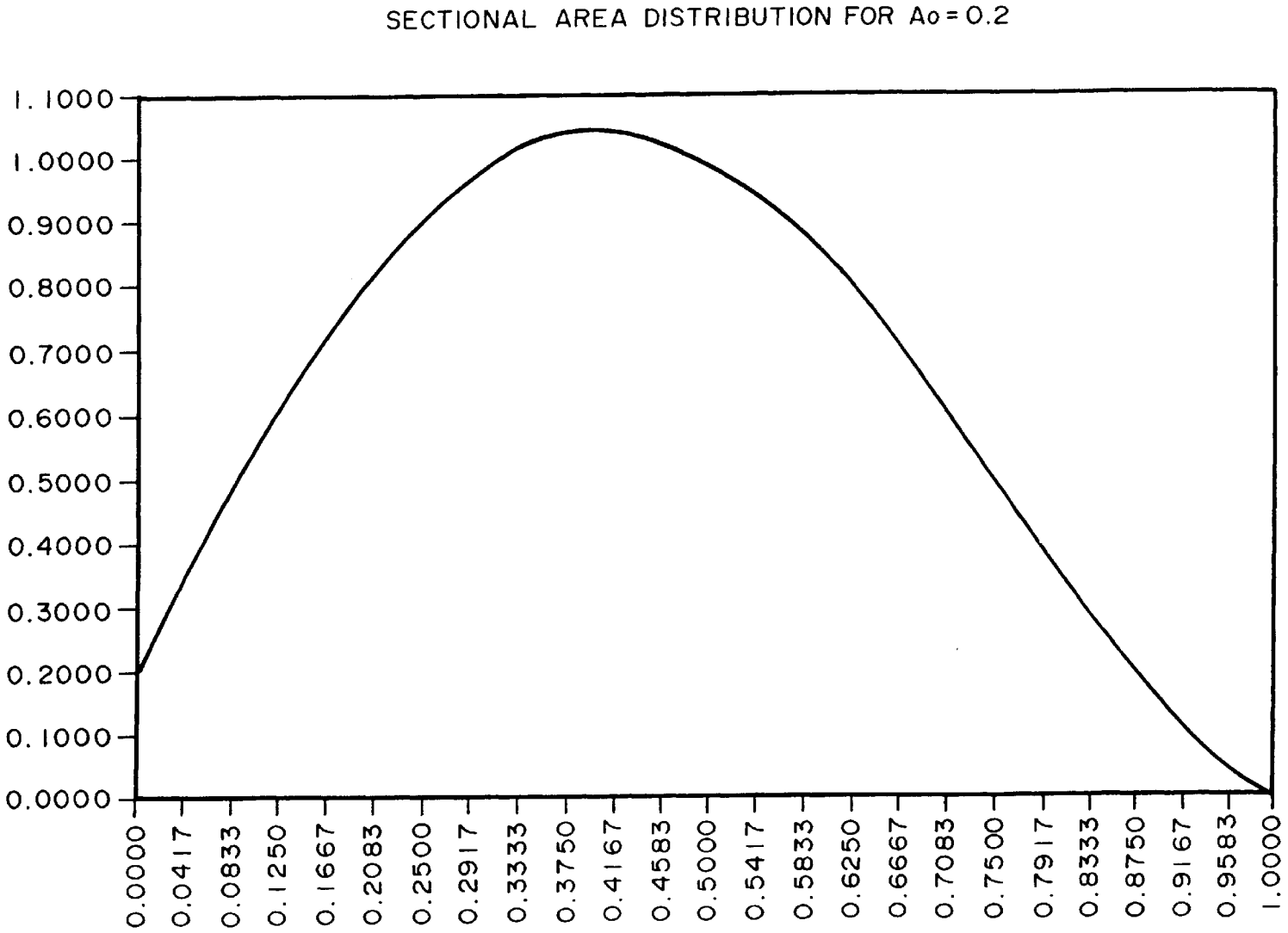
FIG. 37 presents a plot of a sectional area distribution for $A_0$=0.2 for an embodiment of the present invention.
Figure 38:
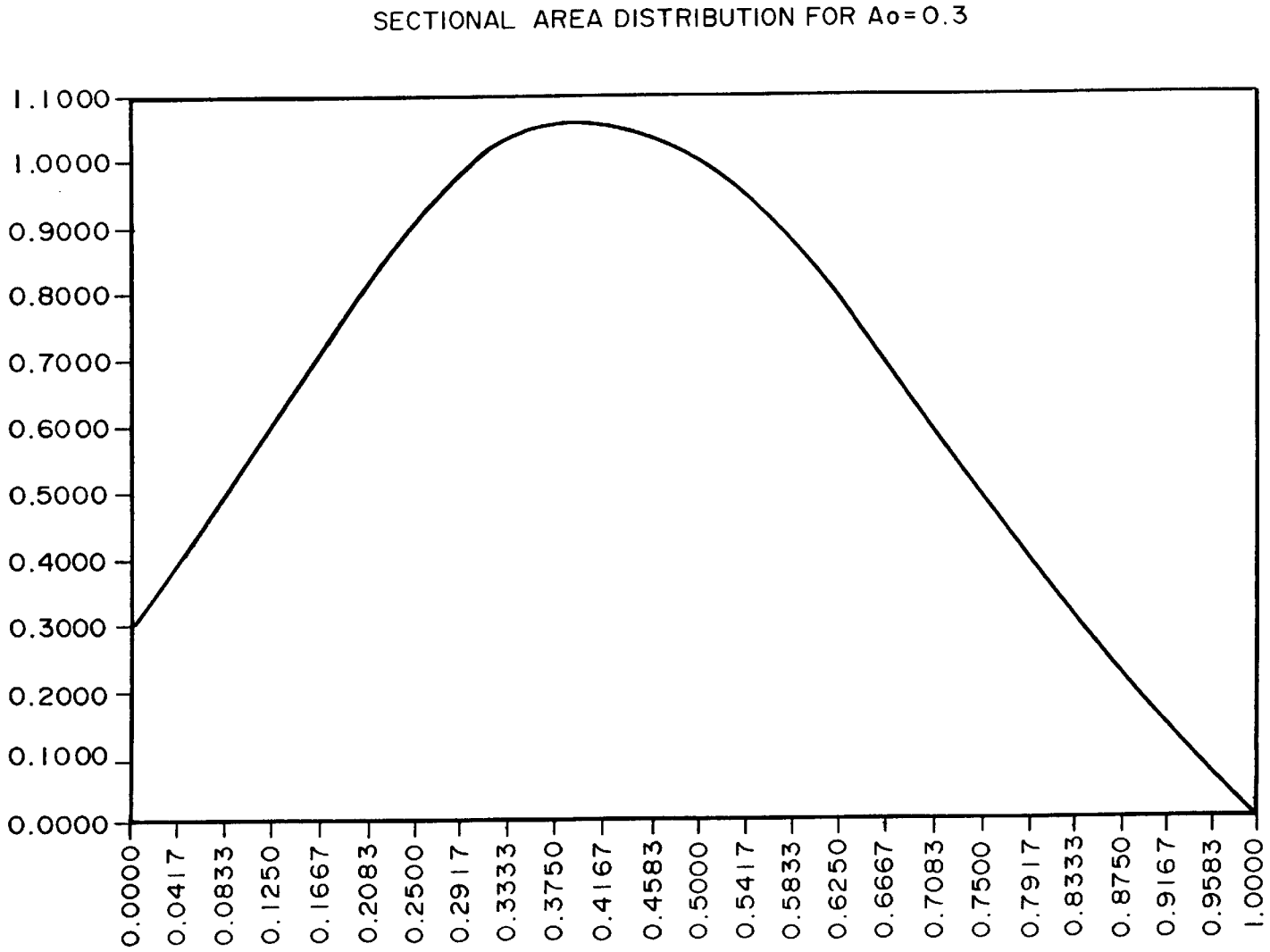
FIG. 38 contains a plot of a sectional area distribution for $A_0$=0.3 for an embodiment of the present invention.
Figure 39:
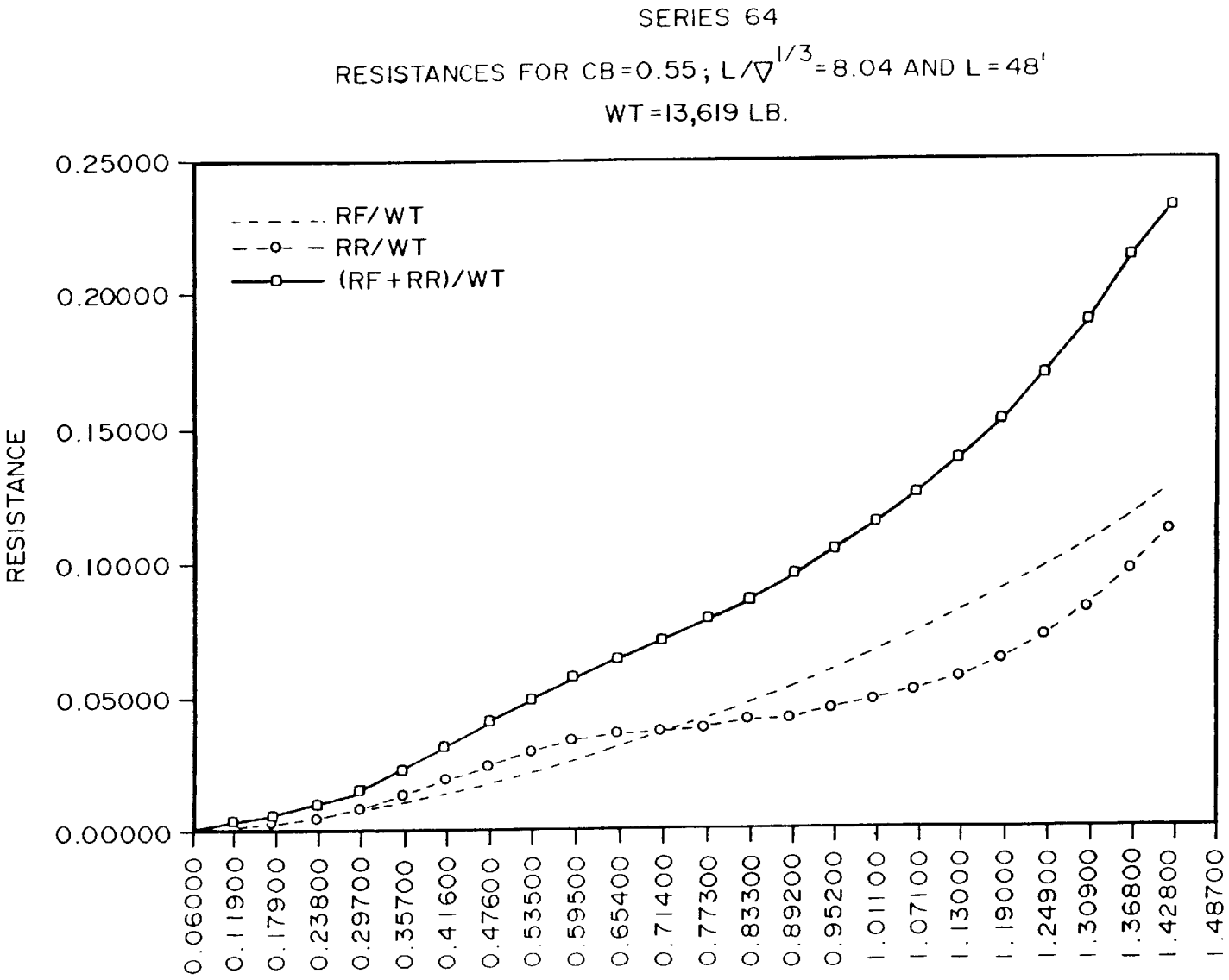
FIG. 39 shows a plot of Series 64 hull shape A with resistance for CB=0.55, $L/\nabla^{1/3}$=8.04, L=48', and WT=13,619 lb. for an embodiment of the present invention.
Figure 40:
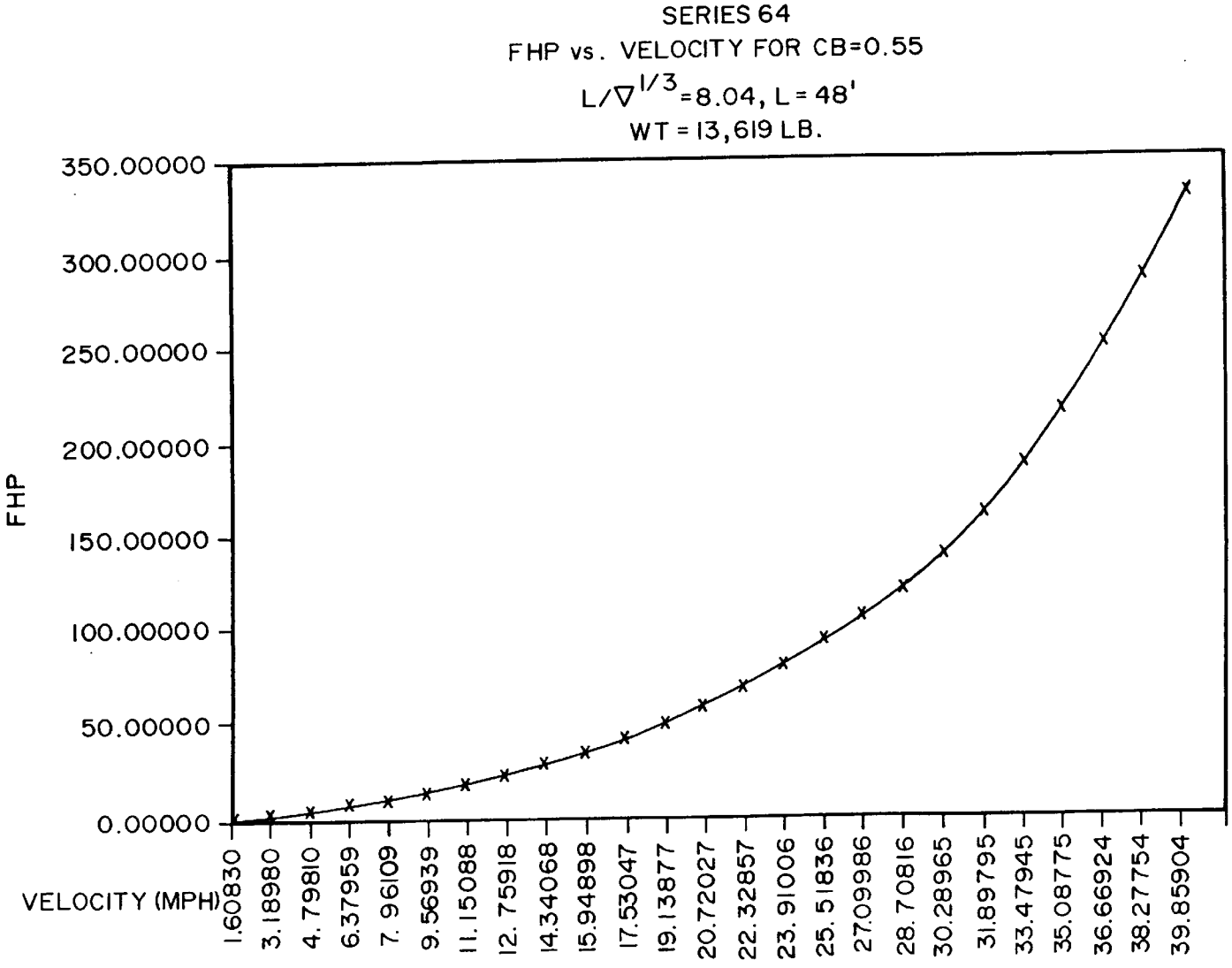
FIG. 40 is a plot of Series 64 hull shape A for FHP versus velocity for CB=0.55, $L/\nabla^{1/3}$=8.04, L=48', and $W_T$=13,619 lb. for an embodiment of the present invention.
Figure 41:
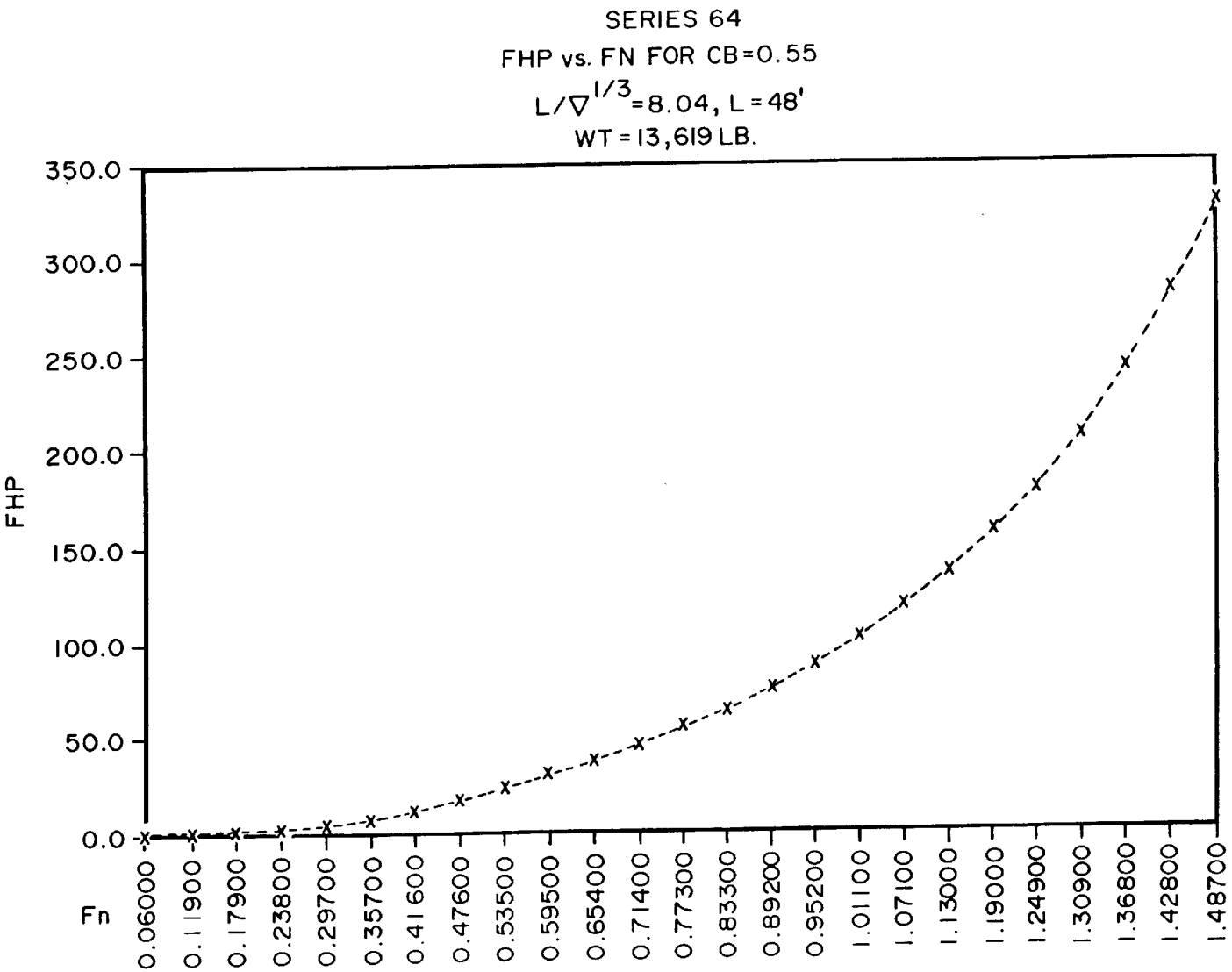
FIG. 41 presents a plot of Series 64 hull shape A for FFHP versus $F_N$ for CB=0.55, $L/\nabla^{1/3}$=8.04, L=48', and $W_T$=13,619 lb. for an embodiment of the present invention.
Figure 42:
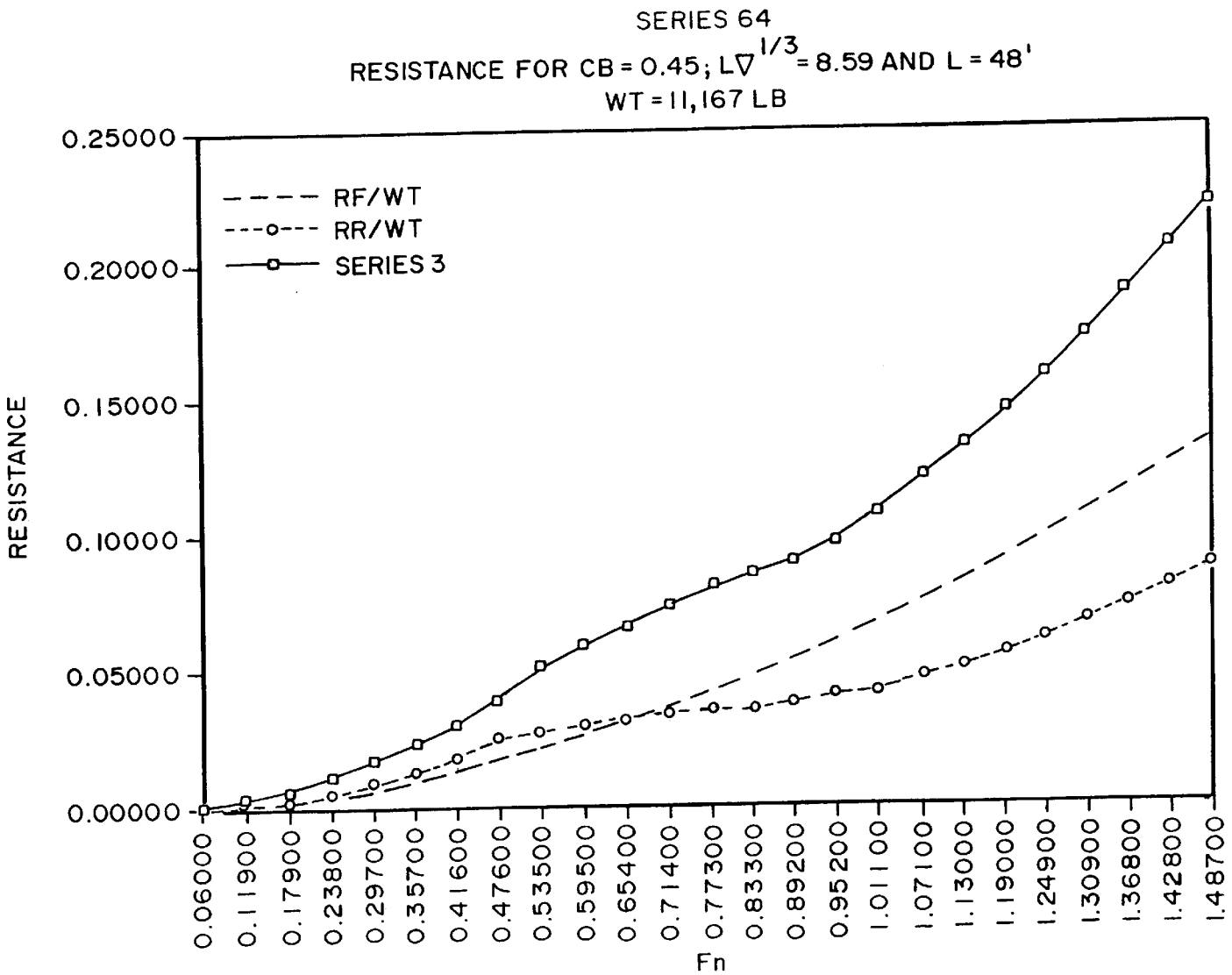
FIG. 42 contains a plot of Series 64 hull shape A resistance ($R_T/W_T$) for CB=0.45, $L/\nabla^{1/3}$=8.59, L=48', and $W_T$=11,167 lb. for an embodiment of the present invention.
Figure 43:
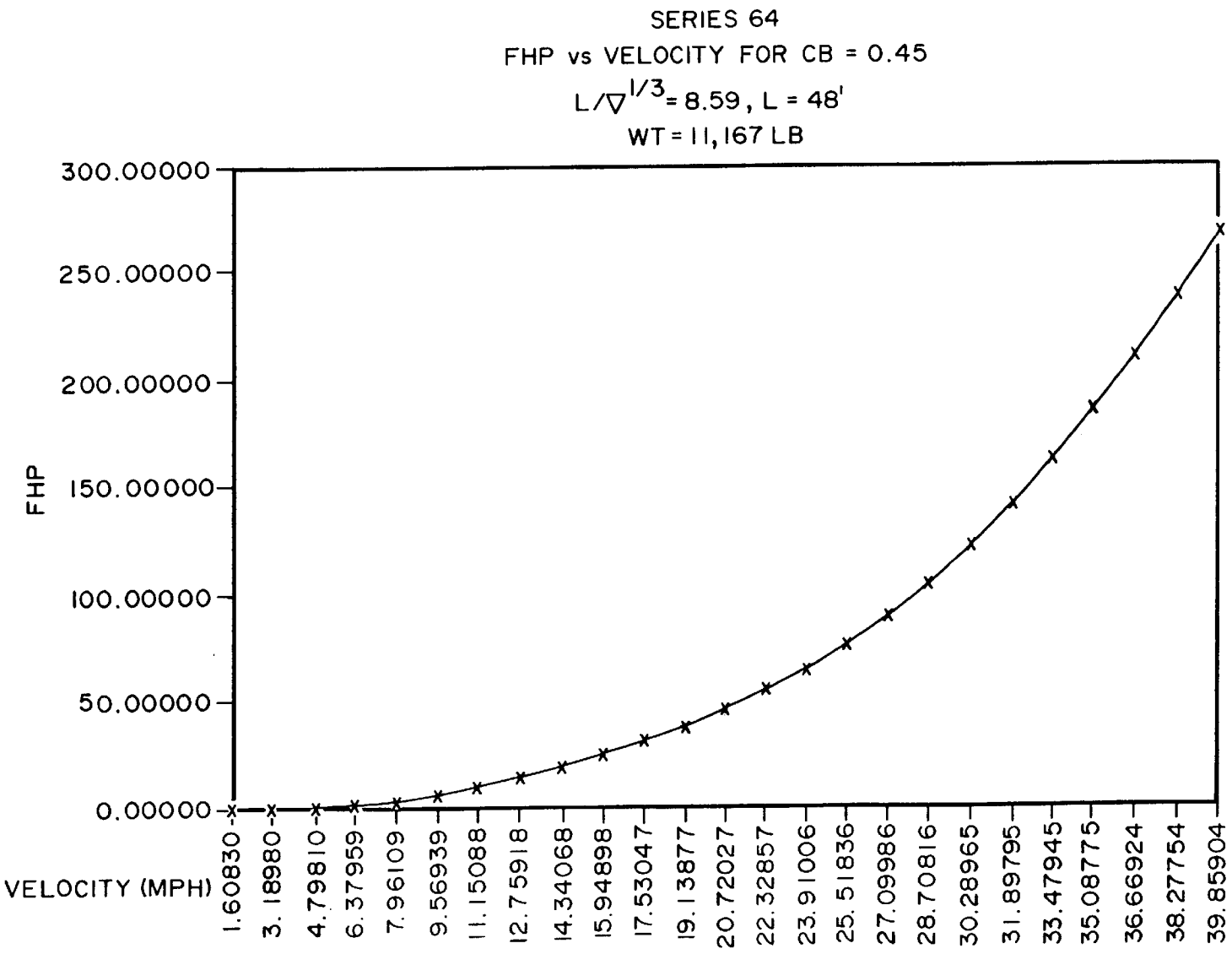
FIG. 43 shows a plot of Series 64 hull shape B for FHP versus velocity for CB=0.45, $L/\nabla^{1/3}$=8.59, L=48', and WT=11,167 lb. for an embodiment of the present invention.
Figure 44:
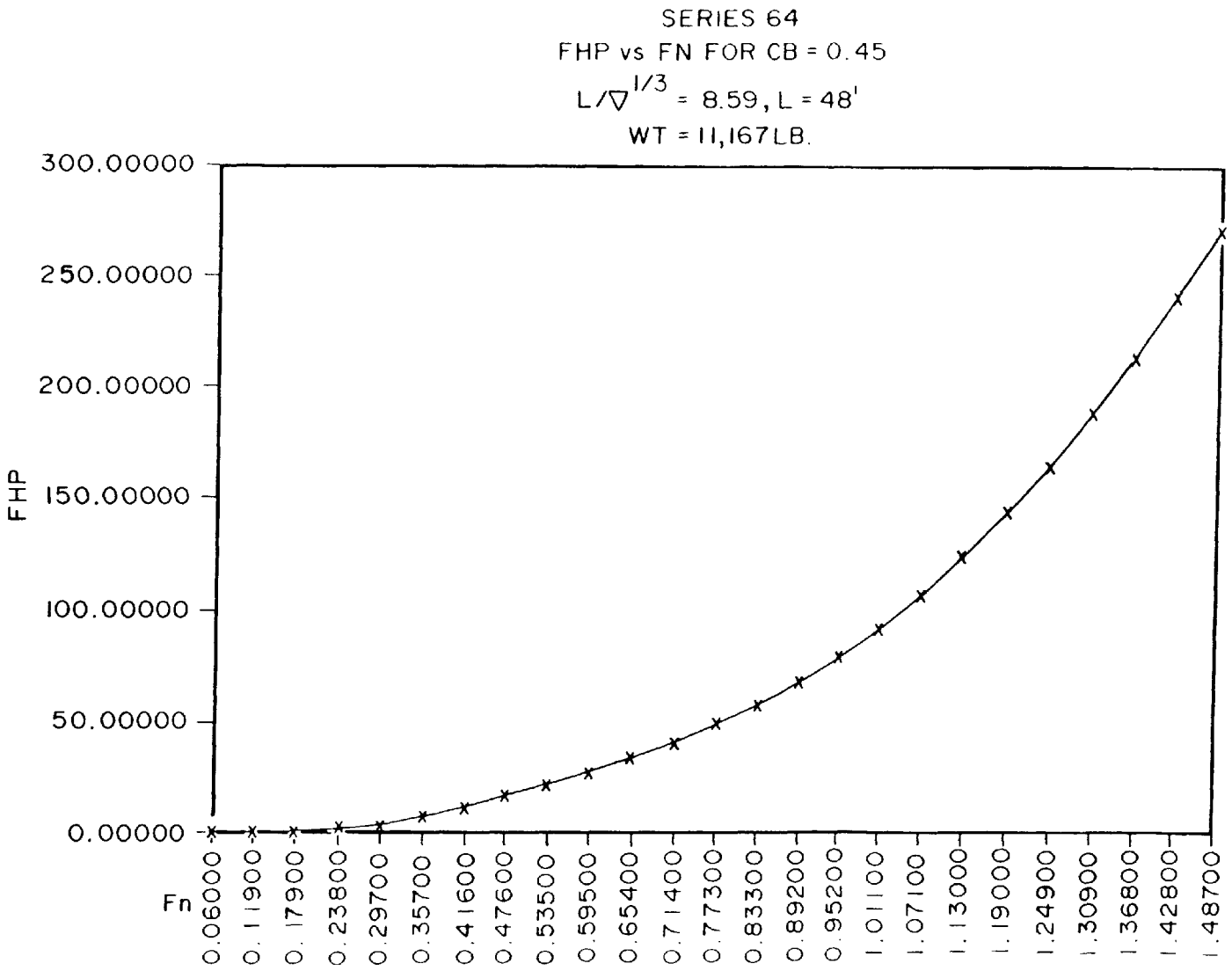
FIG. 44 is a plot of Series 64 hull shape B for FHP versus $F_N$ for CB=0.45, $L/\nabla^{1/3}$=8.59, L=48', and WT=11,167 lb. for an embodiment of the present invention.
Figure 45A:
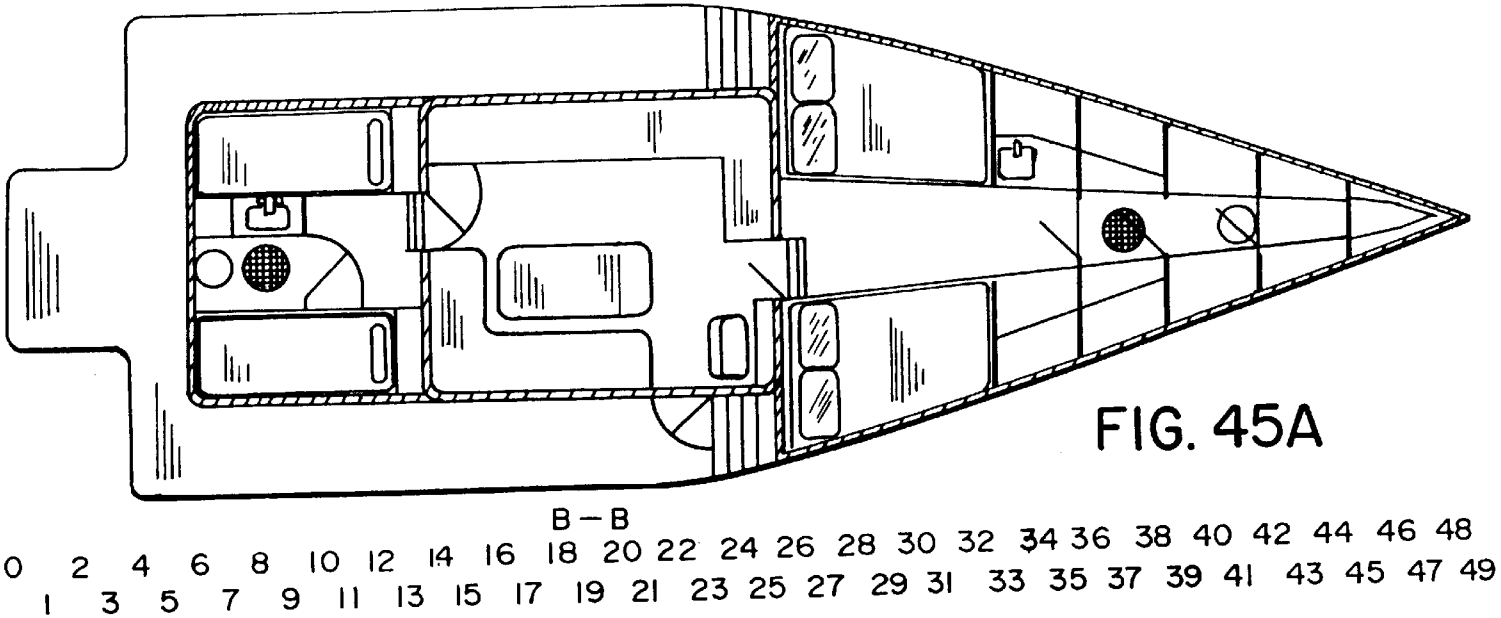
FIGS. 45A and 45B present elevation and plan cut views of a boat design according to an embodiment of the present invention.
Figure 45B:
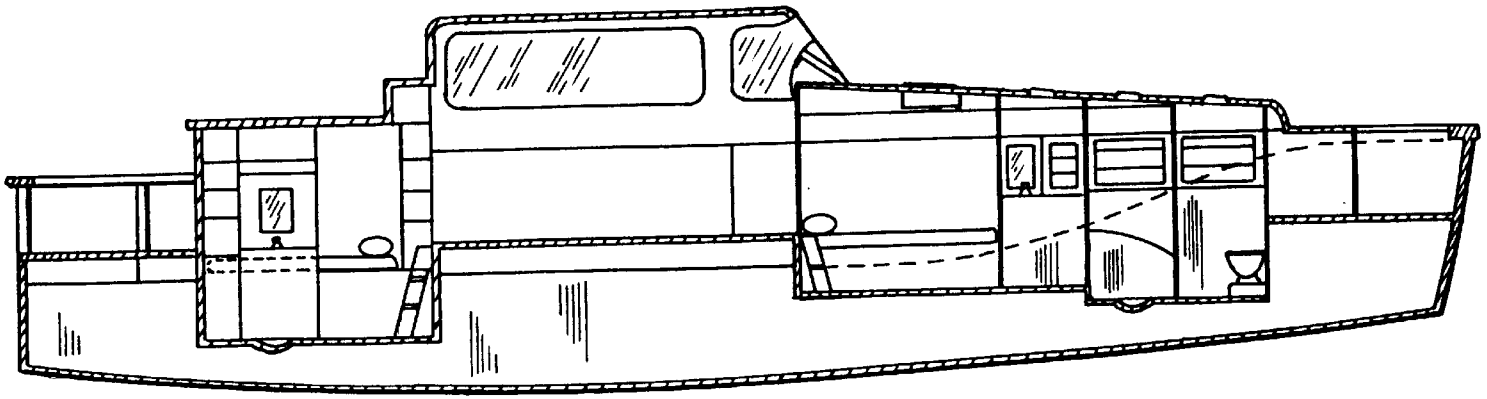
Figures 46A, 46B, 46C, 46D, 46E, 46F, 46G, 46H, 46I, 46J, 46K, 46L, 46M, 46N:
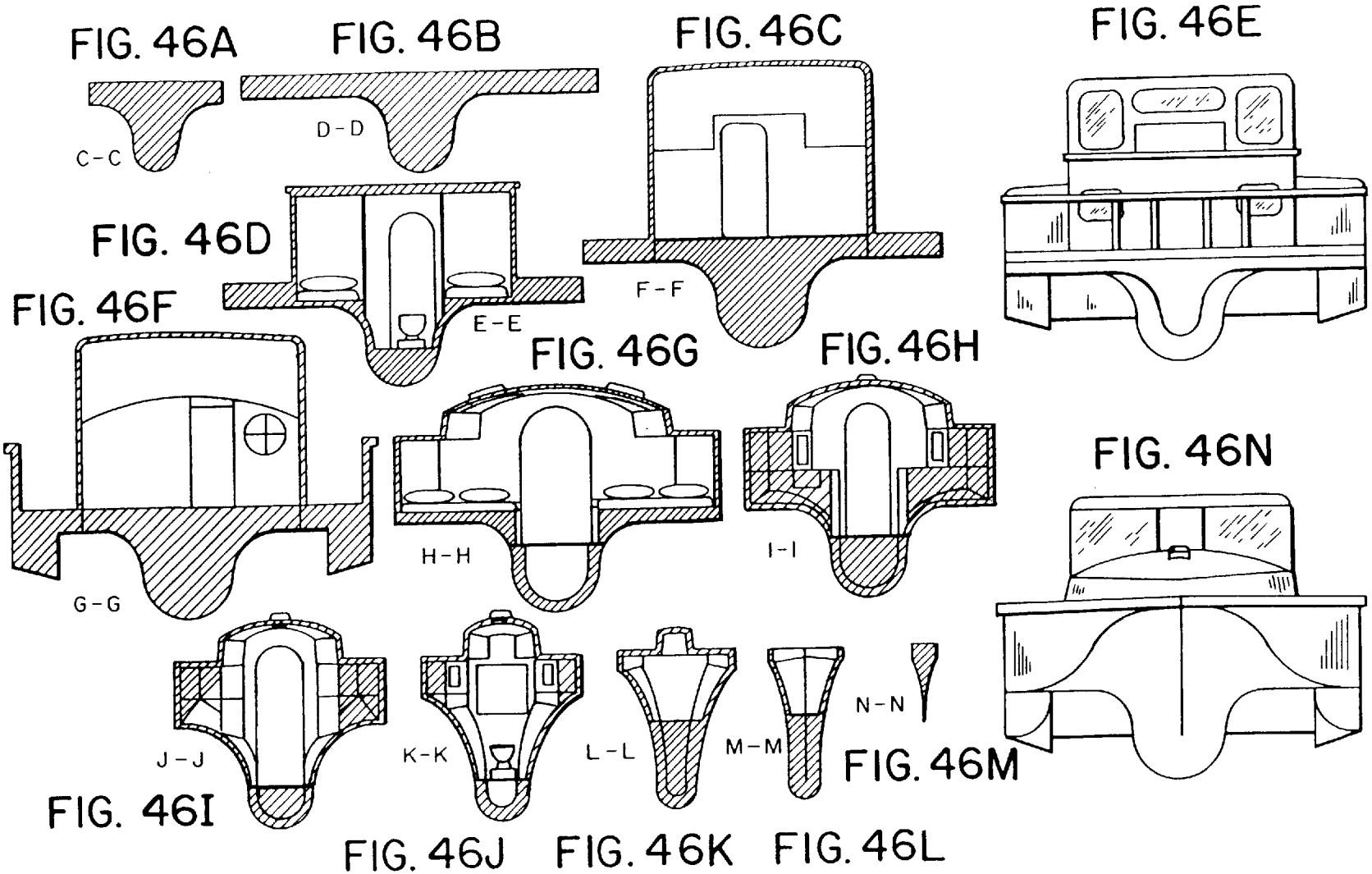
FIGS. 46A–46N contain cross section views of a boat design according to an embodiment of the present invention.
Figure 47A:
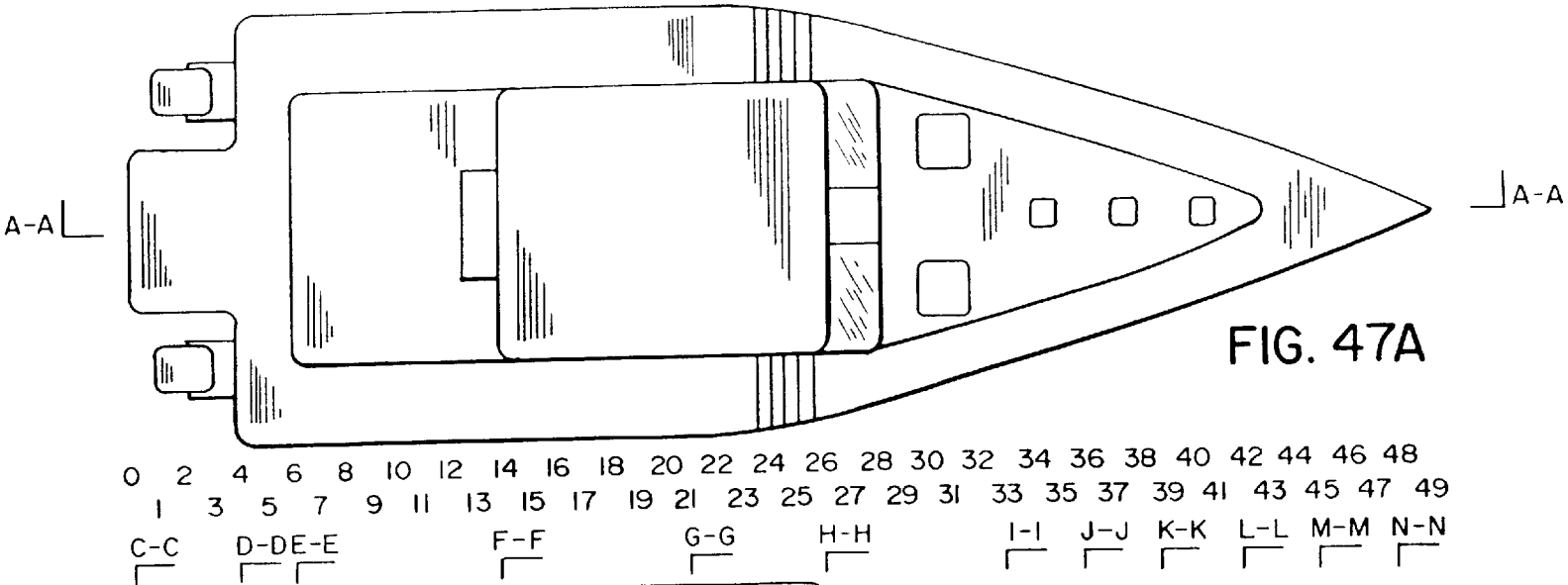
FIGS. 47A and 47B show elevation and plan views of a boat design according to an embodiment of the present invention.
Figure 47B:
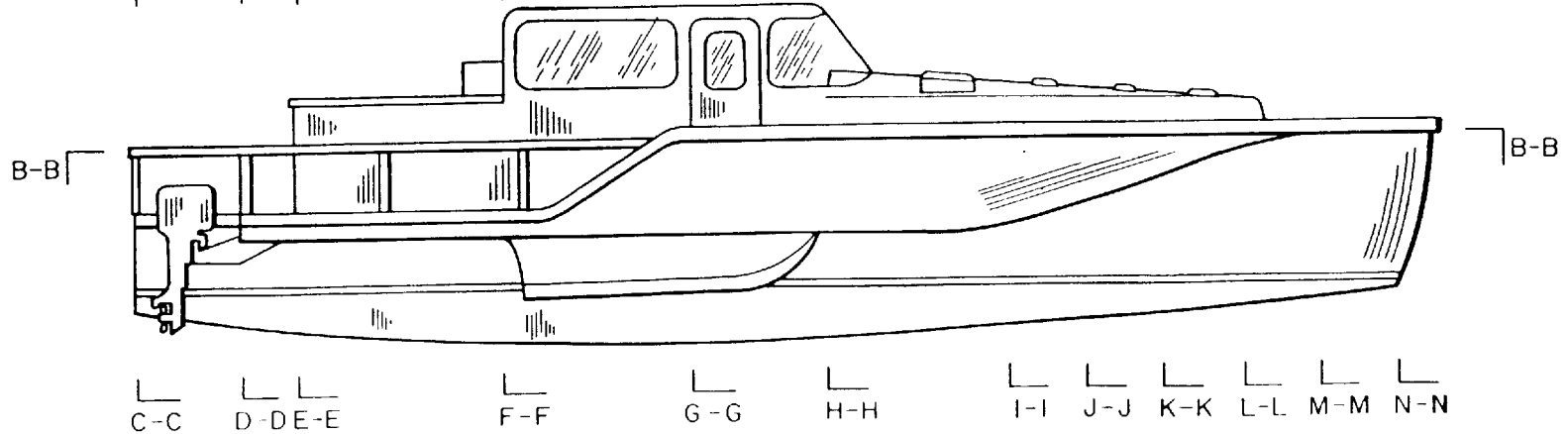
Figures 48A, 48B, 48C, 48D:
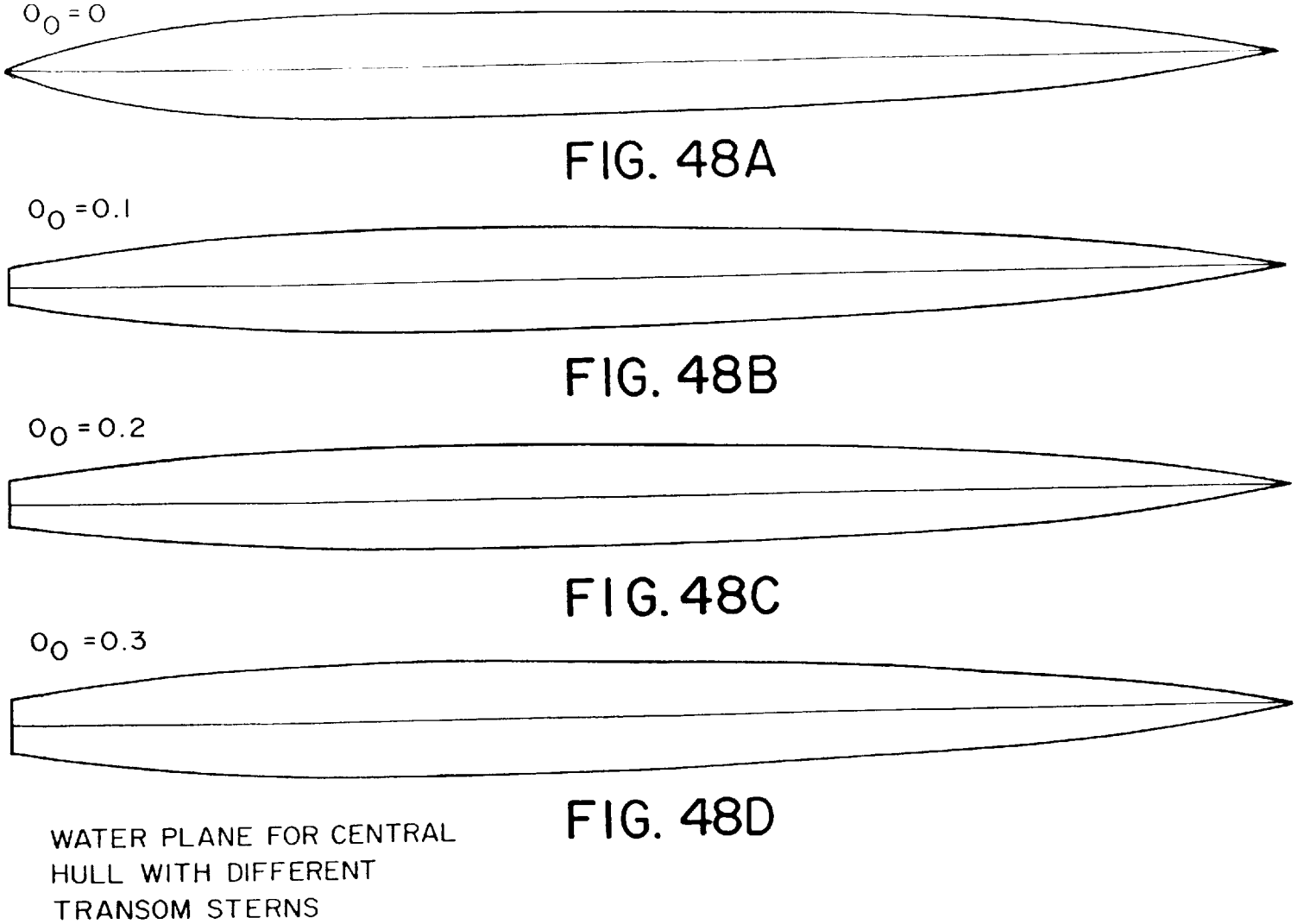
FIGS. 48A–48D are waterplane views of a boat design according to an embodiment of the present invention.
Figure 49A:
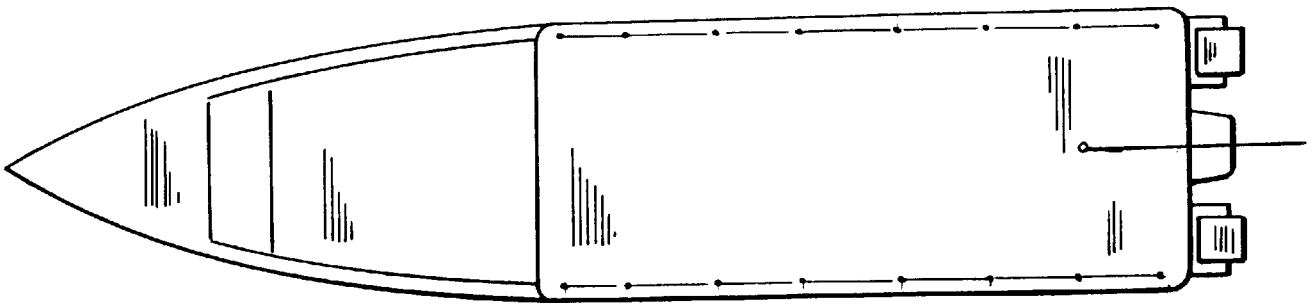
FIGS. 49A and 49B present sketch views of a boat design according to an embodiment of the present invention.
Figure 49B:
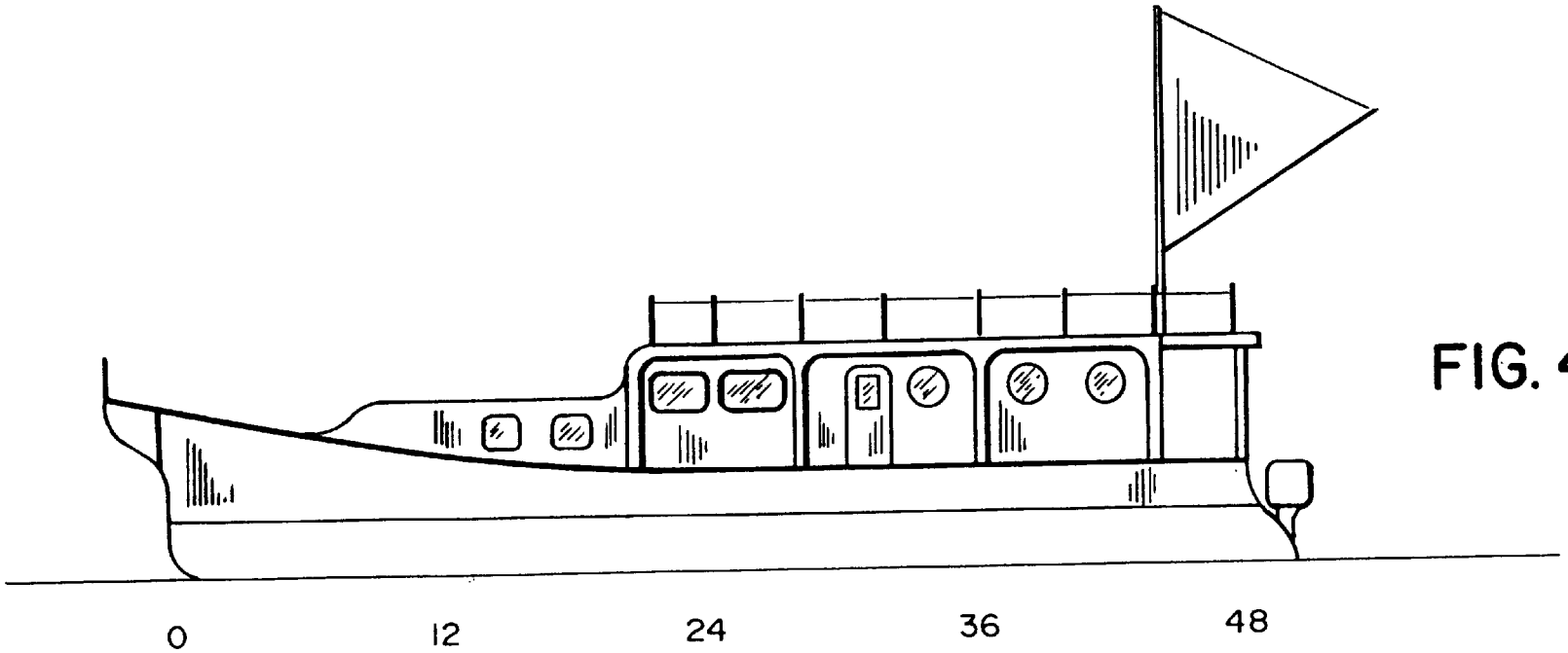
Figure 50:
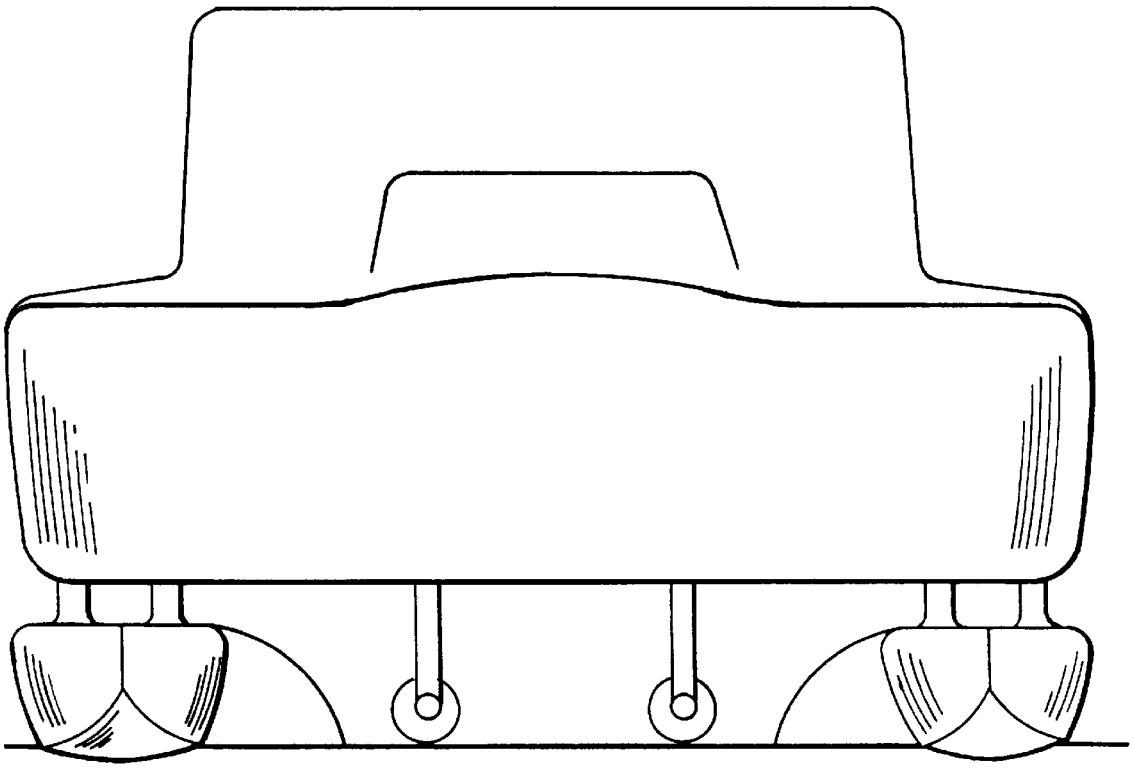
FIG. 50 contains a sketch section view of a boat design according to an embodiment of the present invention.
Figure 51:
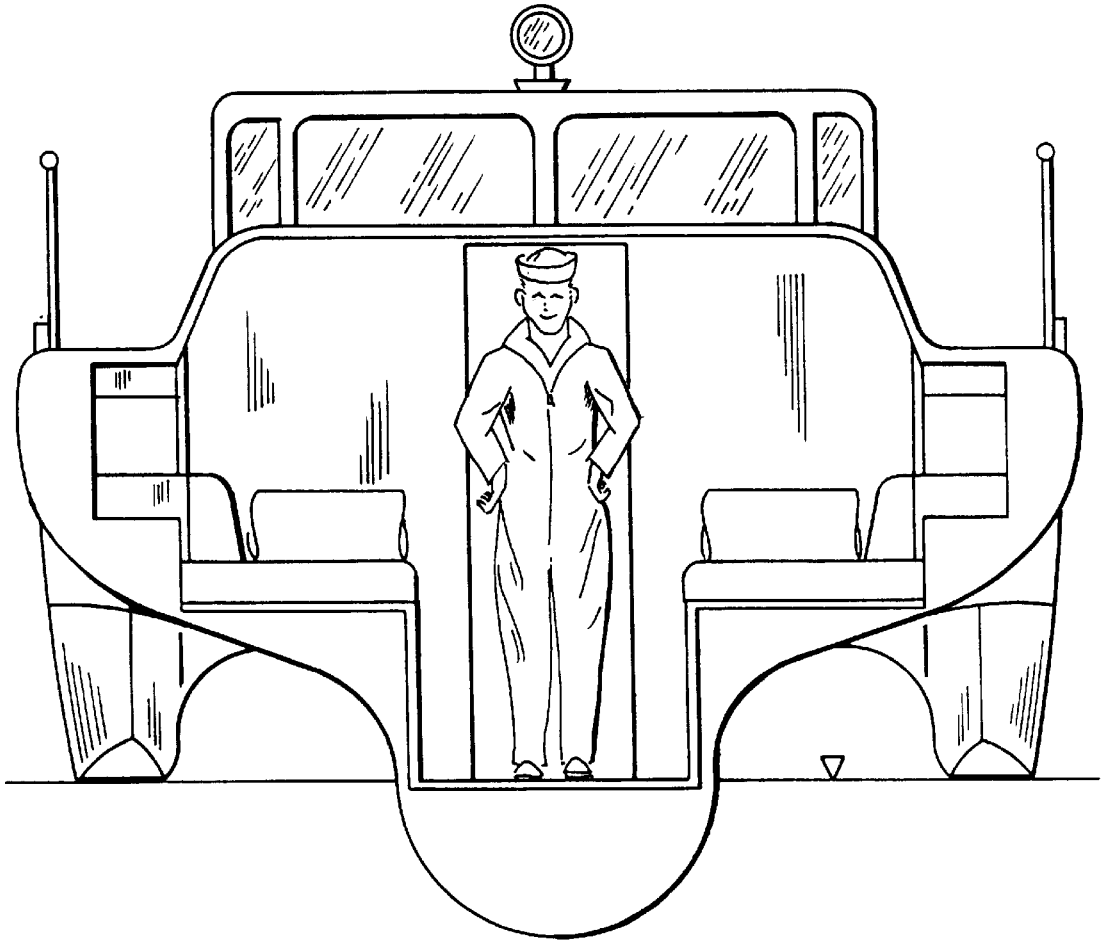
FIG. 51 shows a sketch section view of a boat design according to an embodiment of the present invention.
Figure 52:
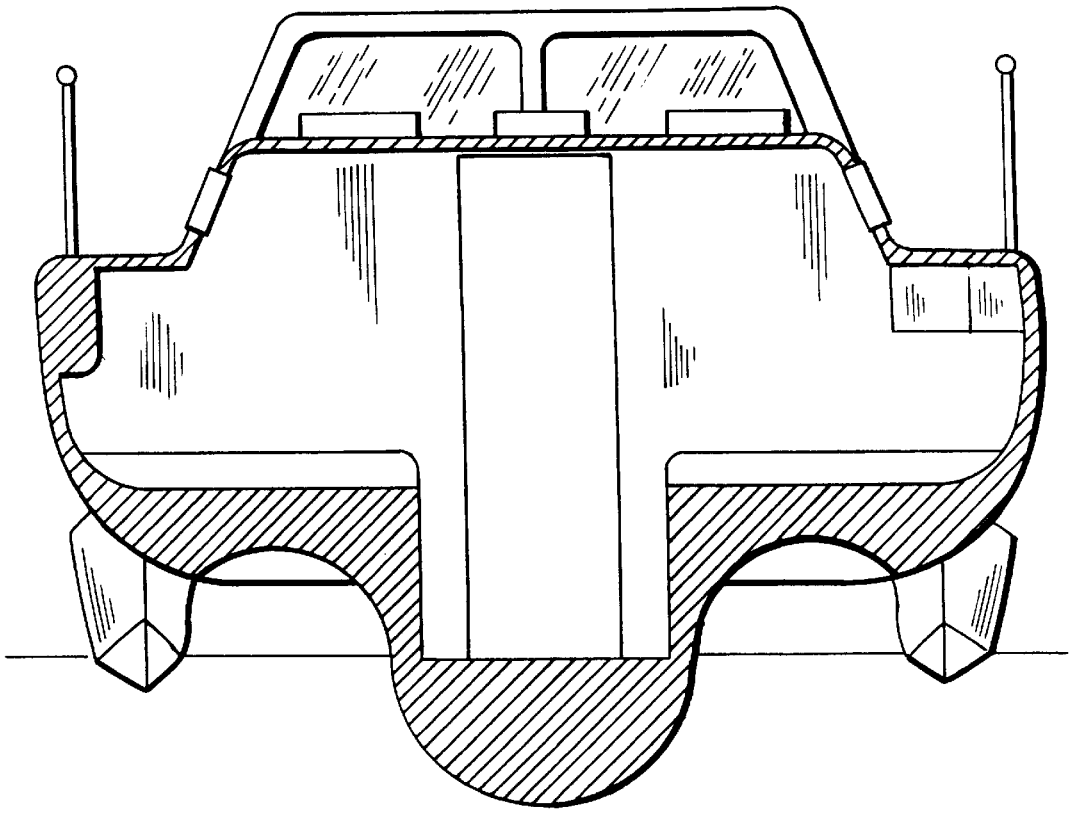
FIG. 52 is a sketch section view of a boat design according to an embodiment of the present invention.
Figure 53:
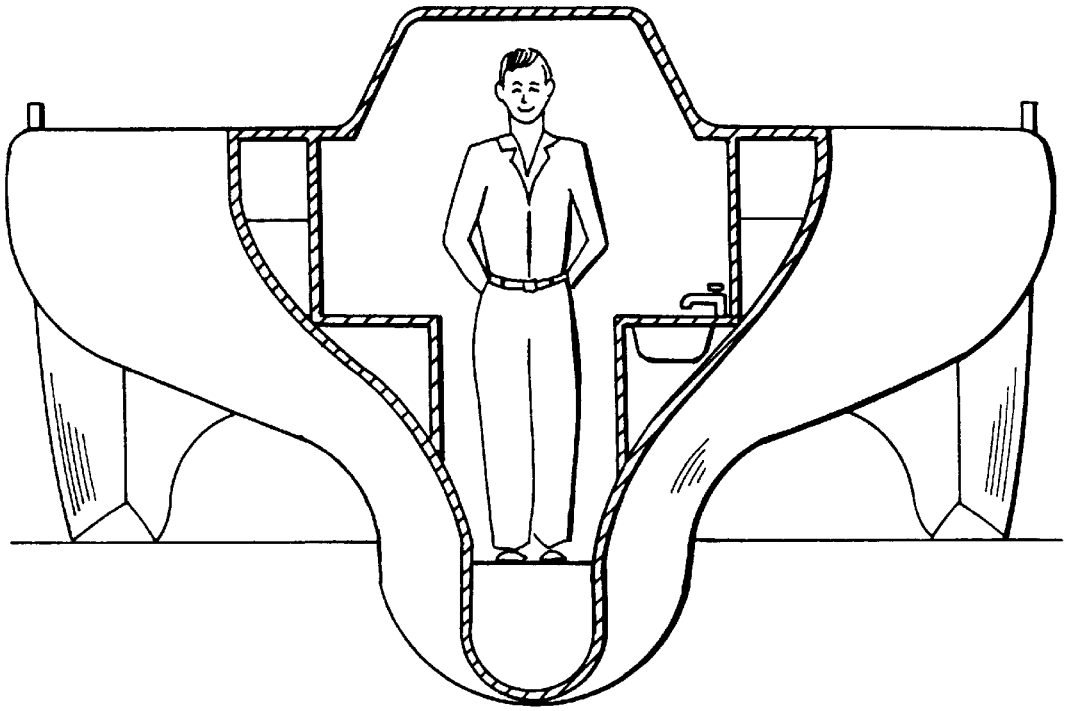
FIG. 53 is a sketch view of a boat design according to an embodiment of the present invention.
Figure 54:
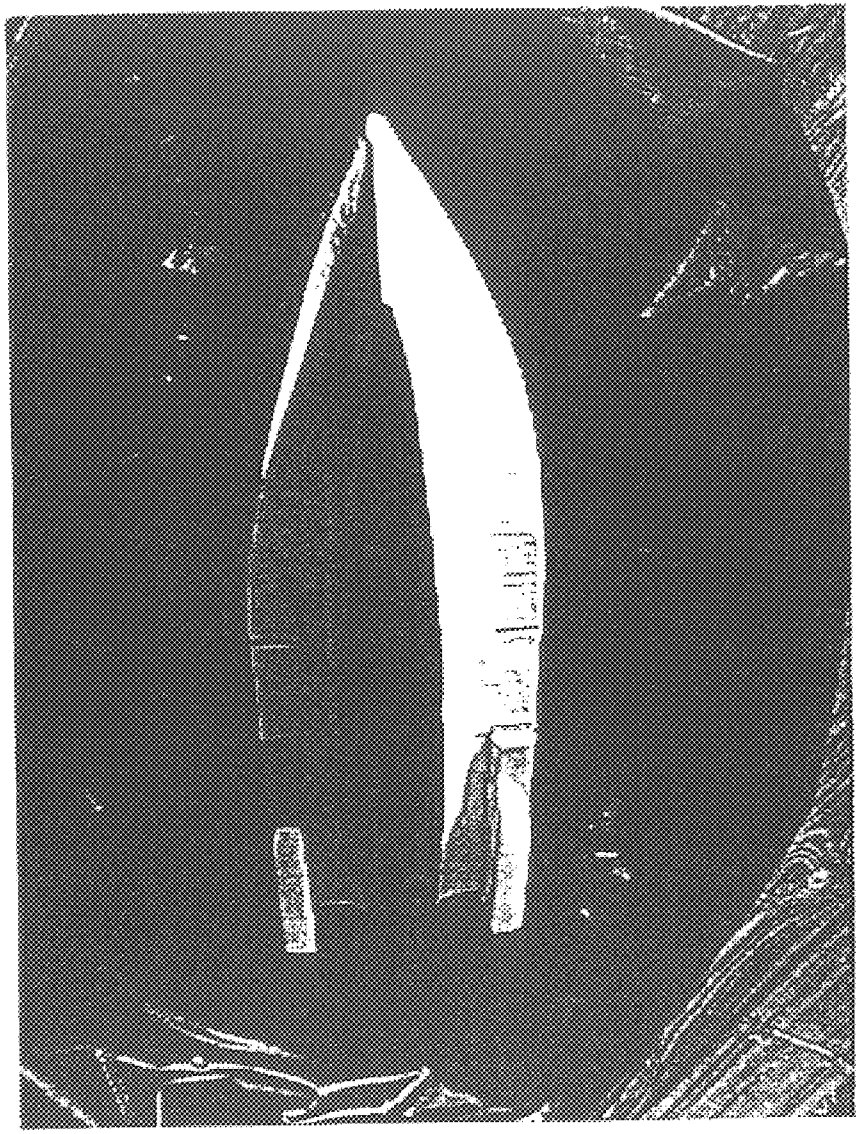
FIG. 54 presents a bottom view of a model boat according to an embodiment of the present invention.
Figure 55:
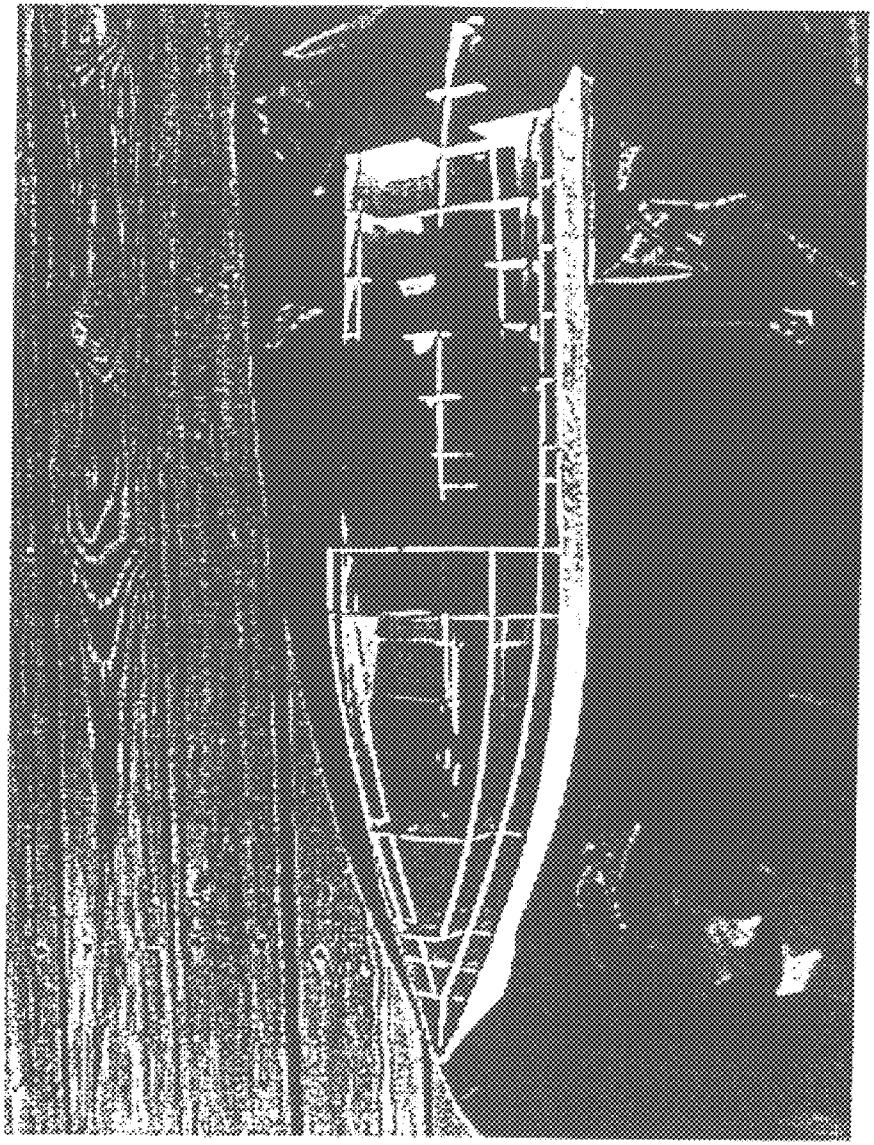
FIG. 55 contains a top view of a model boat according to an embodiment of the present invention.
Figure 56:
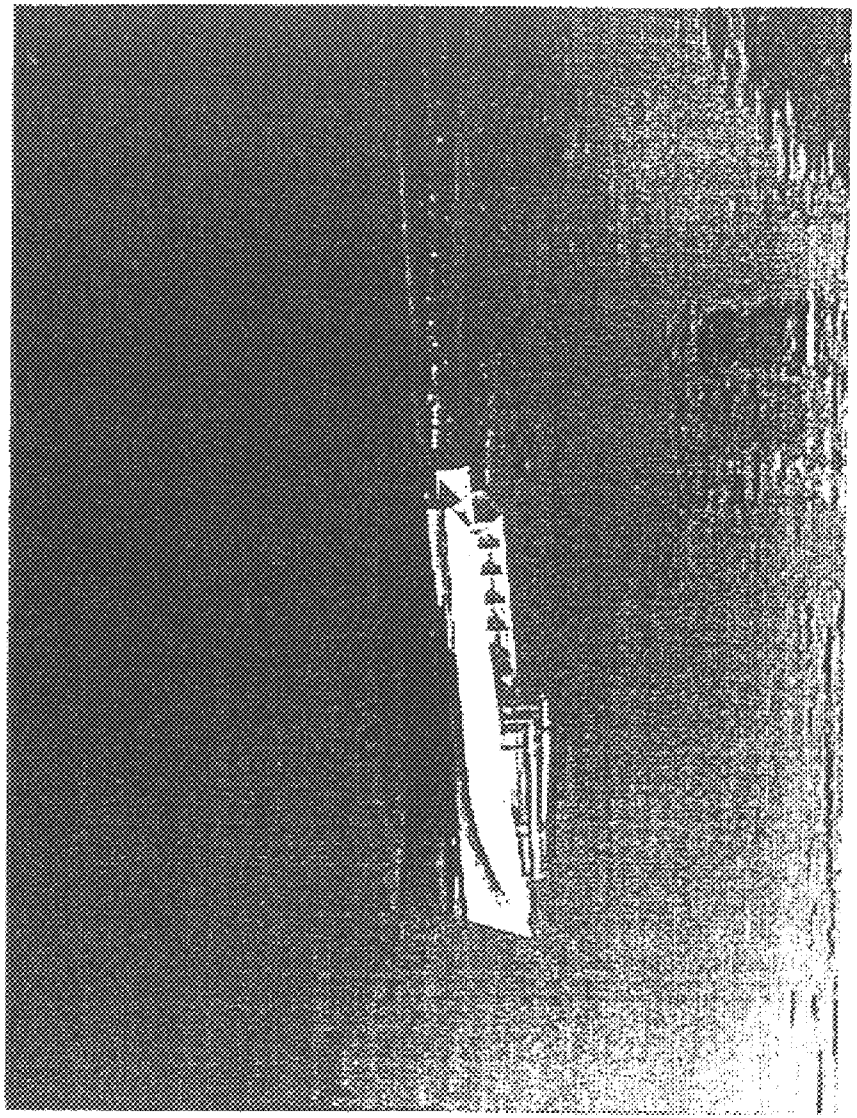
FIG. 56 shows a side view of a model boat in operation according to an embodiment of the present invention.
Figure 57:
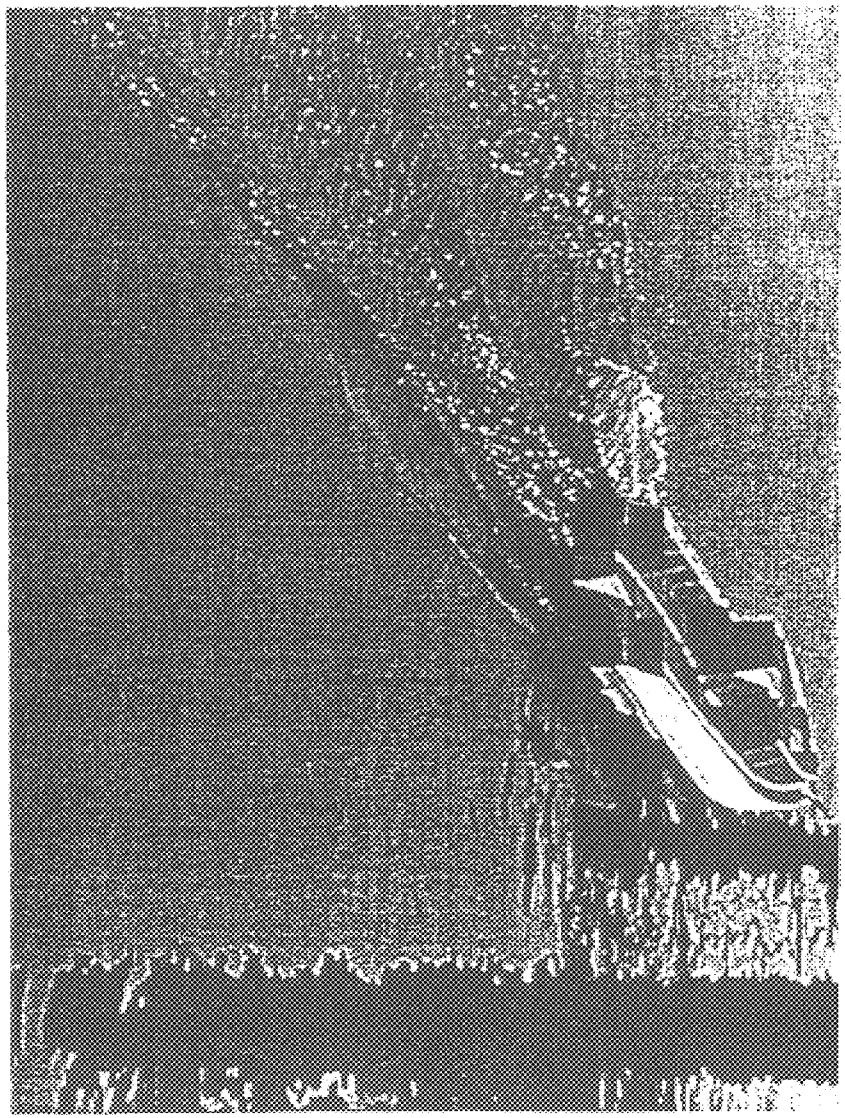
FIG. 57 is another view of a model boat in operation according to an embodiment of the present invention.
Figure 58:
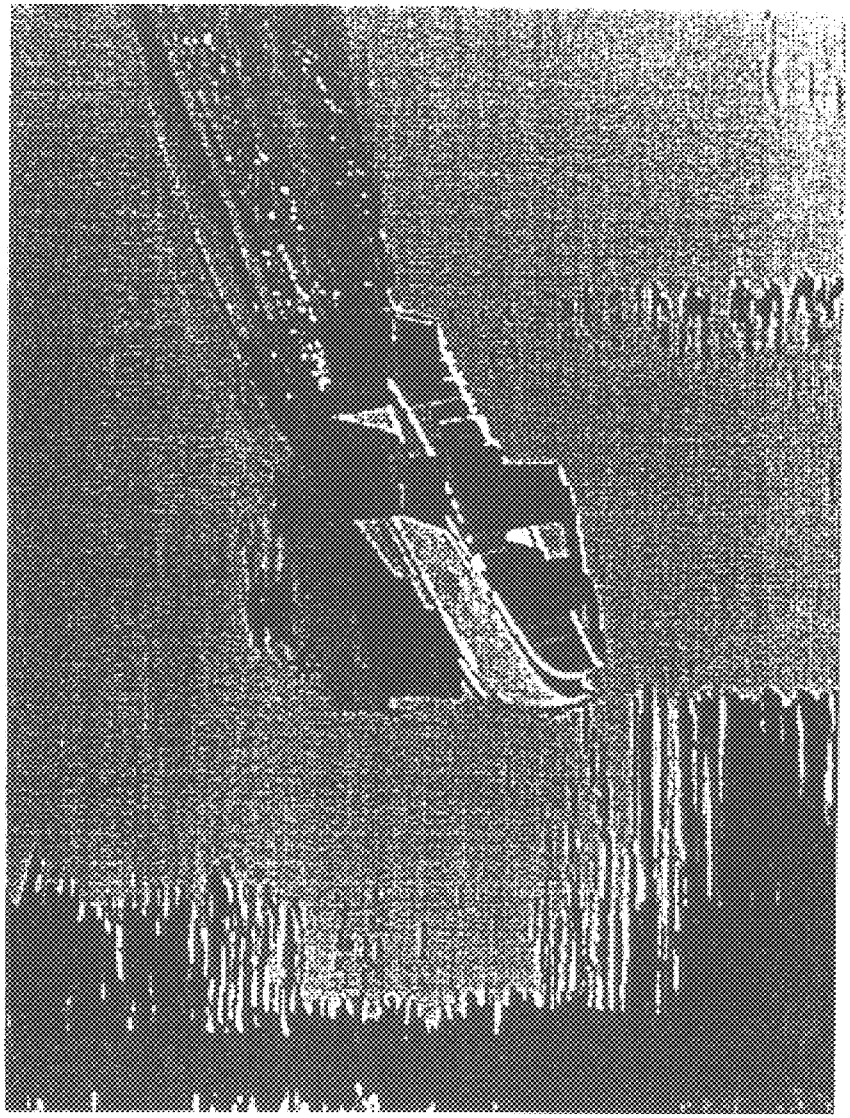
FIG. 58 presents another view of a model boat in operation according to an embodiment of the present invention.
Figure 59:
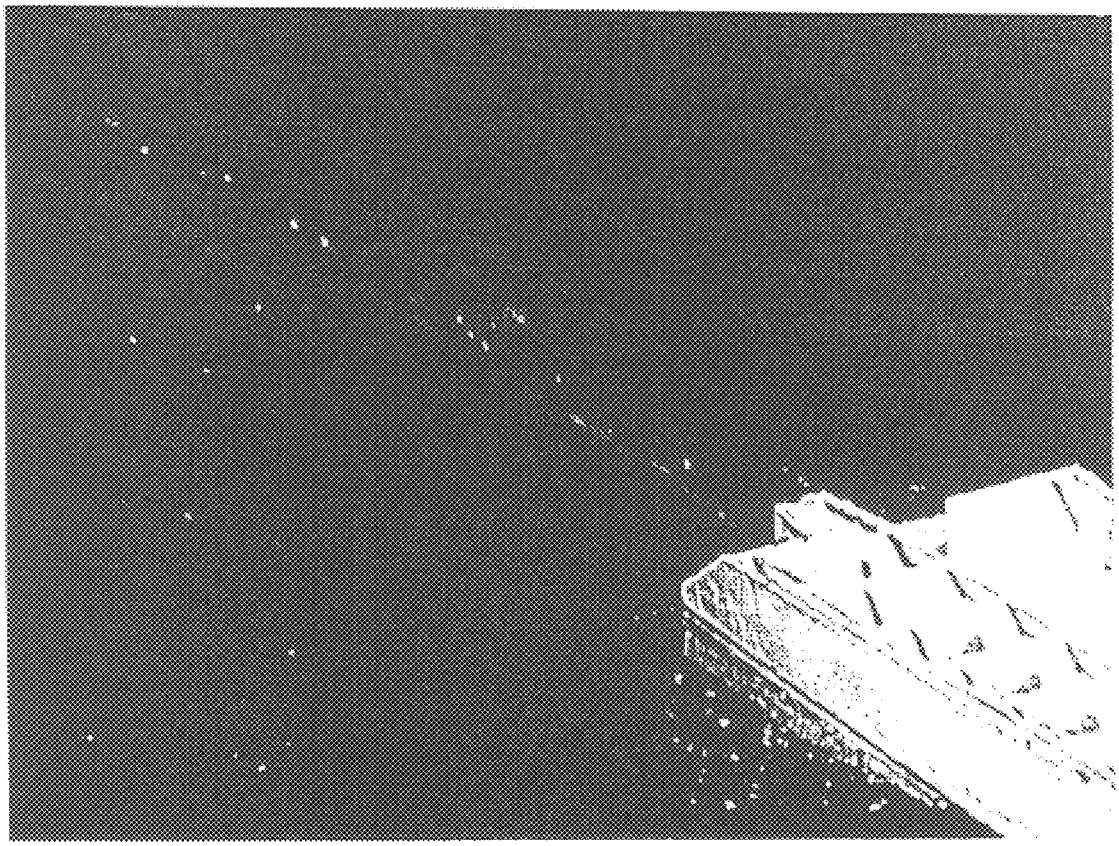
FIG. 59 is a view of the rear of a model boat in operation according to an embodiment of the present invention.
Figure 60:
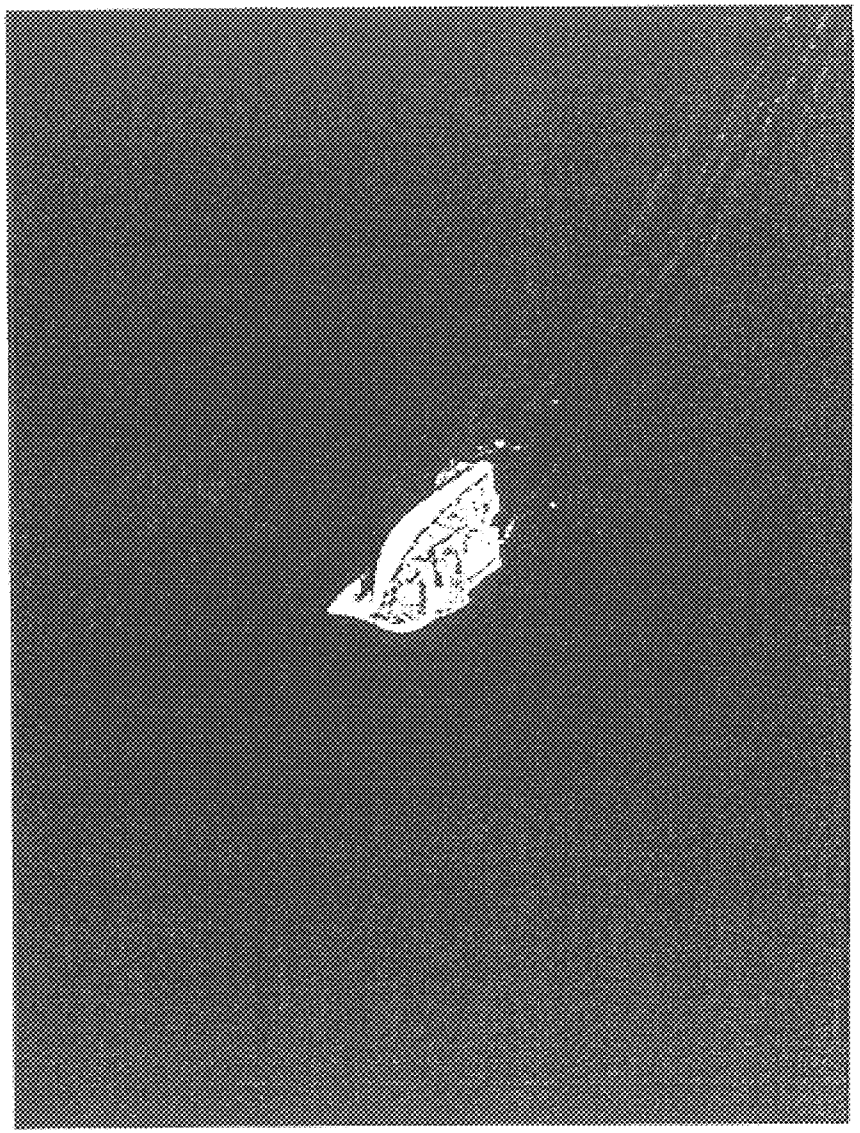
FIG. 60 presents an overhead view of a model boat in operation according to an embodiment of the present invention.
Figure 61:
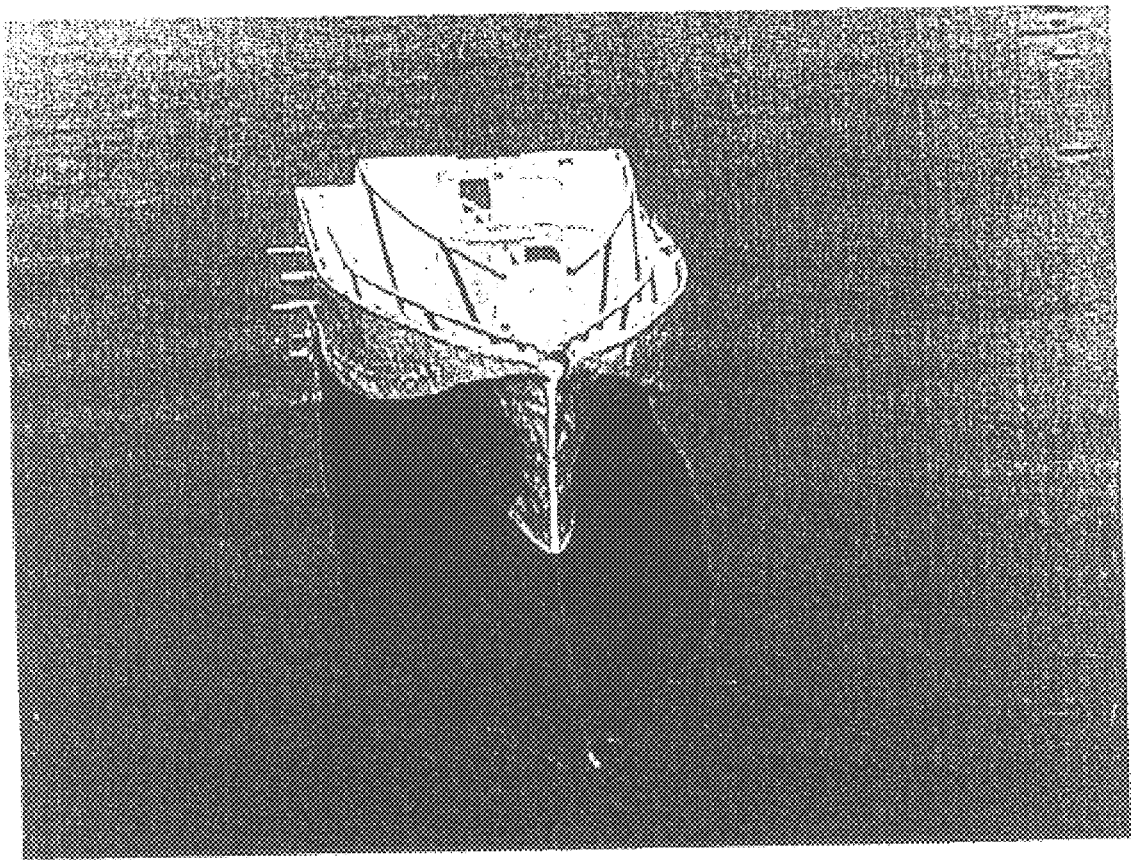
FIG. 61 shows a front view of an afloat model boat according to an embodiment of the present invention.

FIG. 34 illustrates the reduction in wetted length to displacement ratio vs. slenderness offered by the PR and PR-TM hull shapes as compared to the slender Series 64 displacement hulls for $L_W/\nabla^{1/3}$ vs. $L_W/B$. Lower length to displacement ratios indicate greater utility or usefulness for hull shapes, and FIG. 34 shows the corresponding potential for useful smaller displacement hulls operating at higher speeds using PR, PR-T, and PR-TM "type" shapes.

According to an embodiment of the present invention, smaller, slender displacement hulls for operation at speeds corresponding to $0.6 \leqq F_N \leqq 1.2$ are extremely design sensitive to the balance of residuary and friction resistance. This is primarily due to the scale effect on the wetted surface area to displacement ratio:

$$\frac{S_W}{\nabla} = \frac{K}{L}$$

According to an embodiment of the present invention, hull shapes closely approximating half sections of longitudinally nonsymmetrical prolate spheroids, with and without transom sterns, (hull shapes PR, PR-T, and PR-TM) offer the minimum wetted surface area ($S_W$) for a given displacement ($\nabla$) with hull shape coefficients and characteristics strikingly close to those arrived at and being approached empirically for high performance slender displacement hulls.

An embodiment of the present invention incorporates a methodology using data on hulls somewhat similar to the prolate spheroid hull shapes to determine an interrelationship rationale as to what shape-scale-speed combinations perform most advantageously using PR-Type hulls. The design scale, shape, and speed according to this embodiment are such that the following conditions are satisfiable:

$$\frac{R_T}{W_T} \leq 0.1$$

and $$R_F \geqq R_R$$

For values $R_T/W_T \geqq 0.1$ planing hull characteristics are advantageous. For values $R_F \leqq R_R$, the sensitivity to wetted surface area is somewhat reduced, and additional slenderness at the expense of increased wetted surface area are more appropriate.

Since the slenderness for a monohull is limited by the need for inherent lateral stability, only multihulls approach the ultimate potential of the slender displacement hull's performance. This does not preclude the same analyses applied to slender monohulls with non-circular elliptical sections and with the constraint that lateral stability must be a consideration. However, distributing a given displacement among multiple hulls vs. a monohull worsens the scale effect and total wetted surface area increases for a given total displacement (see FIG. 18). Slender multihulls, ranging from trimarans with hardly any displacement distribution to the outriggers, all the way to the "outriggers" bearing all the displacement (the catamarans), can exhibit significant forward motion resistance advantages over laterally stable displacement monohulls. (See FIGS. 19 and 21, Tables 5, shown in FIG. 20, and Table 6, shown in FIG. 22.)

For trimarans to perform most advantageously from a resistance perspective, an embodiment of the present invention includes a determination that displacement distribution to the outrigger be minimal and only that required for lateral stability. However, this means that for a given speed, the center hull and the outriggers operate at a significantly different Froude numbers. From the smaller trimaran perspective, if the PR-Type center hull is designed to operate in the most advantageous range, the outrigger operates in a higher range, where planing characteristics are advantageous. This leads to use of adjustable planing outriggers for smaller high performance powered trimarans with displacement center hulls. For larger trimarans, the PR-Type displacement outrigger is appropriate, while the center displacement hull scale advantage allows still more slender hull design that is less sensitive to wetted surface area. The larger trimaran's center hull is of the PR-Type, but with higher LIB ratios and less transom stern than for the outriggers or for the smaller trimaran center hull.

Appendix 3 contains additional information regarding outrigger hulls.

FIGS. 35–44 contain graphical depictions of various elements of an embodiment of the present invention, as described above.

FIGS. 45A–53 contain various views of vessels designed in accordance with an embodiment of the present invention.

FIGS. 54–61 present various views of a model and the model in operation according to an embodiment of the present invention.

Based on the analysis according to the present invention, it is thus clear that a preferred shape for a slim hull, particularly suitable for use with a trimaran—a shape that suitably maximizes displacement versus wetted surface area—is generally a longitudinal non-symmetrical ellipsoid. Further, the particular characteristics of the ellipsoid will vary with the operating speed of the vessel. It is further clear that a hull shaped as a special type of ellipsoid—a prolate spheroid—provides a preferred special design. Further, the present invention shows that the use of a transom stern provides further advantages in the design a trimaran hull. Advantages in characteristics of the shape of the hull also vary such that both a trimaran and a catamaran shape according to embodiments of the present invention are superior than similarly shaped monohulls.

Further, according to an embodiment of the present invention, the shape of the outrigger hulls varies with hull size and speed. For smaller vessels having a PR-type main hull, adjustable planing outriggers provide superior designs, such that the outriggers have more planing characteristics at higher speeds. For larger vessels of the PR-type outrigger is advantageous in combination with more slender main hull design—such as a PR-type hull with a higher L/B ratio and a less transom stern than the outriggers.

Overall, using Appendix 3 information, according to an embodiment of the present invention, the wetted length to wetted beam ratio should be within the limits:

$$8 \leqq L_W/B_W \leqq 16.$$

Referring to FIGS. 33 and 34, this corresponds to:

$$35 \leqq S_W L_W/\nabla \leqq 75;$$

and $$6 \leqq L_W/\nabla^{1/3} \leqq 10.$$

APPENDIX 1

SURFACE TO VOLUME RATIOS, THE EFFECT OF BODY SHAPE

Depending on shape, three dimensional bodies enclose their respective volumes at varying ratios of surface area to volume. The sphere in particular encloses a given volume with less surface area than any other shape.

The ratio of surface area to volume for a particular shape also changes with scale. This scale effect is where the surface area to volume ratio varies inversely with any given linear dimension of the shape being considered. All enclosed body shapes behave this way. Therefore, the surface area to volume ratio of one shape has to be compared to that of another shape at the same volume for both shapes. For instance the surface area to volume ratio for a cube is always $(6/\pi)^{1/3}$ times that of a sphere of the same volume.

Since the sphere is the shape of minimum surface area to volume ratio, it is useful to compare bodies of other shapes to that of the sphere when evaluating their corresponding surface area to volume ratios. This suggests the term surface to volume shape factor (F) where:

$$F = \frac{\left(\frac{S}{\nabla}\right)_{shape}}{\left(\frac{S}{\nabla}\right)_{sphere}}$$

In the above equation, $\nabla$ shape=$\nabla$ sphere and F for a sphere is equal to 1.

Consider the special case of a body of revolution about a given axis where only the profile of the body and its dimension along the axis of revolution is needed to define the body. Any body section perpendicular to the axis of revolution is circular, the maximum diameter of the body is "B" and the length of the body along the axis of revolution is "L" where $L/B \geqq 1$. In the limiting case where "L" approaches the value of "B" the body approaches the shape of the sphere of diameter "B" (F=1). The question to be considered then is for any value of L/B>1 what body shape(s) provide minimum surface area to volume ratio or minimum F while satisfying the above stated limiting condition when "L" approaches the value "B"?

In an embodiment of the present invention, two basic body shapes are examined that would satisfy the above criteria. One shape consists of a cylindrical section capped on both ends with hemispheres similar to a liquid propane storage tank (the "tank"). The second shape is the prolate spheroid. Of course a third shape consisting of a cylindrical section with ellipsoidal end caps would also satisfy the above criteria.

Figure 64:
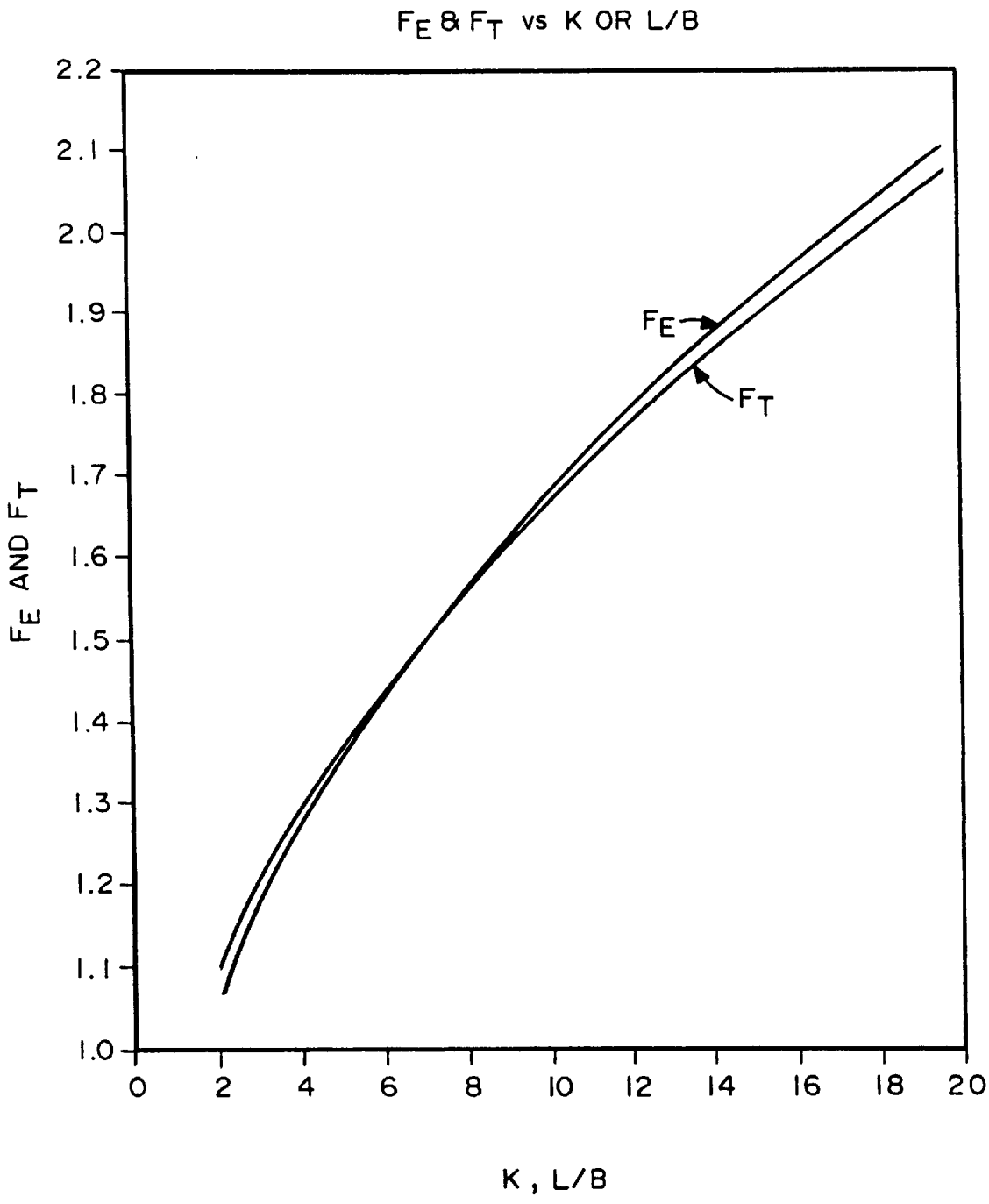
FIG. 64 contains a plot of $F_E$ and $F_T$ versus K or L/B for an embodiment of the present invention.

The shape factor $F_T$ for the tank as calculated is shown in FIG. 62. The prolate spheroid's shape factor $F_E$ as calculated is shown in FIG. 63. F vs. L/B is plotted for both the tank and the prolate spheroid in FIG. 64.

APPENDIX 2

It is not immediately apparent that for surface vessels the logic in Appendix 1 can be extended to wetted hull surfaces and displacements. A sphere just submerged in water has a higher wetted surface to displacement ratio than one just half submerged. So the logic of Appendix 1 leads to the conclusion for an embodiment of the present invention that for surface vessels the hemisphere is probably the shape that gives minimum wetted surface to displacement.

The hypothesis that the hemisphere is the shape of minimum wetted surface area to displacement ratio for a surface vessel is tested below by evaluating a sphere at various levels of submergence and a hemisphere topped with a cylindrical surface at levels of submergence beyond the hemisphere's radius in depth. Both shapes are compared to a hemisphere of the same displacement that is submerged to a depth equal to its radius. See FIGS. 65 and 66.

Figure 67:
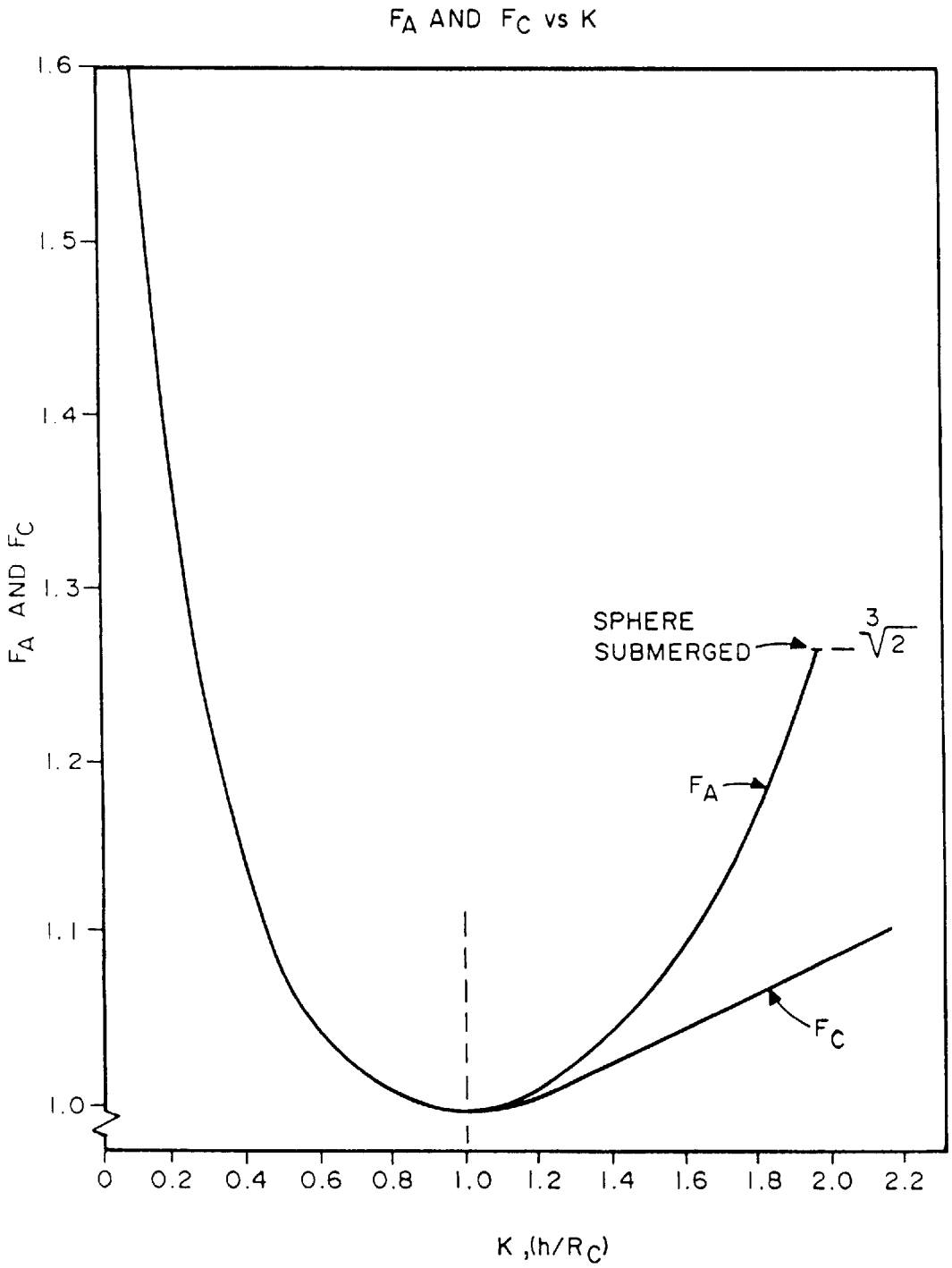
FIG. 67 presents a plot of $F_A$ and $F_C$ versus K for an embodiment of the present invention.

FIG. 67 shows that both bodies shape factor values are minimum when their relative hemispheric sections are just submerged. In an embodiment of the present invention, it is thus concluded that it is the hemispheres of the body shape that provide minimum wetted surface area to displacement for a surface vessel.

APPENDIX 3

Appendix 3 is presented in FIGS. 68–71.

APPENDIX 4

OUTRIGGER HULLS

In an embodiment of the present invention, the outrigger are substantially shorter than the central hull. This means that the $F_N$ for the outrigger hulls is some multiple of that for the central hull is as follows:

$$\frac{F_N\,outriggerhull}{F_N\,centralhull} = \left(\frac{Lcentral}{Loutrigger}\right)^{1/2}$$

With the central hull (48' in length) operating at $F_N$ on the order of 1, a 10 ft. outrigger hull, for instance, operates at $F_N$=2.19 1.

As a result, in an embodiment of the present invention, the outrigger hulls are planing hulls instead of displacement hulls.

In order to assure that the outriggers are planing hulls, for an embodiment of the present invention, the distribution of hydrodynamic and hydrostatic (buoyancy) forces at various speeds is variable by way of adjustable draft and trim for the outrigger hulls. For instance, the outrigger hull should exhibit substantial buoyancy when the boat is moored or at dock, while at cruising speed the outrigger hulls may need to function essentially only as outboard trim tabs.

In an embodiment of the present invention, considerations for longitudinal location of the outrigger hulls include: wave interference among the hulls, the overall trim of the three-hull system at speed, performance in differing seas, righting torque on the central hull, directional stability, and maneuverability.

In an embodiment of the present invention, asymmetrical outrigger planing hulls are given an over all dihedral effect in boat lateral stability, reducing "tunnel" spray, minimizing non-beneficial wave interference and maximizing the tunnel opening.

In an embodiment of the present invention, outrigger hull lateral spacing would hopefully preclude an unwieldy beam such that the boat fits into normal slips while still allowing the desired lateral stability and adequate tunnel between the central hull and the outrigger hulls.

LIST OF SYMBOLS $A_M$ Maximum wetted section area (ft.$^2$)
$A_O$ Wetted stern section area (ft.$^2$)
$A_{WP}$ Water plane area (ft.$^2$)
$A_P$ After perpendicular (most aft. point of Waterplane)
a Major axis length for an ellipse or axis of rotation length for a prolate spheroid
BHP Brake horse power
B The maximum wetted beam (ft.)
b Minor axis length for an ellipse or a prolate spheroid
$C_B$ The block coefficient (Dimensionless)
$C_F$ Coefficient of friction (Dimensionless)
$C_M$ Maximum beam coefficient (Dimensionless)
$C_P$ Prismatic coefficient (Dimensionless)
$C_R$ Residuary coefficient (Dimensionless)
$C_{WP}$ Water plane coefficient (Dimensionless)
F Volume shape factor (Dimensionless) (Appendix 1)
$F_E$ Volume shape factor for prolate spheroid (Dimensionless) (Appendix 1)
$F_N$ Froude number (Dimensionless)
$F_{N\nabla}$ Volumetric Froude number (Dimensionless)
$F_T$ Volume shape factor for tank (Dimensionless) (Appendix 1)
$F_P$ Forward perpendicular (most forward point of waterplane)
g Gravitational acceleration (32.2 ft./sec$^2$)
$g_o$ Conversion constant (32.2 lbm.ft./1 bf. sec.$^2$)
L Length in general (ft.)
$L_W$ Wetted waterline length (ft.)
$L_E$ Length of entry from FP to max. wetted beam (ft.)
LCB Longitudinal center of buoyancy normally referenced from FP (ft.)

$$\frac{L}{\nabla^{\frac{1}{3}}}$$

Length to displacement ratio (Dimensionless)
$P_E$ Effective power (Horsepower)
$P_B$ Brake power (Horsepower)
$P_I$ Indicated power (Horsepower)
R Radius of spherical shape (ft.) (Appendix 1)
$R_F$ Frictional drag (lbf.)
$R_N$ Reynolds number (Dimensionless)
$R_R$ Residuary resistance (lbf)
$R_T$ Total resistance (lbf)
S Surface area in general (ft.$^2$)
$S_E$ Surface area of prolate spheroid (ft.$^2$) (Appendix 1)

$S_T$ Surface area of tank (ft.$^2$) (Appendix 1)
$S_W$ Wetted surface area (ft.$^2$)

$$\frac{SL}{\nabla}$$

Surface to displacement ratio (Dimensionless)
V Hull speed (ft./sec.)
$V_K$ Hull speed (knots)
$V_{MAX}$ Maximum hull speed (knots)
$W_T$. Weight of water displaced by hull (lbf)
x variable distance referenced from maximum beam section (ft.)
$x_1$ Transom stern location aft. of maximum beam section (ft.)
y Dependent variable distance perpendicular to longitudinal centerline (ft.)

GREEK AND NON-ALPHABET SYMBOLS $\nabla$ The volume of water displaced by hull (ft.$^3$)
ρ Salt water density @68° F.=64 lb/ft$^3$
ν The kinematic viscosity of salt water @68° F.=11.34215×$10^6$ ft$^2$

SOME COMMON DEFINITIONS

Block Coefficient;

$$C_B = \frac{\nabla}{LBT}$$

Maximum Beam Coefficient;

$$C_M = \frac{A_M}{BT}$$

Prismatic Coefficient;

$$C_P = \frac{\nabla}{LBT \cdot C_M} = \frac{C_B}{C_M}$$

Waterplane Coefficient;

$$C_{WP} = \frac{A_{WP}}{BL}$$

Froude Number;

$$F_N = \frac{V}{\sqrt{gL}}$$

Volume Froude Number;

$$F_{N\nabla} = \frac{V}{\sqrt{g\nabla^{\frac{1}{3}}}}$$

Reynolds Number;

$$R_N = \frac{VL}{\nu}$$

I claim:

1. A method for displacement hull design of a water vessel having a hull, wherein the hull has a hull shape, a wetted length, a beam, a wetted surface area, a residuary resistance, a prismatic coefficient, a block coefficient, a maximum beam coefficient, and a water plane coefficient, comprising:

constraining the hull such that the hull has slenderness, wherein the hull slenderness comprises the hull having a high ratio of the wetted length to the beam, and the residuary resistance is minimized;

constraining the hull shape such that the hull has the minimum wetted surface area for the hull slenderness; and optimizing the hull shape wherein optimizing the hull shape includes varying the prismatic coefficient, the block coefficient, the maximum beam coefficient, and the water plane coefficient;

wherein the hull has substantially an ellipsoidal shape;

wherein the ellipsoidal shape is a longitudinally non-symmetrical shape;

wherein the hull has a fore, an aft, a center of buoyancy, a length of entry, and an overall length, and wherein the longitudinally non-symmetrical ellipsoidal hull shape has a plurality of design characteristics, the plurality of design characteristics including the longitudinal center located in the aft, and a ratio of the length of entry to the overall length is greater than 0.5;

wherein the hull comprises an entry angle, and wherein the plurality of design characteristics includes refined entry angle and a transom stern;

wherein the hull is substantially a prolate spheroidal shape, and wherein the water vessel comprises a multihull, such that the multihull provides lateral stability;

wherein the water vessel has a waterline, and wherein the water vessel is a trimaran comprising a main center hull and two outrigger hulls, the two outrigger hulls being equally spaced on opposite sides of the main center hull the two outrigger hulls being connected to the main center hull above the waterline; and wherein the two outrigger hulls each have an angular orientation and a vertical orientation relative to the main center hull, and wherein the outrigger hulls are connected to the center hull such that the angular orientation and the vertical orientation of each of the two outrigger hulls is adjustable relative to the main center hull.

2. The method of claim 1, wherein the two outrigger hulls and the main center hull are displacement hulls.

3. The method of claim 1, wherein the outrigger hulls are planing hulls and the main center hull is a displacement hull.

4. The method of claim 1, wherein the two outrigger hulls and the main center hull are planing hulls.

5. A method for displacement hull design of a water vessel having a hull, wherein the hull has a hull shape, a wetted length, a beam, a wetted surface area, a residuary resistance, a prismatic coefficient, a block coefficient, a maximum beam coefficient, and a water plane coefficient, comprising:

constraining the hull such that the hull has slenderness, wherein the hull slenderness comprises the hull having a high ratio of the wetted length to the beam, and the residuary resistance is minimized;

constraining the hull shape such that the hull has the minimum wetted surface area for the hull slenderness; and optimizing the hull shape wherein optimizing the hull shape includes varying the prismatic coefficient, the block coefficient, the maximum beam coefficient, and the water plane coefficient;

wherein the hull has substantially an ellipsoidal shape;

wherein the ellipsoidal shape is a longitudinally non-symmetrical shape;

wherein the hull has a fore, an aft, a center of buoyancy, a length of entry, and an overall length, and wherein the longitudinally non-symmetrical ellipsoidal hull shape has a plurality of design characteristics, the plurality of design characteristics including the longitudinal center located in the aft, and a ratio of the length of entry to the overall length is greater than 0.5;

wherein the hull comprises an entry angle, and wherein the plurality of design characteristics includes refined entry angle and a transom stern;

wherein the hull has a displacement, a friction resistance, and an operation speed, wherein a ratio of the wetted surface area to the displacement is inversely proportional to the wetted length of the hull, and wherein the operation speed of the hull is such that the friction resistance is approximately equal to the residuary resistance, further comprising:

increasing a ratio of the wetted length to the wetted beam of the hull such that the residuary resistance is reduced and such that the wetted surface area and the friction resistance are increased;

constraining the hull such that the hull has a substantially ellipsoidal shape, such that the increased wetted surface area and the increased ratio of the wetted length to the wetted beam of the hull are minimized; and increasing the operation speed such that the substantially ellipsoidal shape includes the transom stern.

6. The method of claim 5, wherein the water vessel comprises a multihull, the multihull including a plurality of hulls, such that the multihull provides lateral stability, further comprising:

constraining at least one of the hulls such that the at least one hull has a substantially prolate spheroidal shape.

7. The method of claim 5, wherein the wetted surface area of the hull is minimized.

8. The method of claim 7, wherein the substantially ellipsoidal shape of the hull provides for an increase in the wetted length to the wetted beam of the hull, with a minimum increase in the wetted surface area to the ratio of the wetted surface area to the displacement.

9. A method for displacement hull design of a water vessel having a hull, wherein the hull has a hull shape, a wetted length, a beam, a wetted surface area, a residuary resistance, a prismatic coefficient, a block coefficient, a maximum beam coefficient, and a water plane coefficient, comprising:

constraining the hull such that the hull has slenderness, wherein the hull slenderness comprises the hull having a high ratio of the wetted length to the beam, and the residuary resistance is minimized;

constraining the hull shape such that the hull has the minimum wetted surface area for the hull slenderness; and optimizing the hull shape wherein optimizing the hull shape includes varying the prismatic coefficient, the block coefficient, the maximum beam coefficient, and the water plane coefficient;

wherein the hull has substantially an ellipsoidal shape;

wherein the ellipsoidal shape is a longitudinally non-symmetrical shape;

wherein the hull has a fore, an aft, a center of buoyancy, a length of entry, and an overall length, and wherein the longitudinally non-symmetrical ellipsoidal hull shape has a plurality of design characteristics, the plurality of design characteristics including the longitudinal center located in the aft, and a ratio of the length of entry to the overall length is greater than 0.5;

wherein the hull comprises an entry angle;

wherein the plurality of design characteristics includes refined entry angle, wherein the hull has a displacement, a friction resistance, and an operation speed;

wherein a ratio of the wetted surface area to the displacement is inversely proportional to the wetted length of the hull;

wherein the operation speed of the hull is such that the friction resistance is approximately equal to the residuary resistance;

wherein the water vessel comprises a multihull, such that the multihull provides lateral stability, further comprising:

constraining the at least one hull such that the at least one hull has a substantially prolate spheroidal shape;

increasing a ratio of the wetted length to the wetted beam of the at least one hull such that the residuary resistance is reduced and such that the wetted surface area and the friction resistance are increased;

constraining the at least one hull such that the hull has a substantially ellipsoidal shape, such that the increased wetted surface area and the increased ratio of the wetted length to the wetted beam of the at least one hull are minimized; and increasing the operation speed of the at least one hull such that the substantially ellipsoidal shape includes the transom stern.

10. The method of claim 9, wherein the water vessel is a catamaran.

11. The method of claim 9, wherein the water vessel has a waterline, and wherein the water vessel is a trimaran comprising a main center hull and two outrigger hulls, the two outrigger hulls being equally spaced on opposite sides of the main center hull, the two outrigger hulls being connected to the main center hull above the waterline.

12. The method of claim 11, wherein the water vessel has a displacement distribution between the main center hull and the two outrigger hulls, such that the main center hull has a main center hull displacement and each of the outrigger hulls has an outrigger displacement, and wherein the main center hull displacement greatly exceeds the displacement of the outrigger hulls, such that the outrigger hulls provide primarily lateral stability.

13. The method of claim 12, wherein the displacement distribution is such that the outrigger hulls comprise less than 20 percent of the displacement of the water vessel.

14. The method of claim 11, wherein the main center hull has a main center hull wetted length and a main center hull Froude Number, wherein each of the outrigger hulls has a Froude Number, and wherein the main center hull has the operation speed and the wetted length such that the Froude Number of the main center hull is greater than 0.48 and the Froude Number of each of the outrigger hulls has a Froude Number greater than the Froude Number of the main center hull.

15. The method of claim 14, wherein the main center hull has substantially a prolate spheroidal longitudinally non-symmetrical shape;

wherein the main center hull has a fore, an aft, a center of buoyancy, a length of entry, and an overall length, and wherein the main center hull shape has a plurality of design characteristics, the plurality of design characteristics including the longitudinal center of buoyancy located in the aft, and a ratio of the length of entry to the overall length is greater than 0.5;

wherein the main center hull comprises an entry angle, and wherein the plurality of design characteristics includes refined entry angle and a transom stern;

wherein the water vessel comprises a multihull, such that the multihull provides lateral stability;

wherein the two outrigger hulls each have an angular orientation and a vertical orientation relative to the main center hull, and wherein the outrigger hulls are connected to the center hull such that the angular orientation and the vertical orientation of each of the two outrigger hulls is adjustable relative to the main center hull;

wherein the two outrigger hulls and the main center hull are displacement hulls; and wherein each of the outrigger hulls has a frictional drag, a weight of water displaced by the outrigger hull, a residuary resistance, a total resistance, and a total specific resistance, such that the frictional drag is at least equal to the residuary resistance, and such that a ratio of the total resistance to the weight of water displaced by the outrigger hull is not more than 0.10.

16. The method of claim 14, wherein the main center hull has substantially a prolate spheroidal longitudinally non-symmetrical shape;

wherein the main center hull has a fore, an aft, a center of buoyancy, a length of entry, and an overall length, and wherein the hull shape has a plurality of design characteristics, the plurality of design characteristics including the longitudinal center located in the aft, and a ratio of the length of entry to the overall length is greater than 0.5;

wherein the main center hull comprises an entry angle, and wherein the plurality of design characteristics includes refined entry angle and a transom stern;

wherein the water vessel comprises a multihull, such that the multihull provides lateral stability;

wherein the two outrigger hulls each have an angular orientation and a vertical orientation relative to the main center hull, and wherein the outrigger hulls are connected to the center hull such that the angular orientation and the vertical orientation of each of the two outrigger hulls is adjustable relative to the main center hull;

wherein the outrigger hulls are planing hulls and the main center hull is a displacement hull; and wherein each of the outrigger hulls has a frictional drag, a weight of water displaced by the outrigger hull, a residuary resistance, a total resistance, and a total specific resistance, such that the frictional drag is at least equal to the residuary resistance, and such that a ratio of the total resistance to the weight of water displaced by the outrigger hull is not more than 0.10.

17. A method for displacement hull design of a water vessel having a hull, wherein the hull has a hull shape, a wetted length, a beam, a wetted surface area, a residuary resistance, a prismatic coefficient, a block coefficient, a maximum beam coefficient, and a water plane coefficient, comprising:

constraining the hull such that the hull has slenderness, wherein the hull slenderness comprises the hull having a high ratio of the wetted length to the beam, and the residuary resistance is minimized;

constraining the hull shape such that the hull has the minimum wetted surface area for the hull slenderness; and optimizing the hull shape wherein optimizing the hull shape includes varying the prismatic coefficient, the block coefficient, the maximum beam coefficient, and the water plane coefficient;

wherein the hull has substantially an ellipsoidal shape;

wherein the ellipsoidal shape is a longitudinally non-symmetrical shape;

wherein the hull has a fore, an aft, a center of buoyancy, a length of entry, and an overall length, and wherein the longitudinally non-symmetrical ellipsoidal hull shape has a plurality of design characteristics, the plurality of design characteristics including the longitudinal center located in the aft, and a ratio of the length of entry to the overall length is greater than 0.5;

wherein the hull comprises an entry angle, and wherein the plurality of design characteristics includes refined entry angle and a transom stern;

wherein the hull is substantially a prolate spheroidal shape, and wherein the water vessel comprises a multihull, such that the multihull provides lateral stability;

wherein the hull has a wetted beam and a ratio of the wetted length to the wetted beam is at least 8 and not more than 16.

18. The method of claim 17, wherein the hull has a displacement, wherein a ratio of the product of the wetted surface area and the wetted length to the displacement is at least 35 and not more than 75, and wherein a ratio of the wetted length to the cube root of the displacement is at least 6 and not more than 10.

19. A method for displacement hull design of a water vessel having a hull, wherein the hull has a hull shape, a wetted length, a beam, a wetted surface area, a residuary resistance, a prismatic coefficient, a block coefficient, a maximum beam coefficient, and a water plane coefficient, comprising:

constraining the hull such that the hull has slenderness, wherein the hull slenderness comprises the hull having a high ratio of the wetted length to the beam, and the residuary resistance is minimized;

constraining the hull shape such that the hull has the minimum wetted surface area for the hull slenderness; and optimizing the hull shape wherein optimizing the hull shape includes varying the prismatic coefficient, the block coefficient, the maximum beam coefficient, and the water plane coefficient;

wherein the hull has substantially an ellipsoidal shape;

wherein the ellipsoidal shape is a longitudinally non-symmetrical shape;

wherein the hull has a fore, an aft, a center of buoyancy, a length of entry, and an overall length, and wherein the longitudinally non-symmetrical ellipsoidal hull shape has a plurality of design characteristics, the plurality of design characteristics including the longitudinal center located in the aft, and a ratio of the length of entry to the overall length is greater than 0.5;

wherein the hull comprises an entry angle, and wherein the plurality of design characteristics includes refined entry angle and a transom stern;

wherein the hull is substantially a prolate spheroidal shape, and wherein the water vessel comprises a multihull, such that the multihull provides lateral stability, the multihull including a first hull and at least second and third longitudinally extended hulls that are spaced from the first hull, each of the first, second, and third hulls having a water line, and the hulls being connected to one another above the water line, at least one of the hulls constituting a main hull and the other hulls constituting outrigger hulls, the outrigger hulls being spaced on opposite sides of the main hull, the main hull having a bow and a stern, a stern wetted section area, a wetted section area, a maximum beam coefficient, a prismatic coefficient, a block coefficient, a water plane coefficient, a surface area, a displacement, a longitudinal center of buoyancy, a forward perpendicular, a length, a length of entry from the forward perpendicular, and a maximum wetted beam, at least one of the hulls further comprising:

a longitudinally nonsymmetrical prolate spheroid shape of the PR-type, wherein the prolate spheroid has a shape of a prolate spheroid having a longitudinal axis and two axes perpendicular to the longitudinal axis, the longitudinal axis further comprising a major longitudinal axis and a minor longitudinal axis, and wherein the two axes perpendicular to the longitudinal axis have the same length;

wherein the hull has a circular hull section at any section along the longitudinal axis;

wherein the longitudinal center of buoyancy and wherein a ratio of the length of entry from forward perpendicular to the wetted waterline length is variable;

wherein the major longitudinal axis has a length $a_2$ and describes a curve $y_2$, and the minor longitudinal axis has a length $a_1$ and describes a curve $y_1$, wherein $a_1$ equals the length times a fraction f, wherein $a_2$ equals the length times a fraction (1−f), wherein the hull has minor axes of length b, wherein $a_1 \leqq a_2$, and wherein the maximum beam B=2b;

wherein the major longitudinal axis, the minor longitudinal axis, and the two axes perpendicular to the longitudinal axis further meet a plurality of constraints, the constraints comprising:

$$x_1^2/a_1^2+y_1^2/b^2=1; \text{ and}$$

$$x_1^2/a_2^2+y_2^2/b^2=1;$$

the maximum beam coefficient is π/4;

the prismatic coefficient is ⅔;

the block coefficient is π/6;

the water plane coefficient is π/4;

the longitudinal center of buoyancy normally reference from the forward perpendicular is equal to a product of one quarter of the length and the fraction (½−f);

a ratio of the wetted surface area times the wetted waterline length to displacement is expressible by an equation, wherein the equation is $3+3L/B[(f\sin^{-1}\epsilon_1)/\epsilon_1+(1-f)(\sin^{-1}\epsilon_2)/\epsilon_2]$, wherein:

$$\epsilon_1 = \sqrt{1-\left(\frac{b}{fL}\right)^2}\,;\ \epsilon_2 = \sqrt{1-\left(\frac{b}{(1-f)L}\right)^2}\,;\ \text{and}\ L_E/L = (1-f).$$

.

20. The method of claim 19, wherein the water vessel has a minimum operation speed, such that the Froude Number is at least 0.48 for the minimum operation speed.

21. The method of claims 19, wherein the hull is substantially a prolate spheroidal shape type PR-T, and wherein the water vessel comprises a multihull, such that the multihull provides lateral stability, the multihull including a first hull and at least second and third longitudinally extended hulls that are spaced from the first hull, each of the first, second, and third hulls having a water line, and the hulls being connected to one another above the water line, at least one of the hulls constituting a main hull and the other hulls constituting outrigger hulls, the outrigger hulls being spaced on opposite sides of the main hull, the main hull having a bow and a stern, a stern wetted section area, a maximum wetted section area, a maximum beam coefficient, a prismatic coefficient, a block coefficient, a water plane coefficient, a surface area, a displacement, a longitudinal center of buoyancy, a forward perpendicular, a length, a length of entry from the forward perpendicular, a maximum wetted beam, and the transom stern located at a location $x_1$, at least one of the hulls further comprising:

a transom stern located at a location $x_1$ on the longitudinal axis;

the maximum beam coefficient is π/4;

$0<x_1<a_1$;

the block coefficient is equal to $\pi/4[a_1(x_1/a_1-x_1^3/3a_1^2)+2a_2/3](x_1+a_2)^{-1}$;

the prismatic coefficient is equal to a ratio of the block coefficient to the maximum beam coefficient;

the water plane coefficient is:

$$C_{WP} = \frac{a_2}{2(x_1+a_2)}\left[\frac{x_1}{a_1}\sqrt{1-\left(\frac{x_1}{a_1}\right)^2}+\sin^{-1}\left(\frac{x_1}{a_1}\right)+\frac{\pi\cdot a_2}{2a_1}\right];$$

the longitudinal center of buoyancy is:

$$[(a_2^2/4)(x_1^2/2)+x_1^4/4a_1^2)]/[x_1-(x_1^3/3a_1^2)+2a_2/3)];$$

a ratio of the length of entry from the forward perpendicular to the wetted waterline length is:

$$a_2/(x_1+a_2);$$

a ratio of a product of the wetted surface area and the wetted waterline length to the displacement is:

$$\frac{S_W L}{\nabla} = \frac{(x_1+a_2)}{b}\left[\frac{2\int_0^{x_1}\left[1-\left(1-\frac{b^2}{a_1^2}\right)\left(\frac{x}{a_1}\right)^2\right]^{\frac{1}{2}}dx+\frac{a_2\sin^{-1}\epsilon}{\epsilon}+b}{x_1-\frac{x_1^3}{3a_1^2}+\frac{2a_2}{3}}\right],$$

wherein:

$$\epsilon = \sqrt{1 - \left(\frac{b}{a_2}\right)^2}.$$

.

22. The method of claim 21, wherein the hull has substantially a prolate spheroidal longitudinally non-symmetrical shape;

wherein the at least one hull has a fore, an aft, a center of buoyancy, a length of entry, and an overall length, and wherein the hull shape has a plurality of design characteristics, the plurality of design characteristics including the longitudinal center located in the aft, and a ratio of the length of entry to the overall length is greater than 0.5;

wherein the at least one hull comprises an entry angle, and wherein the plurality of design characteristics includes refined entry angle and a transom stern;

wherein the water vessel comprises a multihull, such that the multihull provides lateral stability;

wherein the water vessel has a waterline, and wherein the water vessel is a trimaran comprising a main center hull and two outrigger hulls, the two outrigger hulls being equally spaced on opposite sides of the main center hull, the two outrigger hulls being connected to the main center hull above the waterline;

wherein the two outrigger hulls each have an angular orientation and a vertical orientation relative to the main center hull, and wherein the outrigger hulls are connected to the center hull such that the angular orientation and the vertical orientation of each of the two outrigger hulls is adjustable relative to the main center hull;

wherein the two outrigger hulls and the main center hull are displacement hulls;

wherein each of the outrigger hulls has a frictional drag, a weight of water displaced by the outrigger hull, a residuary resistance, a total resistance, and a total specific resistance, such that the frictional drag is at least equal to the residuary resistance, and such that a ratio of the total resistance to the weight of water displaced by the outrigger hull is not more than 0.10; and wherein the hull has an operation speed, a stern, and a water line, such that at the operation speed, the stern is above the water line.

23. The method of claim 21, wherein the hull has substantially a prolate spheroidal longitudinally non-symmetrical shape;

wherein the at least one hull has a fore, an aft, a center of buoyancy, a length of entry, and an overall length, and wherein the hull shape has a plurality of design characteristics, the plurality of design characteristics including the longitudinal center located in the aft, and a ratio of the length of entry to the overall length is greater than 0.5;

wherein the at least one hull comprises an entry angle, and wherein the plurality of design characteristics includes refined entry angle and a transom stern;

wherein the water vessel comprises a multihull, such that the multihull provides lateral stability;

wherein the water vessel has a waterline, and wherein the water vessel is a trimaran comprising a main center hull and two outrigger hulls, the two outrigger hulls being equally spaced on opposite sides of the main center hull, the two outrigger hulls being connected to the main center hull above the waterline;

wherein the two outrigger hulls each have an angular orientation and a vertical orientation relative to the main center hull, and wherein the outrigger hulls are connected to the center hull such that the angular orientation and the vertical orientation of each of the two outrigger hulls is adjustable relative to the main center hull;

wherein the outrigger hulls are planing hulls and the main center hull is a displacement hull;

wherein each of the outrigger hulls has a frictional drag, a weight of water displaced by the outrigger hull, a residuary resistance, a total resistance, and a total specific resistance, such that the frictional drag is at least equal to the residuary resistance, and such that a ratio of the total resistance to the weight of water displaced by the outrigger hull is not more than 0.10; and wherein the hull has an operation speed, a stern, and a water line, such that at the operation speed, the stern is above the water line.

24. The method of claim 21, wherein $x_1$ and $a_1$, relative to $a_2$ for the at least one hull meet a further plurality of constraints, the further plurality of constraints comprising:

$a_1=a_2=a$;

$x_1=a/2$, the hull has a shape PR-TM;

the block coefficient is $3\pi/16$;

the prismatic coefficient is ¾;

the water plane coefficient is a maximum and is equal to 0.8425;

a ratio of product of the wetted surface area and the wetted waterline length to the displacement is a minimum;

the hull length compared to maximum wetted beam is 3a/4b;

a ratio of the longitudinal center of buoyancy normally reference from the forward perpendicular to the length is 7/12;

a ratio of the length of entry from the forward perpendicular to the maximum wetted beam to length is ⅔; and a ratio of the stern wetted section area to the maximum wetted section area is ¾.

25. The method of claim 24, wherein the at least one hull has substantially a prolate spheroidal longitudinally non-symmetrical shape;

wherein the at least one hull has a fore, an aft, a center of buoyancy, a length of entry, and an overall length, and wherein the hull shape has a plurality of design characteristics, the plurality of design characteristics including the longitudinal center located in the aft, and a ratio of the length of entry to the overall length is greater than 0.5;

wherein the at least one hull comprises an entry angle, and wherein the plurality of design characteristics includes refined entry angle and a transom stern;

wherein the water vessel comprises a multihull, such that the multihull provides lateral stability;

wherein the water vessel has a waterline, and wherein the water vessel is a trimaran comprising a main center hull and two outrigger hulls, the two outrigger hulls being equally spaced on opposite sides of the main center hull, the two outrigger hulls being connected to the main center hull above the waterline;

wherein the two outrigger hulls each have an angular orientation and a vertical orientation relative to the main center hull, and wherein the outrigger hulls are connected to the center hull such that the angular orientation and the vertical orientation of each of the two outrigger hulls is adjustable relative to the main center hull;

wherein the two outrigger hulls and the main center hull are displacement hulls;

wherein each of the outrigger hulls has a frictional drag, a weight of water displaced by the outrigger hull, a residuary resistance, a total resistance, and a total specific resistance, such that the frictional drag is at least equal to the residuary resistance, and such that a ratio of the total resistance to the weight of water displaced by the outrigger hull is not more than 0.10;

wherein the Froude Number is at least 1.0; and wherein the hull has an operation speed, a stern, and a water line, such that at the operation speed, the stern is above the water line.

26. The method of claim 24, wherein the at least one hull has substantially a prolate spheroidal longitudinally non-symmetrical shape;

wherein the at least one hull has a fore, an aft, a center of buoyancy, a length of entry, and an overall length, and wherein the hull shape has a plurality of design characteristics, the plurality of design characteristics including the longitudinal center located in the aft, and a ratio of the length of entry to the overall length is greater than 0.5;

wherein the at least one hull comprises an entry angle, and wherein the plurality of design characteristics includes refined entry angle and a transom stern;

wherein the water vessel comprises a multihull, such that the multihull provides lateral stability;

wherein the water vessel has a waterline, and wherein the water vessel is a trimaran comprising a main center hull and two outrigger hulls, the two outrigger hulls being equally spaced on opposite sides of the main center hull, the two outrigger hulls being connected to the main center hull above the waterline;

wherein the two outrigger hulls each have an angular orientation and a vertical orientation relative to the main center hull, and wherein the outrigger hulls are connected to the center hull such that the angular orientation and the vertical orientation of each of the two outrigger hulls is adjustable relative to the main center hull;

wherein the outrigger hulls are planing hulls and the main center hull is a displacement hull; wherein each of the outrigger hulls has a frictional drag, a weight of water displaced by the outrigger hull, a residuary resistance, a total resistance, and a total specific resistance, such that the frictional drag is at least equal to the residuary resistance, and such that a ratio of the total resistance to the weight of water displaced by the outrigger hull is not more than 0.10;

wherein the Froude Number is at least 1.0; and wherein the hull has an operation speed, a stern, and a water line, such that at the operation speed, the stern is above the water line.

27. The method of claim 24, wherein the at least one hull has substantially a prolate spheroidal longitudinally non-symmetrical shape;

wherein the at least one hull has a fore, an aft, a center of buoyancy, a length of entry, and an overall length, and wherein the hull shape has a plurality of design characteristics, the plurality of design characteristics including the longitudinal center located in the aft, and a ratio of the length of entry to the overall length is greater than 0.5;

wherein the at least one hull comprises an entry angle, and wherein the plurality of design characteristics includes refined entry angle and a transom stern;

wherein the water vessel comprises a multihull, such that the multihull provides lateral stability;

wherein the water vessel has a waterline, and wherein the water vessel is a trimaran comprising a main center hull and two outrigger hulls, the two outrigger hulls being equally spaced on opposite sides of the main center hull, the two outrigger hulls being connected to the main center hull above the waterline;

wherein the two outrigger hulls each have an angular orientation and a vertical orientation relative to the main center hull, and wherein the outrigger hulls are connected to the center hull such that the angular orientation and the vertical orientation of each of the two outrigger hulls is adjustable relative to the main center hull;

wherein the two outrigger hulls and the main center hull are displacement hulls;

wherein each of the outrigger hulls has a frictional drag, a weight of water displaced by the outrigger hull, a residuary resistance, a total resistance, and a total specific resistance, such that the frictional drag is at least equal to the residuary resistance, and such that a ratio of the total resistance to the weight of water displaced by the outrigger hull is not more than 0.10;

wherein the Froude Number is at least 1.0; and wherein the hull has an operation speed, a stern, and a water line, such that at the operation speed, the stern is dry.

28. The method of claim 24, wherein the at least one hull has substantially a prolate spheroidal longitudinally non-symmetrical shape;

wherein the at least one hull has a fore, an aft, a center of buoyancy, a length of entry, and an overall length, and wherein the hull shape has a plurality of design characteristics, the plurality of design characteristics including the longitudinal center located in the aft, and a ratio of the length of entry to the overall length is greater than 0.5;

wherein the at least one hull comprises an entry angle, and wherein the plurality of design characteristics includes refined entry angle and a transom stern;

wherein the water vessel comprises a multihull, such that the multihull provides lateral stability;

wherein the water vessel has a waterline, and wherein the water vessel is a trimaran comprising a main center hull and two outrigger hulls, the two outrigger hulls being equally spaced on opposite sides of the main center hull, the two outrigger hulls being connected to the main center hull above the waterline;

wherein the two outrigger hulls each have an angular orientation and a vertical orientation relative to the main center hull, and wherein the outrigger hulls are connected to the center hull such that the angular orientation and the vertical orientation of each of the two outrigger hulls is adjustable relative to the main center hull;

wherein the outrigger hulls are planing hulls and the main center hull is a displacement hull;

wherein each of the outrigger hulls has a frictional drag, a weight of water displaced by the outrigger hull, a residuary resistance, a total resistance, and a total specific resistance, such that the frictional drag is at least equal to the residuary resistance, and such that a ratio of the total resistance to the weight of water displaced by the outrigger hull is not more than 0.10;

wherein the Froude Number is at least 1.0; and wherein the hull has an operation speed, a stern, and a water line, such that at the operation speed, the stern is dry.

29. The method of claim 24, wherein the at least one hull has substantially a prolate spheroidal longitudinally non-symmetrical shape;

wherein the at least one hull has a fore, an aft, a center of buoyancy, a length of entry, and an overall length, and wherein the hull shape has a plurality of design characteristics, the plurality of design characteristics including the longitudinal center located in the aft, and a ratio of the length of entry to the overall length is greater than 0.5;

wherein the at least one hull comprises an entry angle, and wherein the plurality of design characteristics includes refined entry angle and a transom stern;

wherein the water vessel comprises a multihull, such that the multihull provides lateral stability;

wherein the water vessel has a waterline, and wherein the water vessel is a trimaran comprising a main center hull and two outrigger hulls, the two outrigger hulls being equally spaced on opposite sides of the main center hull, the two outrigger hulls being connected to the main center hull above the waterline;

wherein the two outrigger hulls each have an angular orientation and a vertical orientation relative to the main center hull, and wherein the outrigger hulls are connected to the center hull such that the angular orientation and the vertical orientation of each of the two outrigger hulls is adjustable relative to the main center hull;

wherein the outrigger hulls and the main center hull are planing hulls;

wherein each of the outrigger hulls has a frictional drag, a weight of water displaced by the outrigger hull, a residuary resistance, a total resistance, and a total specific resistance, such that the frictional drag is at least equal to the residuary resistance, and such that a ratio of the total resistance to the weight of water displaced by the outrigger hull is not more than 0.10;

wherein the Froude Number is at least 1.0; and wherein the hull has an operation speed, a stern, and a water line, such that at the operation speed, the stern is dry.

30. A water going vessel having at least a first longitudinally extending hull, wherein the first hull has a longitudinally non-symmetrical ellipsoidal shape, the vessel further comprising:

at least second and third longitudinally extended hulls that are spaced from the first hull, each of the first, second, and third hulls having a water line, and the hulls being connected to one another above the water line, one of the hulls constituting a main hull and the other hulls constituting outrigger hulls, the outrigger hulls being spaced on opposite sides of the main hull, the main hull having a bow and a stern, a stern wetted section area, a wetted section area, a maximum beam coefficient, a prismatic coefficient, a block coefficient, a water plane coefficient, a surface area, a displacement, a longitudinal center of buoyancy, a forward perpendicular, a length, a length of entry from the forward perpendicular, and a maximum wetted beam, the main hull further comprising:

a prolate spheroid shape of PR-TM type, wherein the prolate spheroid has a shape of an ellipsoid having a longitudinal axis and two axes perpendicular to the longitudinal axis, the longitudinal axis further comprising a major longitudinal axis and a minor longitudinal axis, and wherein the two axes perpendicular to the longitudinal axis have the same length;

wherein the major axis of the main hull has a length a, the major axis extending from the bow to a point of maximum for the wetted section area, wherein the distance from the maximum wetted section area to the stern has a length a/2, and wherein the main hull has minor axes of length b; and wherein the stern wetted section area to the maximum wetted section area is ¾;

the maximum beam coefficient is $\pi/4$;

the prismatic coefficient is ¾;

the block coefficient is $3\pi/16$;

the water plane coefficient is 0.8425;

the surface area to displacement ratio for the hull length to maximum wetted beam ratio is a minimum;

a ratio of the longitudinal center of buoyancy normally reference from the forward perpendicular to the length is 0.5833;

a ratio of the length of entry from the forward perpendicular to the maximum wetted beam to length is 0.6667; and the hull length compared to the maximum wetted beam is 3a/4b.

31. A water going vessel having at least a first longitudinally extending hull, wherein the first hull has a longitudinally non-symmetrical ellipsoidal shape, the vessel further comprising:

at least second and third longitudinally extended hulls that are spaced from the first hull, each of the first, second, and third hulls having a water line, and the hulls being connected to one another above the water line, at least one of the hulls constituting a main hull and the other hulls constituting outrigger hulls, the outrigger hulls being spaced on opposite sides of the main hull, the main hull having a bow and a stern, a stern wetted section area, a wetted section area, a maximum beam coefficient, a prismatic coefficient, a block coefficient, a water plane coefficient, a surface area, a wetted surface area, a wetted waterline length, a displacement, a longitudinal center of buoyancy, a forward perpendicular, a length, a length of entry from the forward perpendicular, and a maximum wetted beam, the main hull further comprising:

a longitudinally nonsymmetrical prolate spheroid shape of PR-type, wherein the prolate spheroid has a shape of an ellipsoid having a longitudinal axis and two axes perpendicular to the longitudinal axis, the longitudinal axis further comprising a major longitudinal axis and a minor longitudinal axis, and wherein the two axes perpendicular to the longitudinal axis have the same length;

wherein the major longitudinal axis has a length $a_1$ and describes a curve $y_1$, and the minor longitudinal axis has a length $a_2$ and describes a curve $y_2$, wherein $a_1$ equals the length times a fraction f, wherein $a_2$ equals the length times a fraction (1−f), and wherein the hull has minor axes of length b;

wherein the major longitudinal axis, the minor longitudinal axis, and the two axes perpendicular to the longitudinal axis further meet a plurality of constraints, the constraints comprising:

$$x^2/a_1^2+y_1^2/b^2=1; \text{ and}$$

$$x^2/a_2^2+y_2^2/b^2=1;$$

$$\text{for } b/L \leqq f \leqq ½ \text{ and } L/B \geqq 1; \text{ and}$$

wherein the maximum beam coefficient is π/4;

the prismatic coefficient is ⅔;

the block coefficient is π/6;

the water plane coefficient is π/4;

the surface area to displacement ratio for the given hull length to maximum wetted beam ratio is a minimum;

the longitudinal center of buoyancy normally reference from the forward perpendicular is equal to one quarter of the length;

a ratio of the wetted surface area times the wetted waterline length to displacement is expressible by an equation, wherein the equation is $3+3L/B[(f\sin^{-1}\epsilon_1)/\epsilon_1+(1-f)(\sin^{-1}\epsilon_2)/\epsilon_2]$; and $$L_E/L=1-f=a_2/(a_1+a_2).$$

32. A water going vessel having a main hull, wherein the main hull has a longitudinally non-symmetrical ellipsoidal shape, the vessel further comprising:

at least second and third longitudinally extended hulls that are spaced from the main hull, each of the main, second, and third hulls having a water line, and the hulls being connected to one another above the water line, the second and third hulls constituting outrigger hulls, the outrigger hulls being spaced on opposite sides of the main hull;

wherein the main hull has a bow and a stern, a wetted section area, a maximum beam coefficient, a block coefficient, a prismatic coefficient, a water plane coefficient, a longitudinal center of buoyancy, a forward perpendicular, a length, a length of entry from the forward perpendicular, and a wetted surface area, at least one of the hulls further comprising:

a longitudinally nonsymmetrical prolate spheroid shape of PR-T type, wherein the prolate spheroid has a shape of an ellipsoid having a longitudinal axis and two axes perpendicular to the longitudinal axis, the longitudinal axis further comprising a first longitudinal axis and a second longitudinal axis, and wherein the two axes perpendicular to the longitudinal axis have equal length;

wherein the first axis of the hull has a length $a_2$, the first axis extending from the bow to a point of maximum for the wetted section area, wherein the distance from the maximum point of the wetted section area to the stern has a length $x_1$; and wherein the maximum beam coefficient is π/4;

wherein $0<x_1<a_1$;

wherein the block coefficient is equal to $\pi/4[a_1(x_1/a_1-x_1^3/3a_1^2)+2a_2/3](x_1+a_2)^{-1}$;

wherein the prismatic coefficient is equal to a ratio of the block coefficient to the maximum beam coefficient;

wherein the water plane coefficient is:

$$C_{WP}=\frac{a_2}{2(x_1+a_2)}\left[\frac{x_1}{a_1}\sqrt{1-\left(\frac{x_1}{a_1}\right)^2}+\sin^{-1}\left(\frac{x_1}{a_1}\right)+\frac{\pi\cdot a_2}{2a_1}\right];$$

wherein the longitudinal center of buoyancy is:

$$[(a_2/4)(x_1/2)+x_1^4/4a_1^2)]/[x_1-(x_1^3/3a_1^2)+2a_2/3)];$$

wherein a ratio of the length of entry from the forward perpendicular to the wetted waterline length is:

$$a_2/(x_1+a_2);$$

wherein a ratio of a product of the wetted surface area ($S_W$) and the wetted waterline length (L) to the displacement (▽) is:

$$\frac{S_W L}{\nabla}=\frac{(x_1+a_2)}{b}\left[\frac{2\int_0^{x_1}\left[1-\left(1-\frac{b^2}{a_1^2}\right)\left(\frac{x}{a_1}\right)^2\right]^{\frac{1}{2}}dx+\frac{a_2\sin^{-1}\epsilon}{\epsilon}+b}{x_1-\frac{x_1^3}{3a_1^2}+\frac{2a_2}{3}}\right],$$

wherein:

$$\epsilon=\sqrt{1-\left(\frac{b}{a_2}\right)^2}.$$

* * * * *